US009182687B2

(12) United States Patent
Sasaki et al.

(10) Patent No.: US 9,182,687 B2
(45) Date of Patent: Nov. 10, 2015

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Tomoya Sasaki, Kanagawa (JP); Katsumi Nukada, Kanagawa (JP); Wataru Yamada, Kanagawa (JP); Hidekazu Hirose, Kanagawa (JP); Yuko Iwadate, Kanagawa (JP); Kenji Kajiwara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/869,493

(22) Filed: Apr. 24, 2013

(65) Prior Publication Data

US 2014/0072907 A1 Mar. 13, 2014

(30) Foreign Application Priority Data

Sep. 12, 2012 (JP) ..... 2012-200985

(51) Int. Cl.
*G03G 5/147* (2006.01)
*G03G 5/047* (2006.01)

(Continued)

(52) U.S. Cl.
CPC ..... *G03G 5/047* (2013.01); *G03G 5/0507* (2013.01); *G03G 5/0589* (2013.01);
(Continued)

(58) Field of Classification Search
CPC G03G 5/14717; G03G 5/14704; G03G 5/047
USPC ..... 430/58.7, 66, 58.05; 399/159
See application file for complete search history.

(56) References Cited

U.S. PATENT DOCUMENTS 5,411,827 A 5/1995 Tamura et al.
5,427,880 A 6/1995 Tamura et al.

(Continued)

FOREIGN PATENT DOCUMENTS

JP A-62-251757 11/1987
JP A-4-281461 10/1992

(Continued)

OTHER PUBLICATIONS

English language machine translation of JP 2010-164646 (Jul. 2010).*

(Continued)

*Primary Examiner* — Christopher Rodee
(74) *Attorney, Agent, or Firm* — Oliff PLC

(57) ABSTRACT

Provided is an electrophotographic photoreceptor including a conductive substrate and a photosensitive layer provided on the conductive substrate, wherein an outermost surface layer includes a cured film of a composition containing inorganic particles having polymerizable groups and at least one selected from the reactive compounds represented by the following formulae (I) and (II):

(I)

wherein F represents a charge transporting skeleton; L represents a divalent linking group; and m represents an integer of 1 to 8, (II)

wherein F represents a charge transporting skeleton; L' represents an (n+1)-valent linking group; m' represents an integer of 1 to 6; and n represents an integer of 2 to 3.

8 Claims, 11 Drawing Sheets

(51) Int. Cl.

| | |
|---|---|
| ***G03G 21/18*** | (2006.01) |
| ***G03G 5/05*** | (2006.01) |
| ***G03G 5/06*** | (2006.01) |
| ***G03G 5/07*** | (2006.01) |

(52) U.S. Cl.

CPC ..... *G03G 5/0592* (2013.01); *G03G 5/0596* (2013.01); *G03G 5/0614* (2013.01); *G03G 5/071* (2013.01); *G03G 5/14704* (2013.01); *G03G 5/14717* (2013.01); *G03G 5/14786* (2013.01); *G03G 5/14791* (2013.01); *G03G 5/14795* (2013.01); *G03G 21/1814* (2013.01)

(56) References Cited

U.S. PATENT DOCUMENTS

| | | | | |
|---|---|---|---|---|
| 5,456,989 | A | 10/1995 | Nogami et al. | |
| 5,496,671 | A | 3/1996 | Tamura et al. | |
| 5,695,898 | A | 12/1997 | Go et al. | |
| 2002/0119382 | A1 | 8/2002 | Nakata et al. | |
| 2004/0043312 | A1 | 3/2004 | Kikuchi et al. | |
| 2007/0178400 | A1 | 8/2007 | Kikuchi et al. | |
| 2010/0129115 | A1* | 5/2010 | Ishida et al. | 399/159 |
| 2010/0150610 | A1* | 6/2010 | Maeda et al. | 399/159 |
| 2010/0216065 | A1* | 8/2010 | Kurachi et al. | 430/66 |
| 2011/0045391 | A1* | 2/2011 | Maeda et al. | 430/56 |
| 2013/0052571 | A1* | 2/2013 | Yamada et al. | 430/73 |

FOREIGN PATENT DOCUMENTS

| | | | |
|---|---|---|---|
| JP | A-5-40360 | | 2/1993 |
| JP | A-5-216249 | | 8/1993 |
| JP | A-5-323630 | | 12/1993 |
| JP | A-7-72640 | | 3/1995 |
| JP | A-7-146564 | | 6/1995 |
| JP | B2-2546739 | | 10/1996 |
| JP | A-11-52603 | | 2/1999 |
| JP | B2-2852464 | | 2/1999 |
| JP | A-11-249444 | | 9/1999 |
| JP | A-2000-19749 | | 1/2000 |
| JP | A-2000-206715 | | 7/2000 |
| JP | A-2000-264961 | | 9/2000 |
| JP | A-2001-166510 | | 6/2001 |
| JP | A-2001-175016 | | 6/2001 |
| JP | A-2002-82469 | | 3/2002 |
| JP | B2-3287678 | | 6/2002 |
| JP | A-2004-12986 | | 1/2004 |
| JP | A-2004-258345 | | 9/2004 |
| JP | A-2005-2291 | | 1/2005 |
| JP | A-2006-84711 | | 3/2006 |
| JP | A-2007-11005 | | 1/2007 |
| JP | 2010164646 | A * | 7/2010 |
| JP | A-2010-164646 | | 7/2010 |
| JP | 2010169725 | A * | 8/2010 |
| JP | A-2010-169725 | | 8/2010 |

OTHER PUBLICATIONS

English language machine translation of JP 2010-169725 (Aug. 2010).*

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-200985 filed on Sep. 12, 2012.

BACKGROUND

1. Technical Field

The present invention relates to an electrophotographic photoreceptor, a process cartridge, and an image forming apparatus.

2. Related Art

Generally, an electrophotographic image forming apparatus has the following configurations and processes. That is, the surface of an electrophotographic photoreceptor is charged by a charging apparatus to defined polarity and potential, and the charged surface of the electrophotographic photoreceptor is selectively removed of charge by image-wise exposure to form an electrostatic latent image. The latent image is then developed into a toner image by attaching a toner to the electrostatic latent image by a developing unit, the toner image is transferred onto an transfer medium by a transfer unit, and then the transfer medium is discharged as an image formed material.

It has been proposed, for example, to provide the surface of an electrophotographic photoreceptor with a protective layer to increase the strength.

Recently, protective layers formed of acrylic materials have been attracting attention.

These acrylic materials are strongly affected by curing conditions, curing atmosphere, and the like.

SUMMARY

According to an aspect of the invention, there is provided an electrophotographic photoreceptor including a conductive substrate and a photosensitive layer provided on the conductive substrate, wherein an outermost surface layer includes a cured film of a composition containing inorganic particles having polymerizable groups and at least one selected from the reactive compounds represented by the following formulae (I) and (II):

(I)

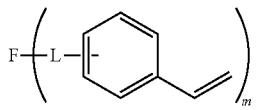

wherein F represents a charge transporting skeleton; L represents a divalent linking group including two or more selected from the group consisting of an alkylene group, an alkenylene group, —C(═O)—, —N(R)—, —S—, and —O—; R represents a hydrogen atom, an alkyl group, an aryl group, or an aralkyl group; and m represents an integer of 1 to 8, (II)

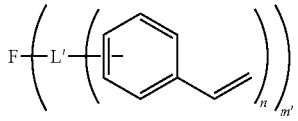

wherein F represents a charge transporting skeleton; L' represents an (n+1)-valent linking group including two or more selected from the group consisting of a trivalent or tetravalent group derived from an alkane or an alkene, and an alkylene group, an alkenylene group, —C(═O)—, —N(R')—, —S—, and —O—; R' represents a hydrogen atom, an alkyl group, an aryl group, or an aralkyl group; m' represents an integer of 1 to 6; and n represents an integer of 2 to 3.

BRIEF DESCRIPTION OF THE DRAWINGS

Exemplary embodiments of the present invention will be described in detail based on the following figures, wherein.

DETAILED DESCRIPTION

Figure 1:
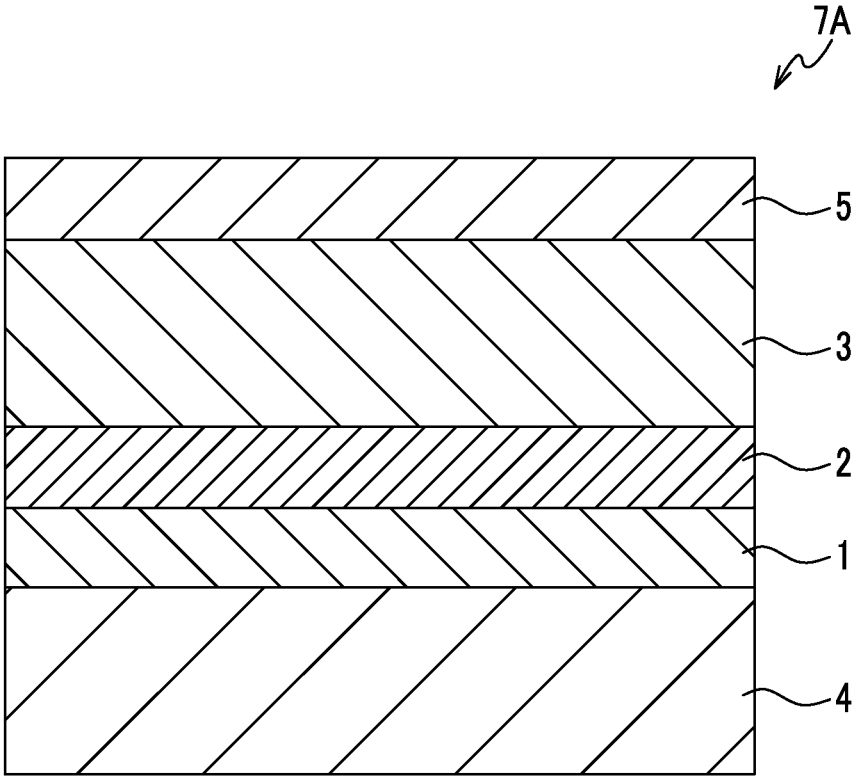
FIG. 1 is a schematic partial cross-sectional diagram showing an example of the layer configuration of the electrophotographic photoreceptor according to the present exemplary embodiment.

Hereinbelow, the present exemplary embodiment which is one example of the invention will be described.

Electrophotographic Photoreceptor

The electrophotographic photoreceptor according to the present exemplary embodiment has a conductive substrate and a photosensitive layer provided on the conductive substrate, wherein the outermost surface layer is constituted with a cured film of a composition containing at least one selected from the reactive compounds represented by the formulae (I) and (II) (hereinafter referred to as a "specific reactive group-containing charge transporting materials" in some cases) and inorganic particles having polymerizable groups (hereinafter referred to as "specific inorganic particles" in some cases).

Here, in the related art, it has been known that the outermost surface layer of an electrophotographic photoreceptor is constituted with a cured film using organic materials including a charge transporting material for the purpose of improving the mechanical strength.

It has also been known that inorganic particles are blended as a filler into an outermost surface layer constituted with a cured film for the purpose of further improving the mechanical strength.

On the other hand, inorganic particles has low affinity and dispersibility in a cured film using an organic material, and cracks may be generated and electrical characteristics of the electrophotographic photoreceptor may be decreased due to the effects of polar groups or the like present on the surface of the inorganic particles in some cases by simply adding the inorganic particles.

There is a method, in which a (meth)acryloyl group as a polymerizable group is introduced into both of organic materials including the charge transporting material and inorganic particles and allowed to undergo a polymerization or crosslinking reaction, thereby improving the affinity between the organic materials and the inorganic materials in order to promote the compatibility of the mechanical strength and the electrical characteristics of the outermost surface layer by blending the inorganic particles.

This method promotes the compatibility between the mechanical strength and the electrical characteristics, but in view of this situation, the generation of scratches on the outermost surface layer and the decrease in the electrical characteristics due to repeated use are not inhibited. The reason therefor is presumed as follows.

It may be thought that in the polymerization or crosslinking reaction by a (meth)acryloyl group, the affinity between the organic material and the inorganic material is improved by linking organic materials other than the charge transporting material and the inorganic particles, but a portion in which many charge transporting skeletons are present in the cured film, and a portion in which many linking groups which link the inorganic particles and the organic material-inorganic particles are present in the cured film are generated, and thus, microscopic distribution in the charge transporting function in the cured film is generated. This effect is hardly seen in the initial electrical characteristics, but it may be thought that when the image formation (image forming process) is repeated, charges slowly accumulate in a part having no charge transporting function, and thus, the electrical characteristics are decreased.

Further, from the viewpoint that microscopic distribution in the charge transporting function in the cured film is generated, it may be thought that the interfacial adhesiveness between the organic material and the inorganic particles is insufficient, and when the image formation (image forming process) is repeated, the polar groups remaining in the inorganic particles are slowly exposed and absorb moisture, and thus, the electrical characteristics are decreased. In addition, it is thought that the generation of scratches on the surface easily occurs by the breakage at the organic-inorganic interface.

Meanwhile, with the electrophotographic photoreceptor according to the present exemplary embodiment, the above configuration inhibits the generation of scratches on the outermost surface layer and the decrease in the electrical characteristics due to repeated use.

The reason thereof is not clear, but it is presumed as follows.

First, the specific reactive group-containing charge transporting material is a charge transporting material having a styryl group, not a (meth)acryloyl group, introduced thereinto as a polymerizable group. Further, the specific inorganic particles are inorganic particles having polymerizable groups as a polymerizable group introduced thereinto.

It is thought that if the outermost surface layer is constituted with a cured film of a composition including the specific reactive group-containing charge transporting material and the specific inorganic particles, that is, if the outermost surface layer is configured to include a polymer or crosslinked product of the specific reactive group-containing charge transporting material and the specific inorganic particles, the outermost surface layer is excellent in both of the electrical characteristics and the mechanical strength.

The reason thereof is thought to be that residual strain is inhibited and formation of a structural trap capturing charges is inhibited in that the specific reactive group-containing charge transporting material itself is excellent in the charge transporting performance and has a small number of polar groups disturbing the carrier transport, such as —OH and —NH—, and further, the material is linked with a styryl group having a $\pi$ electron effective for the carrier transport by polymerization.

On the other hand, it is thought that a phenyl group in the styryl group introduced into the specific reactive group-containing charge transporting material has a good affinity for inorganic particles and plays a role in assisting in the dispersion of the inorganic particles. In addition, it is thought that in that the phenyl group in the styryl group functions to assist the charge transfer, the generation of the distribution of the charge transporting function in the cured film is inhibited, and when the image formation (image forming process) is repeated, the decrease in the electrical characteristics is inhibited.

Moreover, it is thought that the interfacial adhesiveness between the specific reactive group-containing charge transporting materials (organic material) and the inorganic particles is improved in that the phenyl group in the styryl group has satisfactory affinity for the inorganic particles, and thus, when the image formation (image forming process) is repeated, the polar groups remaining in the inorganic particles are inhibited from being slowly exposed, and as a result, the decrease in the electrical characteristics due to the exposure of the polar groups is inhibited. Further, the breakage hardly occurs on the organic-inorganic interface, and the generation of scratches on the surface is also inhibited.

As described above, it is thought that with the electrophotographic photoreceptor according to the present exemplary embodiment, the generation of scratches on the outermost surface layer and the decrease in the electrical characteristics due to repeated use are inhibited.

In particular, in the outermost surface layer, if the polar groups remaining in the inorganic particles are slowly exposed, image defects (for example, the generation of ghost after continuous printing) due to the exposure of the polar groups are easily generated, but in the present exemplary embodiment, there is an advantage that deterioration of the image quality is inhibited.

In addition, with an image forming apparatus (process cartridge) equipped with the electrophotographic photoreceptor according to the present exemplary embodiment, the generation of scratches on the outermost surface layer and image defects (for example, afterimage phenomenon (ghost), in which history in the previous cycle remains) caused by the decrease in the electrical characteristics due to repeated use are inhibited.

Hereinafter, a configuration of the photoreceptor according to the exemplary embodiment will be described in detail with reference to Figs.

Figure 2:
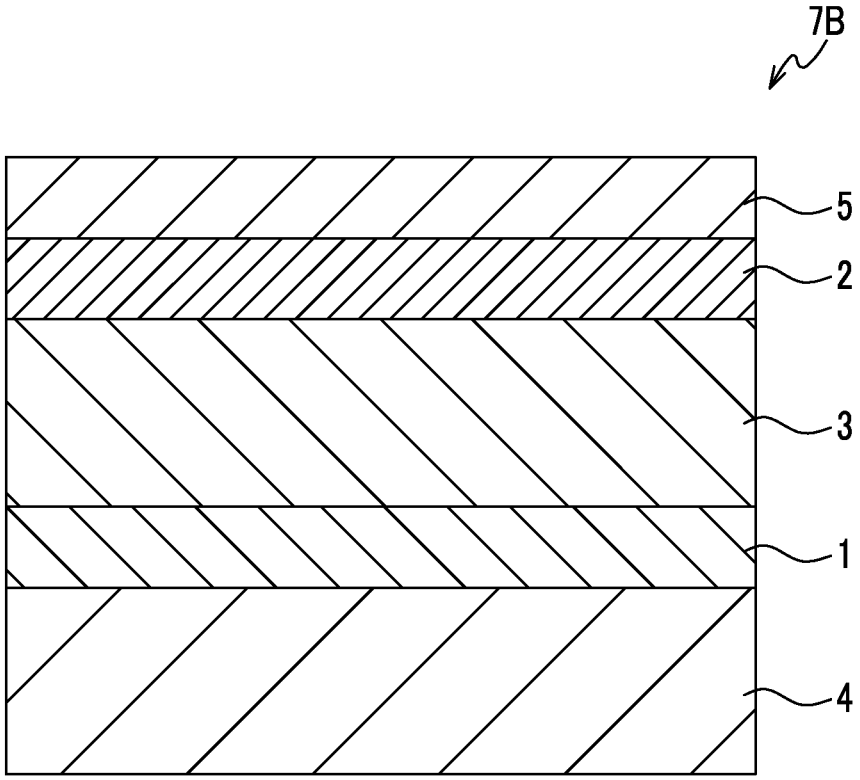
FIG. 2 is a schematic partial cross-sectional diagram showing another example of the layer configuration of the electrophotographic photoreceptor according to the present exemplary embodiment.
Figure 3:
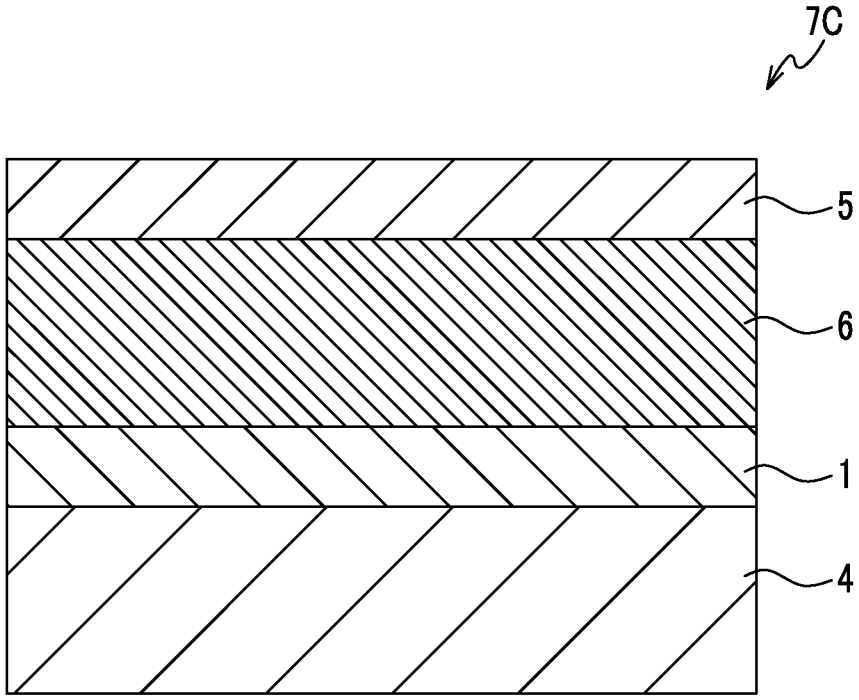
FIG. 3 is a schematic partial cross-sectional diagram showing still another example of the layer configuration of the electrophotographic photoreceptor according to the present exemplary embodiment.

FIG. 1 is a cross-sectional view schematically illustrating a preferred example of the electrophotographic photoreceptor according to the exemplary embodiment. FIGS. 2 and 3 are cross-sectional views schematically illustrating other examples of the electrophotographic photoreceptor according to the exemplary embodiment.

An electrophotographic photoreceptor 7A illustrated in FIG. 1 is a so-called functional separation type photoreceptor (or layered photoreceptor) in which an undercoat layer 1 is provided on a substrate 4; a photosensitive layer in which a charge generating layer 2 and a charge transporting layer 3 are formed in this order is provided thereon; and a protective layer 5 is provided thereon. In the electrophotographic photoreceptor 7A, the photosensitive layer composed of the charge generating layer 2 and the charge transporting layer 3 correspond to the photosensitive layer.

Similarly to the electrophotographic photoreceptor 7A illustrated in FIG. 1, an electrophotographic photoreceptor 7B illustrated in FIG. 2 is a functional separation type photoreceptor in which the charge generating layer 2 and the charge transporting layer 3 are functionally separated. In this configuration, the undercoat layer 1 is provided on the substrate 4; a photosensitive layer in which the charge transporting layer 3 and the charge generating layer 2 are formed in this order is provided thereon; and the protective layer 5 is provided thereon. In the electrophotographic photoreceptor 7B, the photosensitive layer composed of the charge transporting layer 3 and the charge generating layer 2 correspond to the photosensitive layer.

An electrophotographic photoreceptor 7C illustrated in FIG. 3 includes a charge generating material and a charge transporting material in the same layer (single-layered photosensitive layer 6). The electrophotographic photoreceptor 7C illustrated in FIG. 3 has a structure in which the undercoat layer 1 is provided on the substrate 4; and the single-layered photosensitive layer 6 and the protective layer 5 are formed in this order thereon.

In the electrophotographic photoreceptors 7A, 7B, and 7C shown in FIGS. 1, 2, and 3, the protective layer 5 is an outermost layer arranged farthest from the conductive substrate 4, and the outermost layer has the above-described structure.

In the electrophotographic photoreceptors shown in FIGS. 1, 2, and 3, the undercoat layer 1 may or may not be provided.

Hereinafter, the respective elements will be described on the basis of the electrophotographic photoreceptors 7A shown in the FIG. 1 as representative examples. The reference numbers will be omitted.

Conductive Substrate

The conductive substrate may be freely selected from existing ones, such as plastic films having thereon a thin film (for example, a metal such as aluminum, nickel, chromium, stainless steel, or a film of aluminum, titanium, nickel, chromium, stainless steel, gold, vanadium, tin oxide, indium oxide, or indium tin oxide (ITO)), paper coated or impregnated with a conductivity-imparting agent, and plastic films coated or impregnated with a conductivity-imparting agent. The substrate may be in the form of a cylinder, a sheet, or a plate. The conductive substrate particles preferably have a volume resistivity of, for example, less than $10^7$ Ω·cm.

When the conductive substrate is a metal pipe, the surface thereof may be untreated or treated by mirror finishing, etching, anodic oxidation, rough cutting, centerless grinding, sandblast, or wet honing.

Undercoat Layer

The undercoat layer is formed if necessary for the purpose of preventing light reflection on the conductive substrate surface, and inflow of unnecessary carriers from the conductive substrate into the photosensitive layer.

The undercoat layer is configured to contain, for example, a binder resin and other optional additives.

Examples of the binder resin contained in the undercoat layer include known polymer resin compounds such as acetal resins e.g. polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, unsaturated urethane resins, polyester resins, alkyd resins, and epoxy resins, charge transporting resins having a charge transporting group, and conductive resins such as polyaniline.

Among them, as the binder resin, resins which are insoluble in the coating solvent for the upper layer (charge generating layer) are preferable, and resins which are obtained by the reaction of a curing agent and at least one selected from the group consisting of thermosetting resins such as urea resins, phenol resins, phenol-formaldehyde resins, melamine resins, urethane resins, unsaturated polyester resins, alkyd resins, and epoxy resins, polyamide resins, polyester resins, polyether resins, acrylic resins, polyvinyl alcohol resins, and polyvinyl acetal resins are particularly preferable.

When using the binder resins in combination of two or more kinds thereof, the mixing ratio is set as necessary.

The undercoat layer may contain a metal compound such as a silicon compound, an organozirconium compound, an organotitanium compound, or an organoaluminum compound.

The ratio of the metal compound to the binder resin is not specified, and is selected so as to achieve intended electrophotographic photoreceptor properties.

The undercoat layer may contain resin particles for controlling the surface roughness. Examples of the resin particles include silicone resin particles and crosslinked poly(methyl methacrylate) (PMMA) resin particles. For the purpose of controlling the surface roughness, the surface of the undercoat layer provided on a conductive substrate may be polished by, for example, buff polishing, sandblasting, wet honing, or grinding.

The undercoat layer may contain, for example, at least a binder resin and conductive particles. The conductive particles preferably have, for example, a volume resistivity of less than $10^7$ Ω·cm.

Examples of the conductive particles include metallic particles (for example, aluminum, copper, nickel, and silver particles), conductive metallic oxide particles (for examples, antimony oxide, indium oxide, tin oxide, and zinc oxide particles), and conductive substance particles (carbon fiber, carbon black, and graphite powder particles). Among them, conductive metal oxide particles are preferred. The conductive particles may be used in combination of two or more thereof. The conductive particles may be subjected to surface treatment with a hydrophobizing agent (for example, a coupling agent), thereby controlling the resistance. The content of the conductive particles is, for example, preferably from 10% by weight to 80% by weight with respect to the binder resin, and more preferably from 40% by weight to 80% by weight.

The formation of the undercoat layer is not particularly limited, and a well-known formation method is used. For example, the undercoat layer is formed by forming a coating film of an undercoat layer-forming coating solution obtained by adding the above-described components to a solvent; and drying (optionally, heating) the coating solution.

Examples of the method for coating the undercoat layer forming coating liquid to the conductive substrate include dip coating, push-up coating, wire-bar coating, spray coating, blade coating, knife coating, and curtain coating.

Examples of the method for dispersing particles in the undercoat layer forming coating liquid include media dispersers such as a ball mill, a vibrating ball mill, an attritor, a sand mill, and a horizontal sand mill; and medialess dispersers such as a stirrer, an ultrasonic disperser, a roll mill, and a high pressure homogenizer. The high pressure homogenizer may be of a collision type which achieves dispersion by liquid-liquid collision or liquid-wall collision under high pressure, or of a penetrating type which achieves dispersion by penetrating through fine channels under high pressure.

The thickness of the undercoat layer is preferably 15 μm or more, and more preferably from 20 μm to 50 μm.

Here, although omitted in the drawings, an intermediate layer may be further provided between the undercoat layer and the photosensitive layer. Examples of the binder resins for use in the intermediate layer include polymeric resin compounds e.g., acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins; and organic metallic compounds containing zirconium, titanium, aluminum, manganese, and silicon atoms. These compounds may be used singly or as a mixture or polycondensate of the plural compounds. Among them, an organic metallic compound containing zirconium or silicon is preferable because it has a low residual potential, and thus a change in potential due to the environment is small, and a change in potential due to the repeated use is small.

The formation of the intermediate layer is not particularly limited, and a well-known formation method is used. For example, the intermediate layer is formed by forming a coating film of an intermediate layer-forming coating solution obtained by adding the above-described components to a solvent; and drying (optionally, heating) the coating solution.

As a coating method for forming the intermediate layer, a general method is used such as a dipping coating method, an extrusion coating method, a wire bar coating method, a spray coating method, a blade coating method, a knife coating method, or a curtain coating method.

The intermediate layer improves the coating property of the upper layer and also functions as an electric blocking layer. However, when the thickness is excessively large, an electric barrier becomes excessively strong, which may cause desensitization or an increase in potential due to the repeated use. Accordingly, when an intermediate layer is formed, the thickness may be set to from 0.1 μm to 3 μm. In this case, the intermediate layer may be used as the undercoat layer.

Charge Generating Layer

The charge generating layer includes, for example, a charge generating material and a binder resin. Also the charge generating layer may include a vapor deposition film of a charge generating material.

Examples of the charge generating material include phthalocyanine pigments such as metal-free phthalocyanine, chlorogallium phthalocyanine, hydroxygallium phthalocyanine, dichlorotin phthalocyanine, and titanyl phthalocyanine. Particularly, there are exemplified a chlorogallium phthalocyanine crystal having strong diffraction peaks at least at Bragg angles (2θ±0.2°) of 7.4°, 16.6°, 25.5°, and 28.3° with respect to CuKα characteristic X-ray, a metal-free phthalocyanine crystal having strong diffraction peaks at least at Bragg angles (2θ±0.2°) of 7.7°, 9.3°, 16.9°, 17.5°, 22.4°, and 28.8° with respect to CuKα characteristic X-ray, a hydroxygallium phthalocyanine crystal having strong diffraction peaks at least at Bragg angles (2θ±0.2°) of 7.5°, 9.9°, 12.5°, 16.3°, 18.6°, 25.1°, and 28.3° with respect to CuKα characteristic X-ray, and a titanyl phthalocyanine crystal having strong diffraction peaks at least at Bragg angles (2θ±0.2°) of 9.6°, 24.1°, and 27.2° with respect to CuKα characteristic X-ray. Other examples of the charge generating material include quinone pigments, perylene pigments, indigo pigments, bisbenzimidazole pigments, anthrone pigments, and quinacridone pigments. These charge generating materials may be used singly or in mixture of two or more types.

Examples of the binder resin constituting the charge generating layer include a polycarbonate resins such as a bisphenol-A type and a bisphenol-Z type, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and poly-N-vinylcarbazole resins. These binder resins may be used singly or in mixture of two or more types.

The blending ratio of the charge generating material to the binder resin is, for example, preferably from 10:1 to 1:10.

The charge generating layer may contain other known additives.

The formation of the generating layer is not particularly limited, and a well-known formation method is used. For example, the charge generating layer is formed by forming a coating film of a generating layer-forming coating solution obtained by adding the above-described components to a solvent; and drying (optionally, heating) the coating solution. Also the charge generating layer may be formed by deposition of the charge generating materials.

Examples of the method of coating the undercoat layer with the coating liquid for charge generating layer formation include a dipping coating method, an extrusion coating method, a wire bar coating method, a spray coating method, a blade coating method, a knife coating method, and a curtain coating method.

As a method of dispersing the particles (for example, charge generating material) in the coating liquid for charge generating layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. Examples of the high-pressure homogenizer include a collision-type homogenizer in which a dispersion is dispersed under high pressure by liquid-liquid collision or liquid-wall collision, and a penetration-type homogenizer in which a dispersion is dispersed by allowing it to penetrate through a minute channel under high pressure.

The thickness of the charge generating layer is preferably set to from 0.01 μm to 5 μm, and more preferably from 0.05 μm to 2.0 μm.

Charge Transporting Layer

The charge transporting layer includes a charge transporting material, and if necessary, a binder resin.

Examples of the charge transporting material include hole transporting substances e.g., oxadiazole derivatives such as 2,5-bis(p-diethylaminophenyl)-1,3,4-oxadiazole, pyrazoline derivatives such as 1,3,5-triphenyl-pyrazoline and 1-[pyridyl-(2)]-3-(p-diethylaminostyryl)-5-(p-diethylaminostyryl)pyrazoline, aromatic tertiary amino compounds such as triphenylamine, N,N'-bis(3,4-dimethylphenyl)biphenyl-4-amine, tri(p-methylphenyl)aminyl-4-amine, and dibenzylaniline, aromatic tertiary diamino compounds such as N,N'-bis(3-methylphenyl)-N,N'-diphenylbenzidine, 1,2,4-triazine derivatives such as 3-(4'-dimethylaminophenyl)-5,6-di-(4'-methoxyphenyl)-1,2,4-triazine, hydrazone derivatives such as 4-diethylaminobenzaldehyde-1,1-diphenylhydrazone, quinazoline derivatives such as 2-phenyl-4-styryl-quinazoline, benzofuran derivatives such as 6-hydroxy-2,3-di(p-methoxyphenyl)benzofuran, α-stilbene derivatives such as p-(2,2-diphenylvinyl)-N,N-diphenylaniline, enamine derivatives, carbazole derivatives such as N-ethylcarbazole, and poly-N-vinylcarbazole and derivatives thereof; electron transporting substances e.g., quinone compounds such as chloranil and bromoanthraquinone, tetracyanoquinodimethane compounds, fluorenone compounds such as 2,4,7-trinitrofluorenone and 2,4,5,7-tetranitro-9-fluorenone, xanthone compounds, and thiophene compounds; and polymers having a group composed of the above-described compounds as a main chain or side chain thereof. These charge transporting materials may be used singly or in combination of two or more types.

Examples of the binder resin in the charge transporting layer include insulating resins such as polycarbonate resins (polycarbonate resins such as bisphenol-A polycarbonate resins and bisphenol-Z polycarbonate resins), acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and chloride rubber, and organic photoconductive polymers such as polyvinyl carbazole, polyvinyl anthracene, and polyvinyl pyrene. The binder resins may be used singly, or as a mixture of two or more kinds thereof.

Among them, polycarbonate is preferable, and polycarbonate copolymers in which a solubility parameter calculated by the Feders method is from 11.40 to 11.75 are particularly preferable.

The blending ratio of the charge transporting material to the binder resin is, for example, preferably 10:1 to 1:5 in terms of the weight ratio.

The charge transporting layer may contain other known additives.

The formation of the charge transporting layer is not particularly limited, and a well-known formation method is used. For example, the charge transporting layer is formed by forming a coating film of a transporting layer-forming coating solution obtained by adding the above-described components to a solvent; and drying (optionally, heating) the coating solution.

As a method of coating the charge transporting layer with the coating liquid for charge transporting layer formation, a general method is used such as a dipping coating method, an extrusion coating method, a wire bar coating method, a spray coating method, a blade coating method, a knife coating method, or a curtain coating method.

As a method of dispersing the particles (for example, fluorine resin particles) in the coating liquid for charge transporting layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. Examples of the high-pressure homogenizer include a collision-type homogenizer in which a dispersion is dispersed under high pressure by liquid-liquid collision or liquid-wall collision, and a penetration-type homogenizer in which a dispersion is dispersed by allowing it to penetrate through a minute channel under high pressure.

The thickness of the charge transporting layer is preferably set to from 5 μm to 50 μm, and more preferably from 10 μm to 40 μm.

Protective Layer

The protective layer is the outermost surface layer in the electrophotographic photoreceptor and constituted with a cured film of a composition including a specific reactive group-containing charge transporting material and inorganic particles having polymerizable groups.

That is, the protective layer is configured to include a polymer or crosslinked product of a specific reactive group-containing charge transporting material and inorganic particles having polymerizable groups.

Moreover, for the curing method for the cured film, radical polymerization is performed with heat, light, radioactive rays, or the like. If the reaction is controlled not to proceed too quickly, the mechanical strength and the electrical characteristics of the protective layer (outermost surface layer) are improved, and also, unevenness of the film and the generation of folds are inhibited. As a result, it is preferable to perform the polymerization under the condition where the generation of radicals occurs relatively slowly. In this regard, thermal polymerization that allows the polymerization speed to be easily adjusted is suitable. That is, the composition for forming a cured film constituting the protective layer (outermost surface layer) may preferably include a thermal radical generator or a derivative thereof.

Specific Reactive Group-Containing Charge Transporting Material

The specific reactive group-containing charge transporting material is at least one selected from the reactive compounds represented by the formulae (I) and (II).

(I)

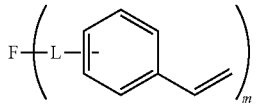

In the formula (I), F represents a charge transporting skeleton.

L represents a divalent linking group including two or more selected from the group consisting of an alkylene group, an alkenylene group, —C(=O)—, —N(R)—, —S—, and —O—. R represents a hydrogen atom, an alkyl group, an aryl group, or an aralkyl group.

m represents an integer of 1 to 8.

(II)

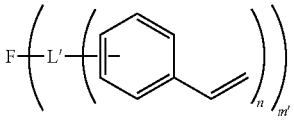

In the formula (II), F represents a charge transporting skeleton.

L' represents an (n+1)-valent linking group including two or more selected from the group consisting of a trivalent or tetravalent group derived from an alkane or an alkene, and an alkylene group, an alkenylene group, —C(=O)—, —N(R')—, —S—, and —O—. R' represents a hydrogen atom, an alkyl group, an aryl group, or an aralkyl group. Further, the trivalent or tetravalent group derived from an alkane or an alkene means a group formed by the removal of 3 or 4 hydrogen atoms from an alkane or an alkene. The same shall apply hereinafter.

m' represents an integer of 1 to 6. n represents an integer of 2 to 3.

In the formulae (I) and (II), F represents a charge transporting skeleton, that is, a structure having a charge transporting property, specifically, a structure having a charge transporting property, such as a phthalocyanine compound, a phorphyrin compound, an azobenzene compound, a triarylamine compound, a benzidine compound, an arylalkane compound, an aryl-substituted ethylene compound, a stilbene compound, an anthracene compound, a hydrazone compound, a quinone compound, and a fluorenone compound.

In the formula (I), examples of the linking group represented by L include:

a divalent linking group having —C(=O)—O— inserted in an alkylene group, a divalent linking group having —C(=O)—N(R)— inserted in an alkylene group, a divalent linking group having —C(=O)—S— inserted in an alkylene group, a divalent linking group having —O— inserted in an alkylene group, a divalent linking group having —N(R)— inserted in an alkylene group, and a divalent linking group having —S— inserted in an alkylene group.

In addition, the linking group represented by L may have two groups of —C(=O)—O—, —C(=O)—N(R)—, —C(=O)—S—, —O—, or —S— inserted in an alkylene group.

In the formula (I), specific examples of the linking group represented by L include:

*—$(CH_2)_p$—C(=O)—O—$(CH_2)_q$—,

*—$(CH_2)_p$—O—C(=O)—$(CH_2)_r$—C(=O)—O—$(CH_2)_q$—,

*—$(CH_2)_p$—C(=O)—N(R)—$(CH_2)_q$—,

*—$(CH_2)_p$—C(=O)—S—$(CH_2)_q$—,

*—$(CH_2)_p$—O—$(CH_2)_q$—,

*—$(CH_2)_p$—N(R)—$(CH_2)_q$—,

*—$(CH_2)_p$—S—$(CH_2)_q$—, and

*—$(CH_2)_p$—O—$(CH_2)_r$—O—$(CH_2)_q$—.

Here, in the linking group represented by L, p represents 0, or an integer of 1 to 6 (preferably 1 to 5). q represents an integer of 1 to 6 (preferably 1 to 5). r represents an integer of 1 to 6 (preferably 1 to 5).

Further, in the linking group represented by L, "*" represents a site linked to F.

On the other hand, in the formula (II), examples of the linking group represented by L' include:

an (n+1)-valent linking group having —C(=O)—O— inserted in an alkylene group linked in a branched form, an (n+1)-valent linking group having —C(=O)—N(R)— inserted in an alkylene group linked in a branched form, an (n+1)-valent linking group having —C(=O)—S— inserted in an alkylene group linked in a branched form, an (n+1)-valent linking group having —O— inserted in an alkylene group linked in a branched form, an (n+1)-valent linking group having —N(R)— inserted in an alkylene group linked in a branched form, and an (n+1)-valent linking group having —S— inserted in an alkylene group linked in a branched form.

Further, the linkage represented by L' may have two groups of —C(=O)—O—, —C(=O)—N(R)—, —C(=O)—S—, —O—, or —S— inserted in an alkylene group linked in a branched form.

In the formula (II), specific examples of the linking group represented by L' include:

*—$(CH_2)_p$—CH[C(=O)—O—$(CH_2)_q$—]$_2$,

*—$(CH_2)_p$—CH=C[C(=O)—O—$(CH_2)_q$—]$_2$,

*—$(CH_2)_p$—CH[C(=O)—N(R)—$(CH_2)_q$—]$_2$,

*—$(CH_2)_p$—CH[C(=O)—S—$(CH_2)_q$—]$_2$,

*—$(CH_2)_p$—CH[$(CH_2)_r$—O—$(CH_2)_q$—]$_2$,

*—$(CH_2)_p$—CH=C[$(CH_2)_r$—O—$(CH_2)_q$—]$_2$,

*—$(CH_2)_p$—CH[$(CH_2)_r$—N(R)—$(CH_2)_q$—]$_2$,

*—$(CH_2)_p$—CH[$(CH_2)_r$—S—$(CH_2)_q$—]$_2$,

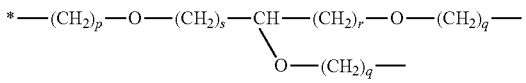

*—$(CH_2)_p$—O—C[$(CH_2)_r$—O—$(CH_2)_q$—]$_3$, and

*—$(CH_2)_p$—C(=O)—O—C[$(CH_2)_r$—O—$(CH_2)_q$—]$_3$.

Here, in the linking group represented by L', p represents 0, or an integer of 1 to 6 (preferably 1 to 5). q represents an integer of 1 to 6 (preferably 1 to 5). r represents an integer of 1 to 6 (preferably 1 to 5). s represents an integer of 1 to 6 (preferably 1 to 5).

Further, in the linking group represented by L', "*" represents a site linked to F.

Among these, in the formula (II), the linking group represented by L' is preferably

*—$(CH_2)_p$—CH[C(=O)—O—$(CH_2)_q$—]$_2$,

*—$(CH_2)_p$—CH=C [C(=O)—O—$(CH_2)_q$—]$_2$,

*—$(CH_2)_p$—CH[$(CH_2)_r$—O—$(CH_2)_q$—]$_2$, or

*—$(CH_2)_p$—CH=C[$(CH_2)_r$—O—$(CH_2)_q$—]$_2$.

Specifically, the group (corresponding to a group represented by the formula (IIA-a)) linked to the charge transporting skeleton represented by F of the compound represented by the formula (II) may preferably be a group represented by the following formula (IIA-a1), the following formula (IIA-a2), the following formula (IIA-a3), or the following formula (IIA-a4).

(IIA-a1)

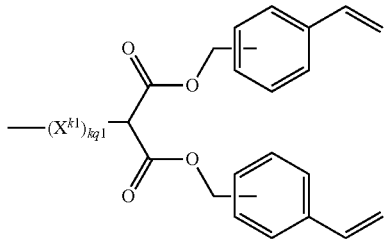

(IIA-a2)

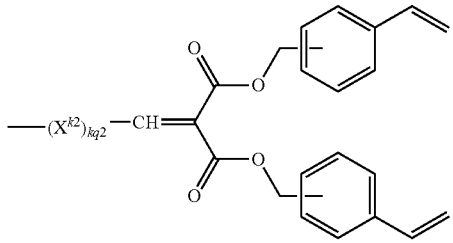

In the formula (IIA-a1) or (IIA-a2), $X^{k1}$ represents a divalent linking group. kq1 represents an integer of 0 or 1. $X^{k2}$ represents a divalent linking group. kq2 represents an integer of 0 or 1.

Here, examples of the divalent linking group represented by $X^{k1}$ and $X^{k2}$ include —$(CH_2)_p$— (provided that p represents an integer of 1 to 6 (preferably 1 to 5)). Examples of the divalent linking group include an alkyleneoxy group.

(IIA-a3)

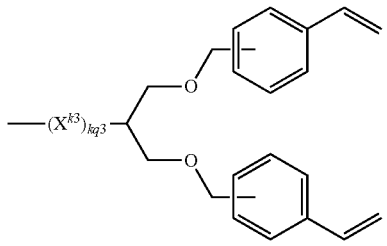

(IIA-a4)

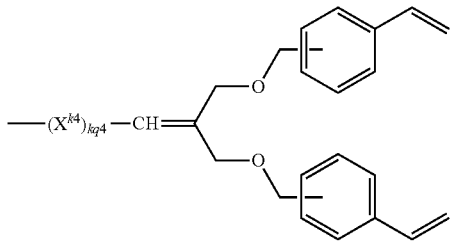

In the formula (IIA-a3) or (IIA-a4), $X^{k3}$ represents a divalent linking group. kq3 represents an integer of 0 or 1. $X^{k4}$ represents a divalent linking group. kq4 represents an integer of 0 or 1. Here, examples of the divalent linking group represented by $X^{k3}$ and $X^{k4}$ include —$(CH_2)_p$— (provided that p represents an integer of 1 to 6 (preferably 1 to 5)). Examples of the divalent linking group include an alkyleneoxy group.

In the formulae (I) and (II), in the linking groups represented by L and L', examples of the alkyl group represented by R of "—N(R)—" include linear or branched alkyl groups having 1 to 5 carbon atoms (preferably 1 to 4 carbon atoms), and specifically, a methyl group, an ethyl group, a propyl group, and a butyl group.

Examples of the aryl group represented by R of "—N(R)—" include aryl groups having 6 to 15 carbon atoms (preferably 6 to 12 carbon atoms), and specifically, a phenyl group, a tolyl group, a xylidyl group, and a naphthyl group.

Examples of the aralkyl group include aralkyl groups having 7 to 15 carbon atoms (preferably 7 to 14 carbon atoms), and specifically, a benzyl group, a phenethyl group, and a biphenylmethylene group.

In the formulae (I) and (II), m preferably represents an integer of 1 to 6.

m' preferably represents an integer of 1 to 6.

n preferably represents an integer of 2 to 3.

Next, suitable compounds of the reactive compounds represented by the formulae (I) and (II) will be described.

The reactive compounds represented by the formulae (I) and (II) are preferably reactive compounds having a charge transporting skeleton (structure having a charge transporting property) derived from a triarylamine compound as F.

Specifically, as the reactive compound represented by the formula (I), at least one compound selected from the reactive compounds represented by the formula (I-a), the formula (I-b), the formula (I-c), and the formula (I-d) are suitable. Among these, at least one compound selected from the reactive compounds represented by the formula (I-b), the formula (I-c), and the formula (I-d) are suitable.

On the other hand, as the reactive compound represented by the formula (II), the reactive compound represented by the formula (II-a) is suitable.

Reactive Compound Represented by Formula (I-a)

The reactive compound represented by the formula (I-a) will be described.

If the reactive compound represented by the formula (I-a) is applied as the specific reactive group-containing charge transporting material, deterioration of the electrical characteristics due to the environmental change is easily inhibited. The reason therefor is not clear, but is thought to be as follows.

First, it may be thought that for the reactive compound having a (meth)acryl group used in the related art, the (meth) acryl group is highly hydrophilic with respect to the skeleton site exhibiting the charge transporting performance during the polymerization. As a result, a certain kind of layer separation state is formed, and thus, the hopping conduction is disturbed. Therefore, it is thought that the charge transporting film including a polymer or crosslinked product of a (meth) acryl group-containing reactive compound exhibits deterioration of the efficiency in the charge transport, and further, the partial moisture adsorption or the like causes a decrease in the environmental stability.

Meanwhile, the reactive compound represented by the formula (I-a) has a vinyl polymerizable group having low hydrophilicity, and further, has several skeletons exhibiting the charge transporting performance in one molecule, and the skeletons are linked to each other with a flexible linking group having no conjugate bond such as an aromatic ring and a conjugate double bond. It is thought that such a structure promotes efficient charge transporting performance and high strength, and inhibits the formation of the layer separation state during the polymerization. As a result, it is thought that the protective layer (outermost surface layer) including the polymer or crosslinked product of the reactive compound represented by the formula (I-a) is excellent in both of the charge transporting performance and the mechanical strength, and further, the environment dependency (temperature and humidity dependency) of the charge transporting performance may be decreased.

As described above, it is thought that if the reactive compound represented by the formula (I-a) is applied, deterioration of the electrical characteristics due to the environmental change is easily inhibited.

(I-a)

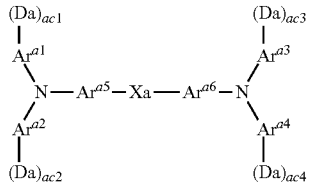

In the formula (I-a), $Ar^{a1}$ to $Ar^{a4}$ each independently represent a substituted or unsubstituted aryl group. $Ar^{a5}$ and $Ar^{a6}$ each independently represent a substituted or unsubstituted arylene group. Xa represents a divalent linking group formed by a combination of the groups selected from an alkylene group, —O—, —S—, and an ester. Da represents a group represented by the following formula (IA-a). ac1 to ac4 each independently represent an integer of 0 to 2. However, the total number of Da is 1 or 2.

(IA-a)

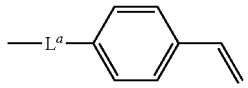

In the formula (IA-a), $L^a$ is represented by *—$(CH_2)_{an}$—O—$CH_2$— and represents a divalent linking group linked to a group represented by $Ar^{a1}$ to $Ar^{a4}$ at *. an represents an integer of 1 or 2.

Hereinafter, the details of the formula (I-a) will be described.

In the formula (I-a), the substituted or unsubstituted aryl groups represented by $Ar^{a1}$ to $Ar^{a4}$ may be the same as or different from each other.

Here, examples of the substituents in the substituted aryl group, those other than "Da", include an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom.

In the formula (I-a), $Ar^{a1}$ to $Ar^{a4}$ are preferably any one of the following structural formulae (1) to (7).

Furthermore, the following structural formulae (1) to (7) are represented together with "-$(D)_C$", which totally refers to "-$(Da)_{ac}1$" to "-$(Da)_{ac}1$" that may be linked to each of $Ar^{a1}$ to $Ar^{a4}$.

(1)

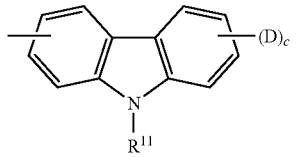

-continued (2)

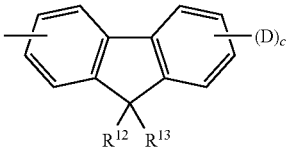

(3)

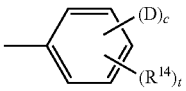

(4)

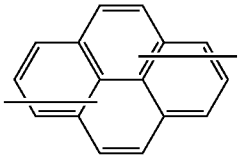

(5)

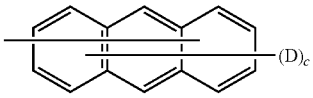

(6)

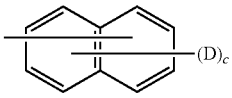

(7)

In the structural formulae (1) to (7), $R^{11}$ represents one selected from the group consisting of a hydrogen atom, an alkyl group having 1 to 4 carbon atoms, a phenyl group substituted with an alkyl group having 1 to 4 carbon atoms, or an alkoxy group having 1 to 4 carbon atoms, an unsubstituted phenyl group, and an aralkyl group having 7 to 10 carbon atoms. $R^{12}$ and $R^{13}$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. $R^{14}$'s each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. Ar represents a substituted or unsubstituted arylene group. represents 0 or 1. t represents an integer of 0 to 3. Z' represents a divalent organic linking group.

Here, in the formula (7), Ar is preferably one represented by the following structural formula (8) or (9).

(8)

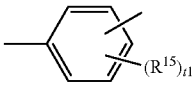

(9)

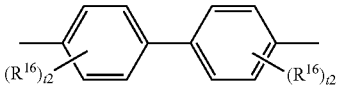

In the structural formulae (8) and (9), $R^{15}$ and $R^{16}$ each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom, and t1 and t2 each represent an integer of 0 to 3.

Furthermore, in the formula (7), Z' is preferably one represented by any one of the following structural formulae (10) to (17).

(10) $-(CH_2)_{q1}-$

(11) $-(CH_2CH_2O)_{r1}-$ (12)

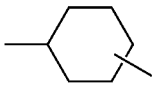

(13)

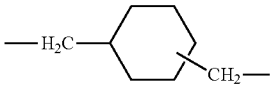

(14)

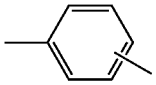

(15)

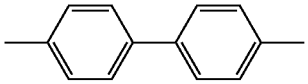

(16)

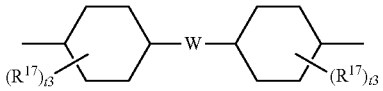

(17)

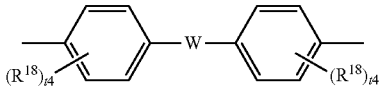

In the structural formulae (10) to (17), $R^{17}$ and $R^{18}$ each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. W represents a divalent group. q1 and r1 each independently represent an integer of 1 to 10. t3 and t4 each represent an integer of 0 to 3.

In the structural formulae (16) to (17), W is preferably any one of the divalent groups represented by the following structural formulae (18) to (26). However, in the formula (25), u represents an integer of 0 to 3.

(18) $-CH_2-$

(19) $-C(CH_3)_2-$

(20) $-O-$

(21) $-S-$

(22) $-C(CF_3)_2-$

(23) $-Si(CH_3)_2-$

-continued (24)

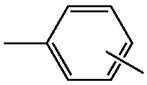

(25)

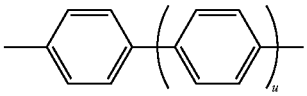

(26)

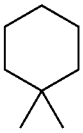

In the formula (I-a), in the substituted or unsubstituted arylene group represented by $Ar^{a5}$ and $Ar^{a6}$, examples of the arylene group include arylene groups formed by the removal of one hydrogen atom at a desired position from the aryl group exemplified in the description of $Ar^{a1}$ to $Ar^{a4}$.

Furthermore, examples of the substituent in the substituted arylene group are the same as those exemplified as the substituent other than "Da" in the substituted aryl group in the description of $Ar^{a1}$ to $Ar^{a4}$.

In the formula (I-a), the divalent linking group represented by Xa is an alkylene group, or a divalent group formed by a combination of the groups selected from alkylene group, —O—, —S—, and an ester, and is a linking group including no conjugate bond such as an aromatic ring and a conjugate double bond.

Specifically, examples of the divalent linking group represented by Xa include an alkylene group having 1 to 10 carbon atoms, as well as a divalent group formed by a combination of an alkylene group having 1 to 10 carbon atoms with a group selected from —O—, —S—, —O—C(═O)—, and —C(═O)—O—.

In addition, in the case where the divalent linking group represented by Xa is an alkylene group, the alkylene group may have a substituent such as alkyl, alkoxy, and halogen, and two of these substituents may be bonded to have the structure such as the divalent linking group represented by the structural formula (26) described as the specific examples of W in the structural formulae (16) to (17).

Reactive Compound Represented by Formula (I-b)

The reactive compound represented by the formula (I-b) will be described.

If the reactive compound represented by the formula (I-b) is applied as the specific reactive group-containing charge transporting material, the abrasion of the protective layer (outermost surface layer) is inhibited, and further, the generation of the uneven density of the image is easily inhibited. The reason is not clear, but is thought to be as follows.

First, when the bulky charge transporting skeleton and the polymerization site (styryl group) are structurally close to each other, and rigid, it is difficult for polymerization sites to move, residual strain due to a curing reaction easily remains, and the charge transporting skeleton is deformed, and therefore, there occurs a change in the level of HOMO (highest occupied molecular orbital) in charge of carrier transport and as a result, a state where the energy distribution spreads (disorder in energy: large σ) is easily caused.

Meanwhile, through a methylene group or an ether group, it is easy to provide the molecule structure with flexibility and a small σ is easily obtained. Further, the methylene group or the ether group has a small dipole moment, as compared with an ester group, an amide group, or the like, and this effect contributes to a decrease in σ, thereby improving the electrical characteristics. Further, by providing the molecular structure with flexibility, the degree of freedom of the movement of the reaction site is increased and the reaction rate is improved, which results in a film having a high strength.

From these, a structure where a linking having sufficient flexibility is inserted between the charge transporting skeleton and the polymerization site is preferable.

Consequently, it is thought that the reactive compound represented by the formula (I-b) has an increased molecular weight of the molecule itself by the curing reaction, it becomes difficult for the weight center to move, and the degree of freedom of the styryl group is high. As a result, it is thought that the protective layer (outermost surface layer) including a polymer or crosslinked product of the reactive compound represented by the formula (I-b) has excellent electrical characteristics and high strength.

From the above, it is thought that if the reactive compound represented by the formula (I-b) is applied, the abrasion of the protective layer (outermost surface layer) is inhibited, and further, the generation of the uneven density of the image is easily inhibited.

(I-b)

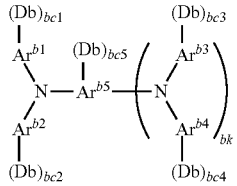

In the formula (I-b), $Ar^{b1}$ to $Ar^{b4}$ each independently represent a substituted or unsubstituted aryl group. $Ar^{b5}$ represents a substituted or unsubstituted aryl group, or a substituted or unsubstituted arylene group. Db represents a group represented by the following formula (IA-b). bc1 to bc5 each independently represent an integer of 0 to 2. bk represents 0 or 1. However, the total number of Db is 1 or 2.

(IA-b)

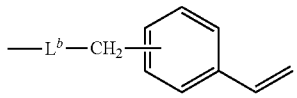

In the formula (IA-b), $L^b$ represents a divalent linking group which includes a group represented by *—$(CH_2)_{bn}$—O— and links to a group represented by $Ar^{b1}$ to $Ar^{b5}$ at *. bn represents an integer of 3 to 6.

Hereinafter, the details of the formula (I-b) will be described.

In the formula (I-b), the substituted or unsubstituted aryl groups represented by $Ar^{b1}$ to $Ar^{b4}$ are the same as the substituted or unsubstituted aryl groups represented by $Ar^{a1}$ to $Ar^{a4}$ in the formula (I-a).

When bk is 0, $Ar^{b5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When bk is 1, $Ar^{b5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

Next, the details of the formula (IA-b) will be described.

In the formula (IA-b), examples of the divalent linking group represented by $L^b$ include:

*—$(CH_2)_{bp}$—O—, and

*—$(CH_2)_{bp}$—O—$(CH_2)_{bq}$—O—.

Here, in the linking group represented by $L^b$, by represents an integer of 3 to 6 (preferably 3 to 5). bq represents an integer of 1 to 6 (preferably 1 to 5).

Further, in the linking group represented by $L^b$, "*" represents a site linked to a group represented by $Ar^{b1}$ to $Ar^{b5}$.

Reactive Compound Represented by Formula (I-c)

The reactive compound represented by the formula (I-c) will be described.

If the reactive compound represented by the formula (I-c) is applied as the specific reactive group-containing charge transporting material, it is difficult to generate scratches on the surface even when used repeatedly, and further, deterioration of the image quality is easily inhibited. The reason therefor is not clear, but is thought to be as follows.

First, it is thought that film shrinkage accompanying a polymerization reaction or a crosslinking reaction, or aggregation of the charge transporting structure, and the structure in the vicinity of a polymerizable group occur when an outermost surface layer including a polymer or crosslinked product of the reactive group-containing charge transporting material is formed. Therefore, it is thought that when a mechanic load is applied to an electrophotographic photoreceptor surface due to repeated use, the film itself is abraded or the chemical structure in the molecule is cut, and the film shrinkage or the aggregation state changes, the electrical characteristics as the electrophotographic photoreceptor changes, and thus, deterioration of the image quality occurs.

On the other hand, it is thought that since the reactive compound represented by the formula (I-c) has a styrene skeleton as the polymerizable group, a good compatibility with an aryl group which is a main skeleton of the charge transporting material is attained, and the film shrinkage or the aggregation of the charge transporting structure due to the polymerization reaction or the crosslinking reaction, and the aggregation of the structure in the vicinity of the polymerizable group are inhibited. As a result, it is thought that the electrophotographic photoreceptor including the protective layer (outermost surface layer) including a polymer or crosslinked product of the reactive compound represented by the formula (I-c) inhibits deterioration of the image quality due to the repeated use.

In addition, it is though that for the reactive compound represented by the formula (I-c), a charge transporting skeleton and a styrene skeleton are linked via a linking group including a specific group such as —C(═O)—, —N(R)—, and —S—, and thus, the interaction between the specific group and a nitrogen atom in the charge transporting skeleton, and between the specific groups, and the like occur, and as a result, it is also thought that the protective layer (outermost surface layer) including a polymer or crosslinked product of the reactive compound represented by the formula (I-c) has a further improved strength.

As described above, it is thought that if the reactive compound represented by the formula (I-c) is applied, it is difficult to generate scratches on the surface even when used repeatedly, and further, deterioration of the image quality is easily inhibited.

In addition, it is thought that a specific group such as —C(═O)—, —N(R)—, and —S— causes deterioration of a charge transport property and deterioration of the image quality under the conditions of high humidity due to its polarity or hydrophilicity, but the reactive compound represented by the formula (I-c) has a styrene skeleton having higher hydrophobicity than (meth)acryl, as a polymerizable group, and thus, deterioration of charge transporting property and deterioration of the image quality, such as afterimage phenomenon (ghost) caused by the history of the previous cycle, hardly occurs.

(I-c)

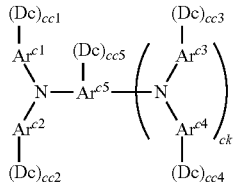

In the formula (I-c), $Ar^{c1}$ to $Ar^{c4}$ each independently represent a substituted or unsubstituted aryl group. $Ar^{c5}$ represents a substituted or unsubstituted aryl group, or a substituted or unsubstituted arylene group. Dc represents a group represented by the following formula (IA-c). cc1 to cc5 each independently represent an integer of 0 to 2. ck represents 0 or 1. However, the total number of Dc is from 1 to 8.

(IA-c)

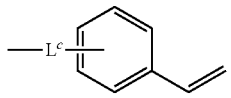

In the formula (IA-c), $L^c$ represents a divalent linking group including one or more groups selected from the group consisting of a group formed by a combination of —C(═O)—, —N(R)—, —S—, or —C(═O)—, and —O—, —N(R)—, or —S—. R represents a hydrogen atom, an alkyl group, an aryl group, or an aralkyl group.

Hereinafter, the details of the formula (I-c) will be described.

In the formula (I-c), the substituted or unsubstituted aryl groups represented by $Ar^{c1}$ to $Ar^{c4}$ are the same as the substituted or unsubstituted aryl groups represented by $Ar^{a1}$ to $Ar^{a4}$ in the formula (I-a).

When ck is 0, $Ar^{c5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When ck is 1, $Ar^{c5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

From the viewpoint of obtaining a protective layer (outermost surface layer) having a higher strength, the total number of Dc is preferably 2 or more, and more preferably 4 or more. Generally, if the number of the polymerizable groups in one molecule is too large, as the polymerization (crosslinking) reaction proceeds, it is difficult for the molecule to move, the polymerization reactivity is decreased, and the ratio of the unreacted polymerizable groups is increased, and thus, the total number of Dc is preferably 7 or less, and more preferably 6 or less.

Next, the details of the formula (IA-c) will be described.

In the formula (IA-c), $L^C$ represents a divalent linking group including one or more groups (hereinafter also referred to as "specific linking groups") selected from the group consisting of a group formed by a combination of —C(═O)—, —N(R)—, —S—, or —C(═O)—, and —O—, —N(R)—, or —S—.

Here, from the viewpoint of a balance of the strength and the polarity (hydrophilicity/hydrophobicity) of the protective layer (outermost surface layer), the specific linking group is, for example, —C(═O)—, —N(R)—, —S—, —C(═O)—O—, —C(═O)—N(R)—, —C(═O)—S—, —O—C(═O)—O—, or —O—C(═O)—N(R)—, preferably —N(R)—, —S—, —C(═O)—O—, —C(═O)—N(H)—, or —C(═O)—O—, and more preferably —C(═O)—O—.

Furthermore, examples of the divalent linking group represented by $L^c$ include divalent linking groups formed by a combination of the specific linking group with residues of a saturated hydrocarbon (including linear, branched, or cyclic ones) or aromatic hydrocarbons, and an oxygen atom, and among these, divalent linking groups formed by a combination of the specific linking group with a residue of a linear saturated hydrocarbon and an oxygen atom.

The total number of the carbon atoms included in the divalent linking group represented by $L^c$ is, for example, from 1 to 20, and preferably from 2 to 10, from the viewpoint of the density of a styrene skeleton in the molecule and the polymerization reactivity.

In the formula (IA-c), specific examples of the divalent linking group represented by $L^c$ include:

*—$(CH_2)_{cp}$—C(═O)—O—$(CH_2)_{cq}$—,

—$(CH_2)_{cp}$—O—C(═O)—$(CH_2)_{cr}$—C(═O)—O—$(CH_2)_{cq}$—,

*—$(CH_2)_{cp}$—C(═O)—N(R)—$(CH_2)_{cq}$—,

*—$(CH_2)_{cp}$—C(═O)—S—$(CH_2)_{cq}$—,

*—$(CH_2)_{cp}$—N(R)—$(CH_2)_{cq}$—, and

*—$(CH_2)_{cp}$—S—$(CH_2)_{cq}$—.

Here, in the linking group represented by $L^c$, cp represents 0, or an integer of 1 to 6 (preferably 1 to 5). cq represents an integer of 1 to 6 (preferably 1 to 5). cr represents an integer of 1 to 6 (preferably 1 to 5).

Furthermore, in the linking group represented by $L^c$, "*" represents a site linked to the group represented by $Ar^{c1}$ to $Ar^{c5}$.

Among these, in the formula (IA-c), the divalent linking group represented by $L^c$ is preferably *—$(CH_2)_{cp}$—C(═O)—O—$CH_2$—. That is, the group represented by the formula (IA-c) is preferably a group represented by the following formula (IA-c1). In the formula (IA-c1), cp1 represents an integer of 0 to 4.

(IA-c1)

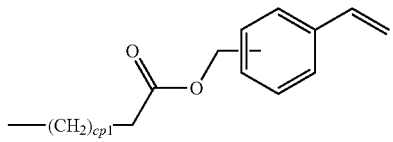

Reactive Compound Represented by Formula (I-d)

The reactive compound represented by the formula (I-d) will be described.

If the reactive compound represented by the formula (I-d) is applied as the specific reactive group-containing charge transporting material, the abrasion of the protective layer (outermost surface layer) is inhibited, and further, the generation of the uneven density of the image is easily inhibited. The reason is not clear, but is thought to be the same as for the reactive compound represented by the formula (I-b).

Particularly, it is thought that since the reactive compound represented by the formula (I-d) has a large total number of Dd of 3 to 8, as compared with the formula (I-b), the crosslinked product to be formed easily forms a more highly crosslinked structure (crosslinked network) and the abrasion of the protective layer (outermost surface layer) is more easily inhibited.

(I-d)

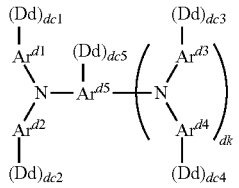

In the formula (I-d), $Ar^{d1}$ to $Ar^{d4}$ each independently represent a substituted or unsubstituted aryl group. $Ar^{d5}$ represents a substituted or unsubstituted aryl group, or a substituted or unsubstituted arylene group. Dd represents a group represented by the following formula (IA-d). dc1 to dc5 each independently represent an integer of 0 to 2. dk represents 0 or 1. However, the total number of Dd is from 3 to 8.

(IA-d)

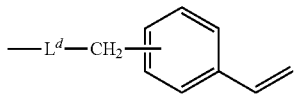

In the formula (IA-d), $L^d$ represents a divalent linking group which includes a group represented by *—$(CH_2)_{dn}$—O— and links to a group represented by $Ar^{d1}$ to $Ar^{d5}$ at *. dn represents an integer of 1 to 6.

Hereinafter, the details of the formula (I-d) will be described.

In the formula (I-d), the substituted or unsubstituted aryl groups represented by $Ar^{d1}$ to $Ar^{d4}$ are the same as the substituted or unsubstituted aryl groups represented by $Ar^{a1}$ to $Ar^{a4}$ in the formula (I-a).

When dk is 0, $Ar^{d5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When dk is 1, $Ar^{d5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

The total number of Dd is preferably 4 or more, from the viewpoint of obtaining a protective layer (outermost surface layer) having a higher strength.

Next, the details of the formula (IA-d) will be described.

In the formula (IA-d), examples of the divalent linking group represented by $L^d$ include:

*—$(CH_2)_{dp}$—O—, and

*—$(CH_2)_{dp}$—O—$(CH_2)_{dq}$—O—.

Here, in the linking group represented by $L^d$, dp represents an integer of 1 to 6 (preferably 1 to 5). dq represents an integer of 1 to 6 (preferably 1 to 5).

Furthermore, in the linking group represented by $L^d$, "*" represents a site linked to a group represented by $Ar^{d1}$ to $Ar^{d5}$.

Reactive Compound Represented by Formula (II-a)

The reactive compound represented by the formula (II-a) will be described.

When the reactive compound represented by the formula (II) (in particular, the formula (II-a)) is applied as the specific reactive group-containing charge transporting material, deterioration of the electrical characteristics is easily inhibited even when used repeatedly for a long period of time. The reason is not clear, but is thought to be as follows.

First, the reactive compound represented by the formula (II) (in particular, the formula (II-a)) is a compound having 2 or 3 polymerizable reactive groups (styrene groups) via one linking group from the charge transporting skeleton.

Consequently, it is thought that the reactive compound represented by the formula (II) (in particular, the formula (II-a)) hardly causes strain in the charge transporting skeleton during polymerization or crosslinking by the presence of the linking group while maintaining high curing degrees and number of crosslinked sites, and both of a high curing degree and excellent charge transporting performance are easily satisfied.

Furthermore, the charge transporting compound having a (meth)acryl group, which has been used in the related art, easily causes strain as described above, the reactive site has high hydrophilicity, and the charge transporting site has high hydrophobicity, and as a result, a microscopic phase separation (microphase separation) easily occurs. However, it is thought that the reactive compound represented by the formula (II) (in particular, the formula (II-a)) has a styrene group as a reactive group, and further, it has a structure having a linking group that hardly causes strain in the charge transporting skeleton when cured (crosslinked), the reactive site and the charge transporting site are both hydrophobic, and the phase separation hardly occurs, and as a result, efficient charge transporting performance and high strength are promoted. As a result, it is thought that the protective layer (outermost surface layer) including the polymer or crosslinked product of the reactive compound represented by the formula (II) (in particular, the formula (II-a)) has excellent mechanical strength as well as superior charge transporting performance (electrical characteristics).

As a result, if the reactive compound represented by the formula (II) (in particular, the formula (II-a)) is applied, it is thought that deterioration of the electrical characteristics even when used repeatedly for a long period of time is easily inhibited.

(II-a)

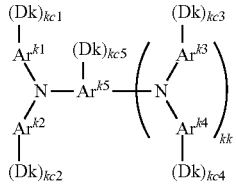

In the formula (II-a), $Ar^{k1}$ to $Ar^{k4}$ each independently represent a substituted or unsubstituted aryl group. $Ar^{k5}$ represents a substituted or unsubstituted aryl group, or a substituted or unsubstituted arylene group. Dk represents a group represented by the following formula (IIA-a). kc1 to kc5 each independently represent an integer of 0 to 2. kk represents 0 or 1. However, the total number of Dk is from 1 to 8.

(IIA-a)

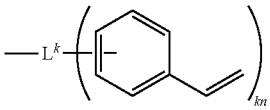

In the formula (IIA-a), $L^k$ represents a (kn+1)-valent linking group including two or more selected from the group consisting of a trivalent or tetravalent group derived from an alkane or an alkene, and an alkylene group, an alkenylene group, —C(=O)—, —N(R)—, —S—, and —O—. R represents a hydrogen atom, an alkyl group, an aryl group, or an aralkyl group. kn represents an integer of 2 to 3.

Hereinafter, the details of the formula (II-a) will be described.

In the formula (II-a), the substituted or unsubstituted aryl groups represented by $Ar^{k1}$ to $Ar^{k4}$ are the same as the substituted or unsubstituted aryl groups represented by $Ar^{a1}$ to $Ar^{a4}$ in the formula (I-a).

When kk is 0, $Ar^{k5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When kk is 1, $Ar^{k5}$ represents a substituted or unsubstituted arylene group, and the substituted or unsubstituted arylene group is the same as the substituted or unsubstituted arylene groups represented by $Ar^{as}$ and $Ar^{a6}$ in the formula (I-a).

From the viewpoint of obtaining a protective layer (outermost surface layer) having a higher strength, the total number of Dk is preferably 2 or more, and more preferably 4 or more. Generally, if the number of the polymerizable groups in one molecule is too large, as the polymerization (crosslinking) reaction proceeds, it is difficult for the molecule to move, the polymerization reactivity is decreased, and the ratio of the unreacted polymerizable groups is increased, and thus, the total number of Dk is preferably 7 or less, and more preferably 6 or less.

Next, the details of the formula (IIA-a) will be described.

In the formula (IIA-a), the (kn+1)-valent linking group represented by $L^k$ is the same as, for example, the (n+1)-valent linking group represented by L' in the formula (II-a).

Hereinafter, specific examples of the specific reactive group-containing charge transporting material will be shown.

Specifically, specific examples of the charge transporting skeleton F (for example, a site corresponding to the skeleton excluding Da in the formula (I-a) and Dk in the formula (II-a)) of the formulae (I) and (II), and specific examples of the functional group (for example, the site corresponding to Da in the formula (I-a) and Dk in the formula (II-a)) linked to the charge transporting skeleton F, as well as specific examples of the reactive compounds represented by the formulae (I) and (II) are shown below, but are not limited thereto.

Furthermore, the "*" moiety of the specific examples of the charge transporting skeleton F of the formulae (I) and (II) means that the "*" moiety of the functional group linked to the charge transporting skeleton F is linked.

That is, for example, the exemplary compound (I-b)-1 is shown as a specific example of the charge transporting skeleton F: (M1)-1 or a specific example of the functional group: (R2)-1, but the specific structures are shown as the following structures.

(I-b)-1

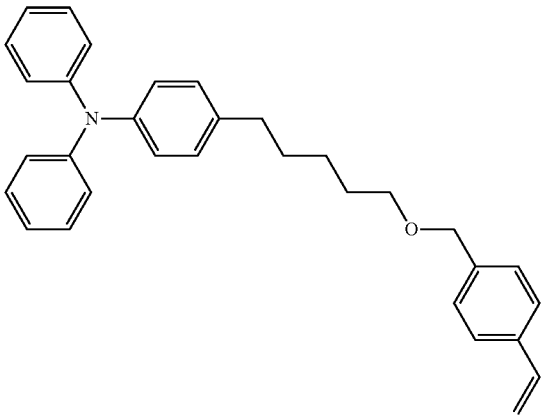

First, specific examples of the charge transporting skeleton F are shown below.

(M1)-1

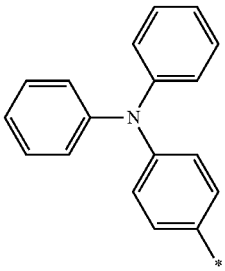

(M1)-2

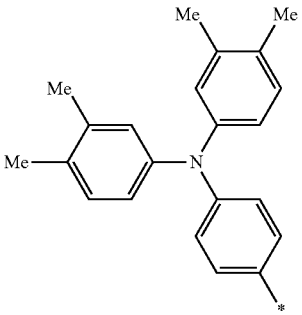

(M1)-3

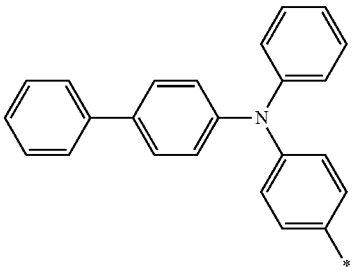

-continued
(M1)-4
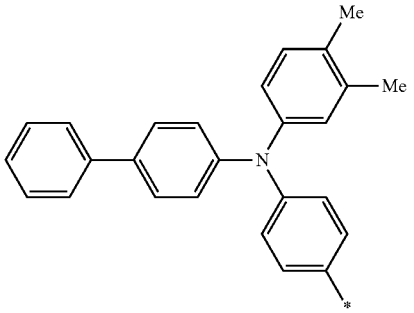
(M1)-5
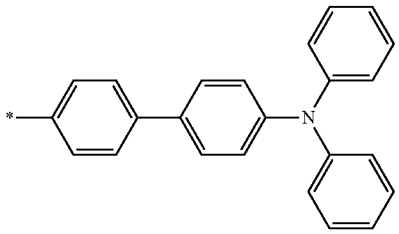
(M1)-6
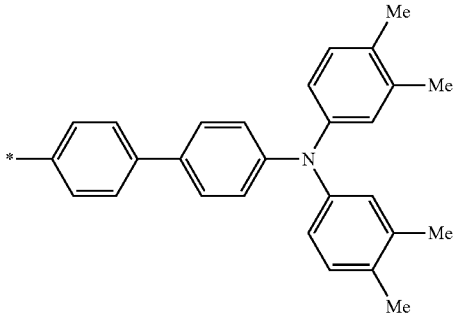
(M1)-7
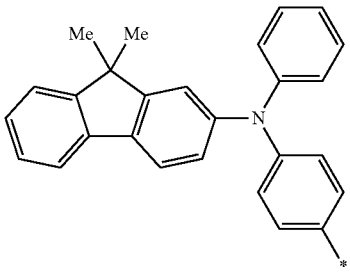
(M1)-8
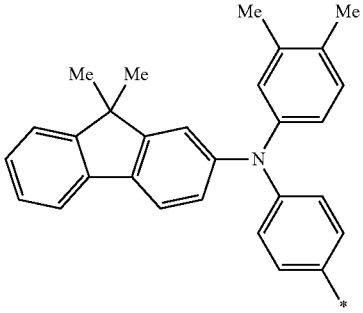
-continued
(M1)-9
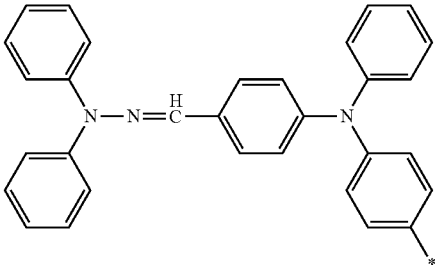
(M1)-10
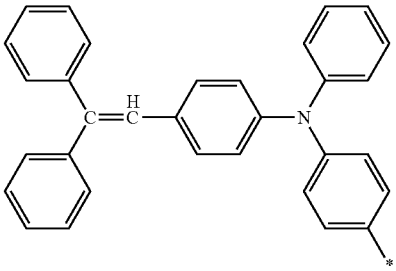
(M1)-11
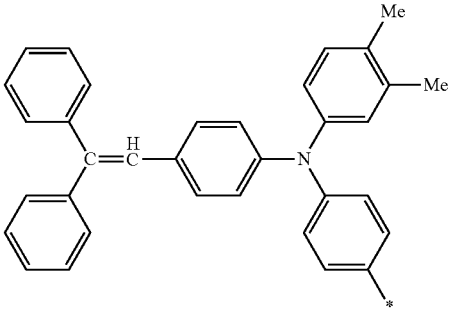
(M1)-12
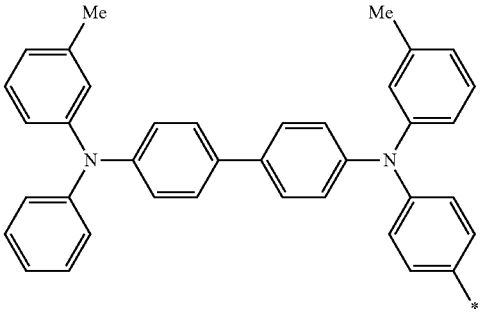
(M1)-13
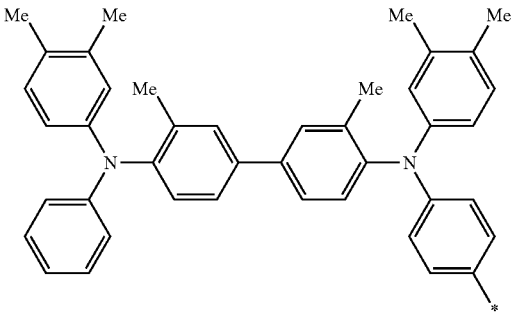

-continued
(M1)-14
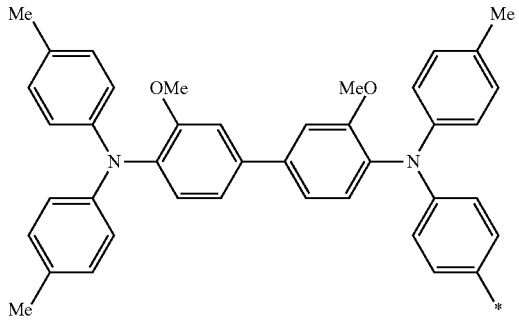
(M1)-15
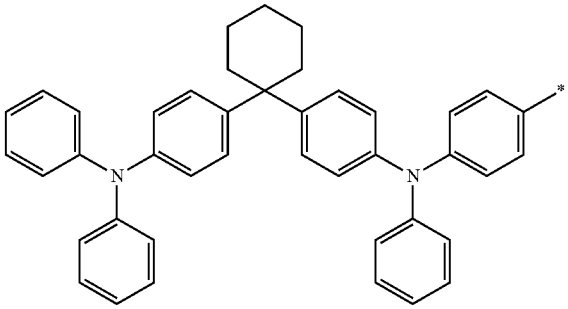
(M1)-16
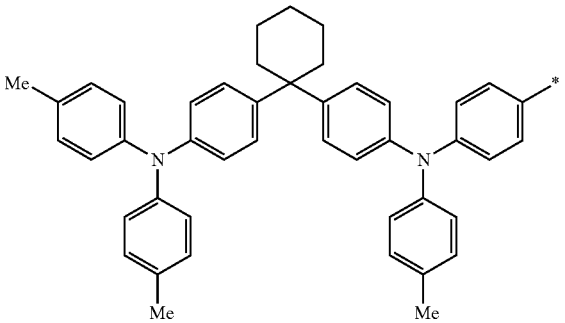
(M1)-17
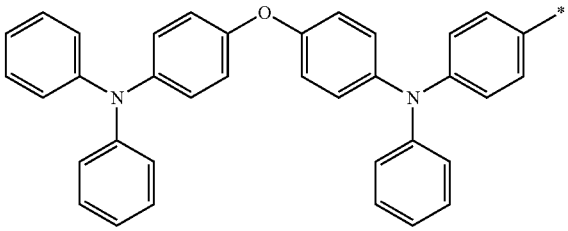
(M1)-18
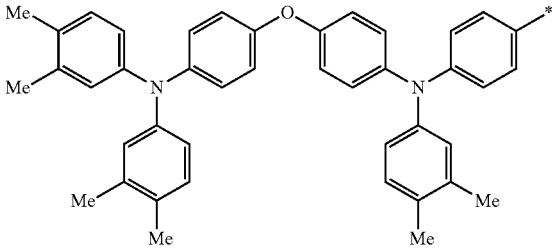
-continued
(M1)-19
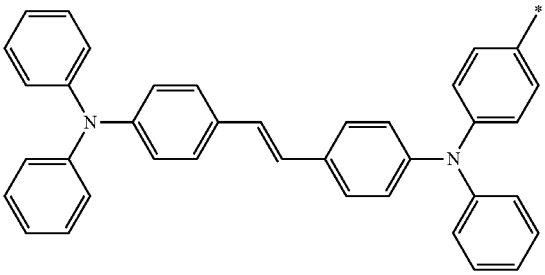
(M1)-20
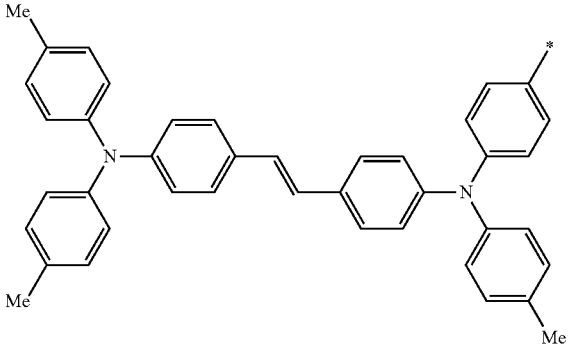
(M1)-21
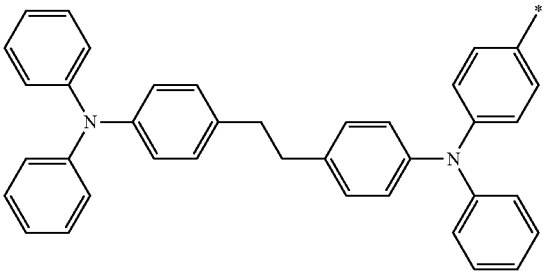
(M1)-22
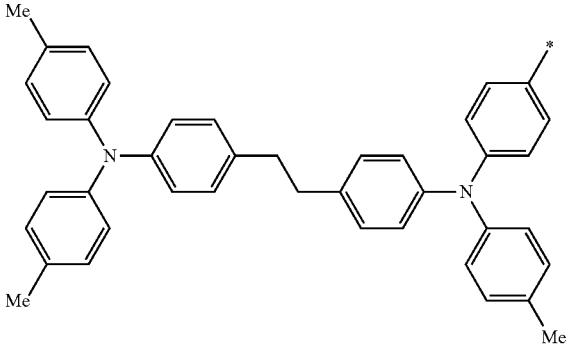

-continued
(M2)-1
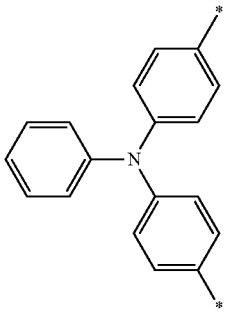
(M2)-2
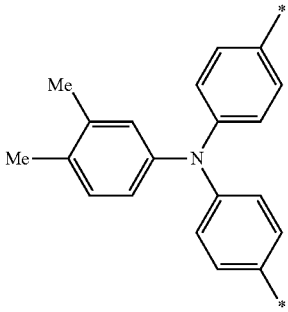
(M2)-3
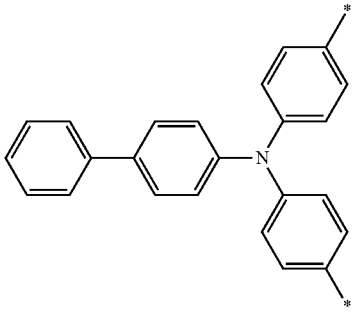
(M2)-4
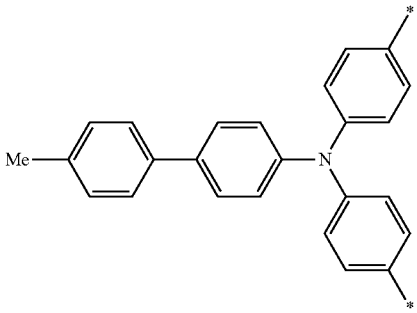
(M2)-5
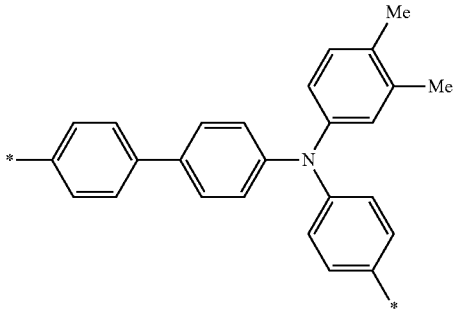
-continued
(M2)-6
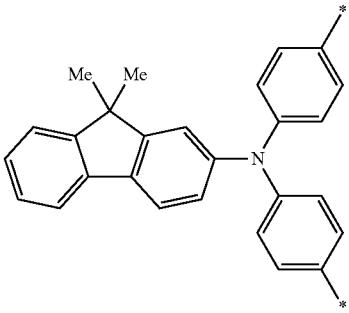
(M2)-7
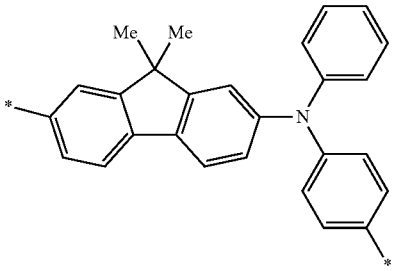
(M2)-8
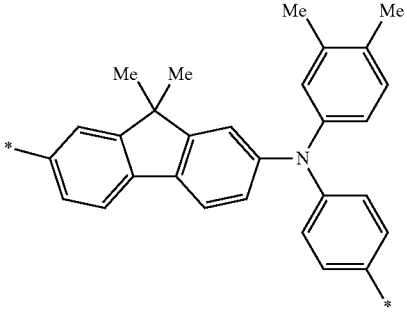
(M1)-9
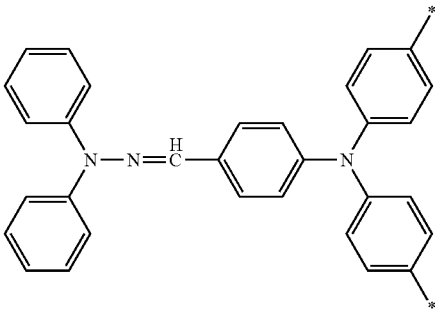
(M1)-10
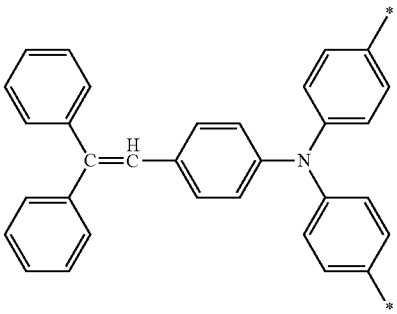

-continued
(M1)-11
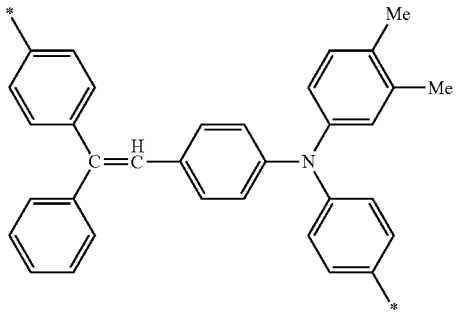
(M1)-12
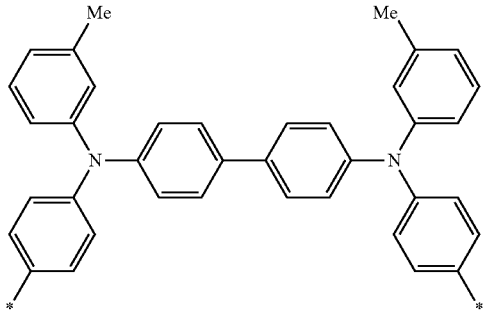
(M1)-13
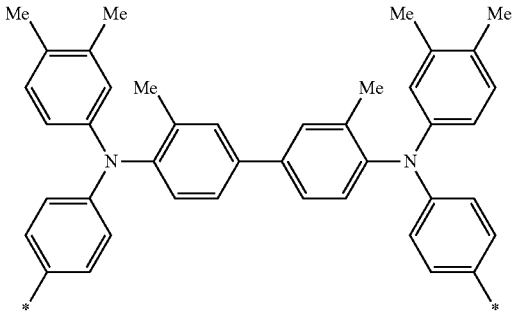
(M2)-14
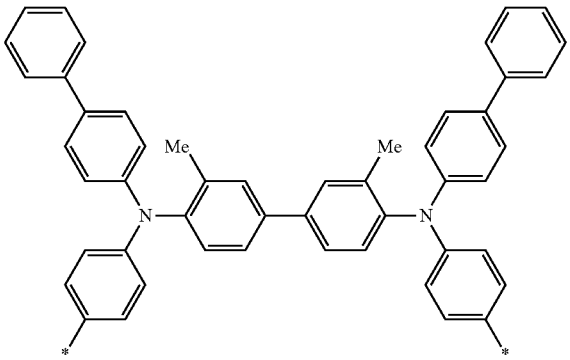
-continued
(M2)-15
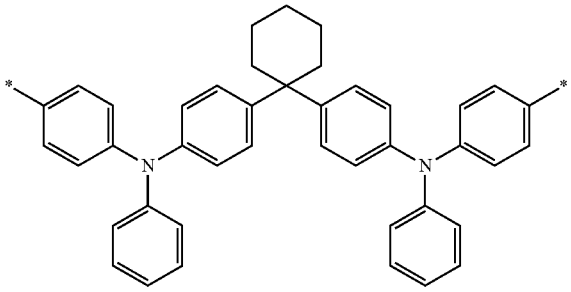
(M2)-16
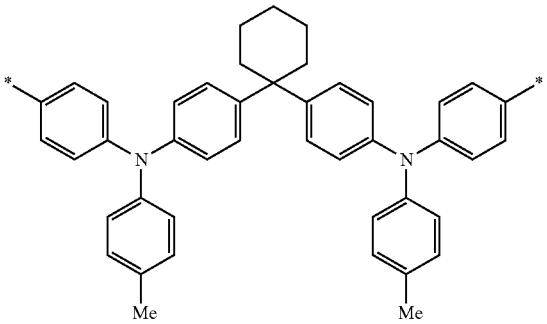
(M2)-17
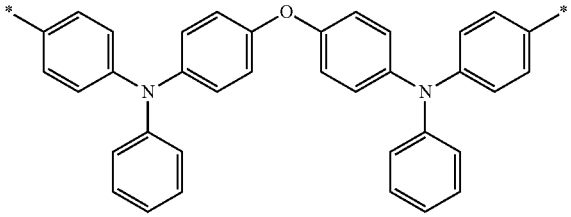
(M2)-18
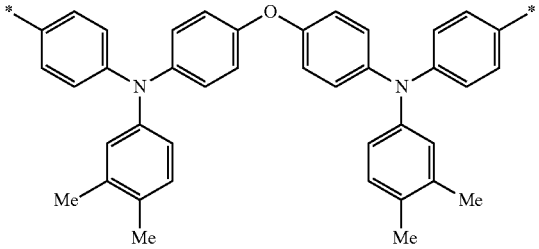
(M2)-19
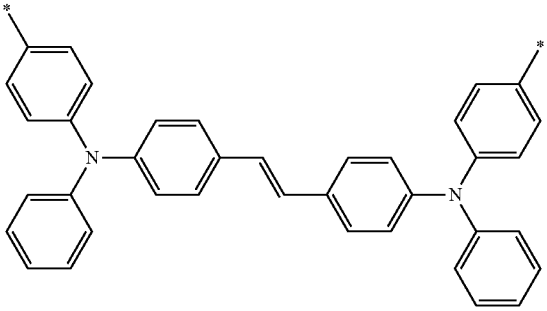

-continued
(M2)-20
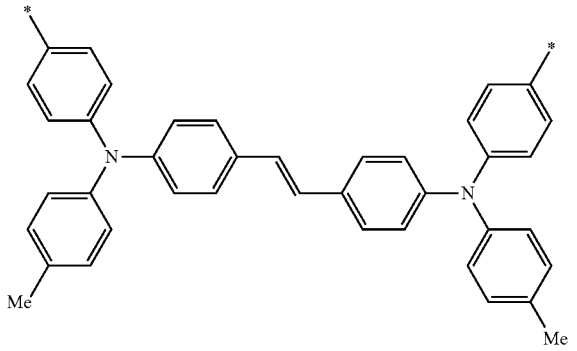
(M2)-21
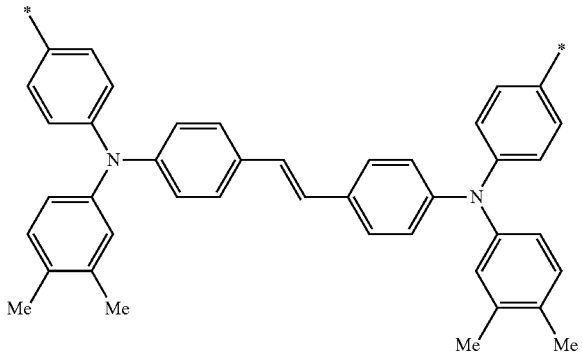
(M2)-22
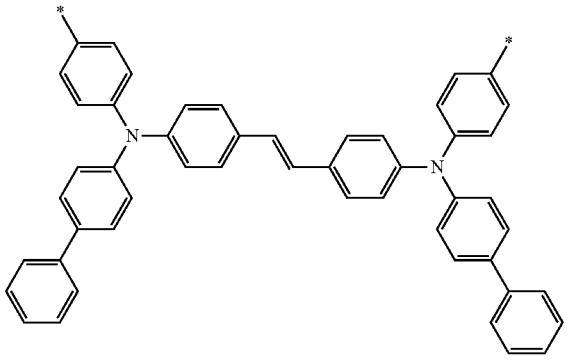
(M2)-23
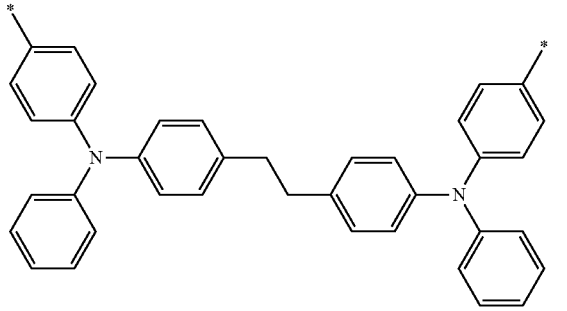
-continued
(M2)-24
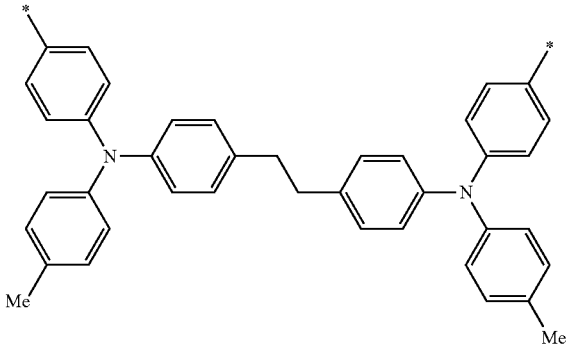
(M2)-25
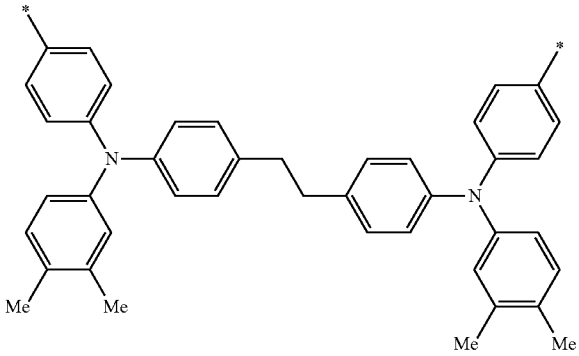
(M2)-26
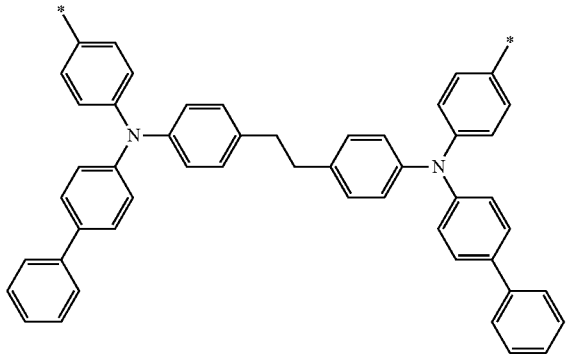
(M3)-1
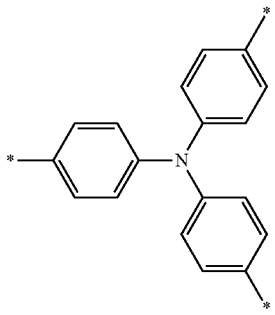

-continued
(M3)-2
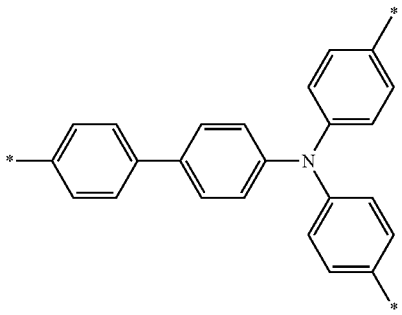
(M3)-3
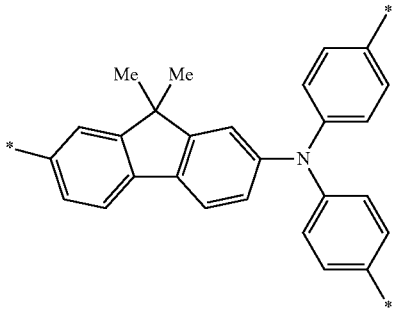
(M3)-4
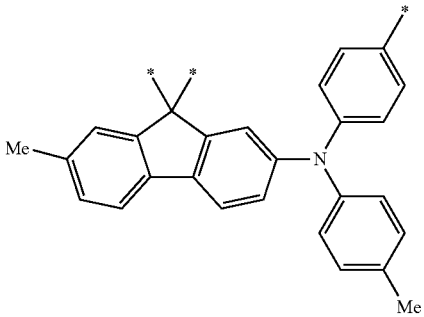
(M3)-5
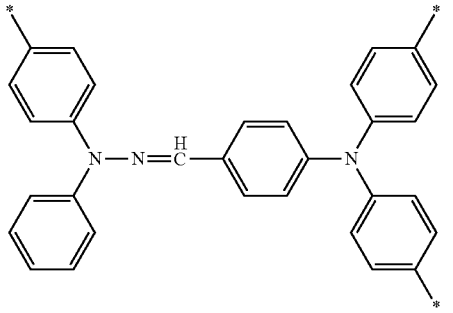
(M3)-6
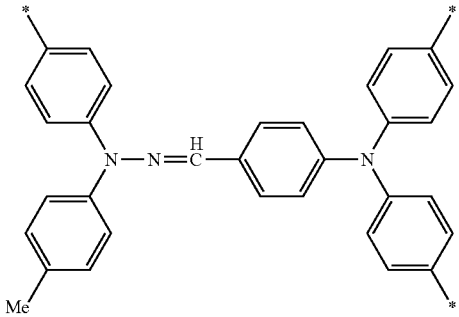
-continued
(M3)-7
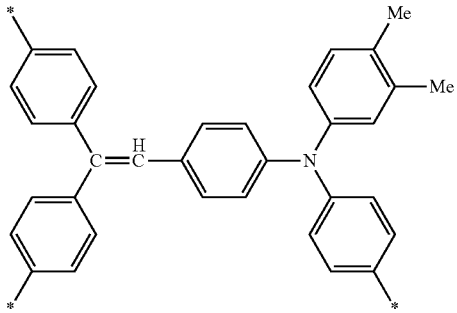
(M3)-8
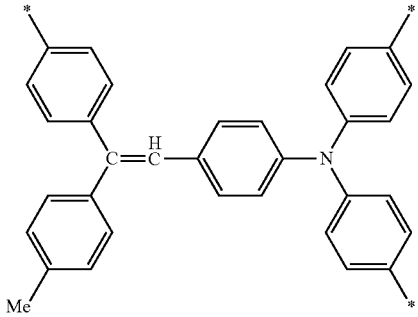
(M3)-9
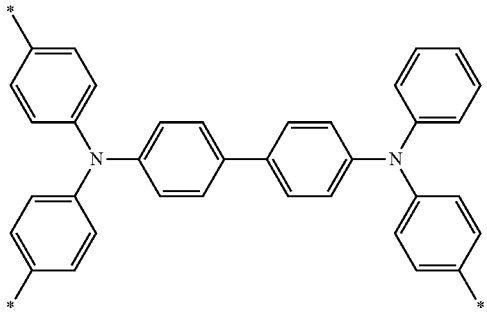
(M3)-10
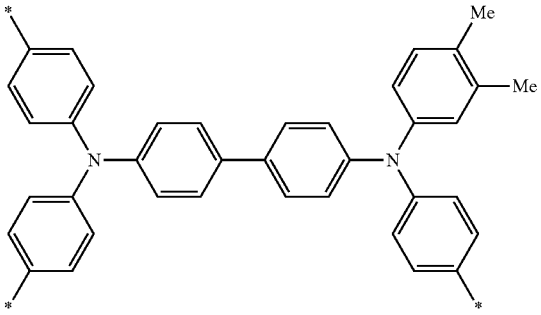

-continued
(M3)-11
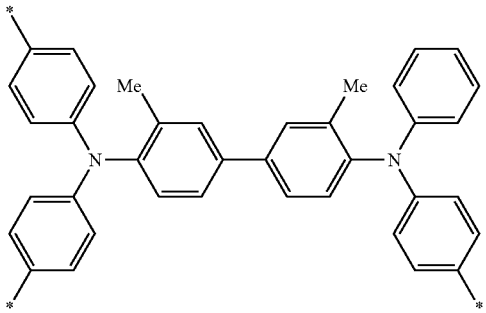
(M3)-12
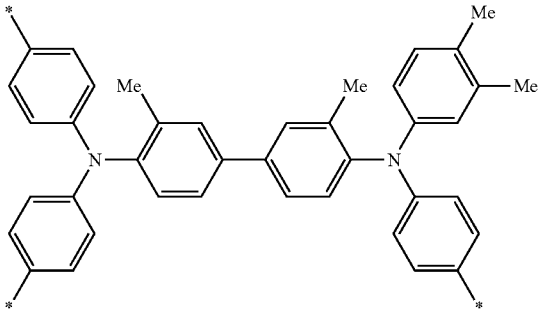
(M3)-13
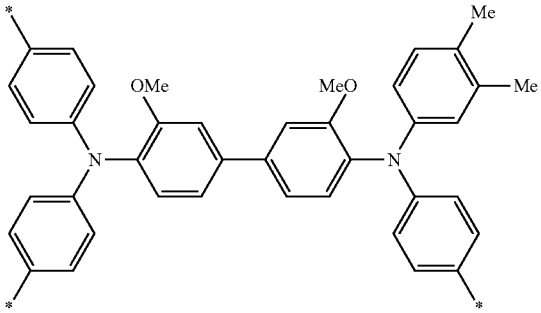
(M3)-14
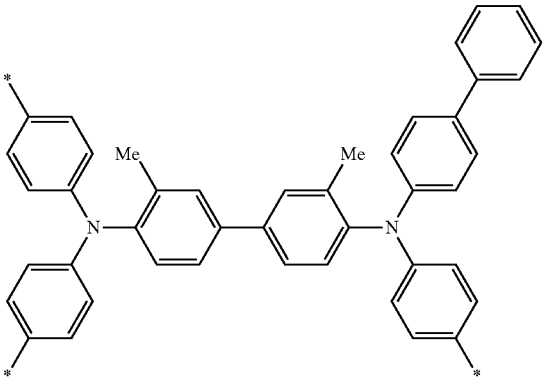
-continued
(M3)-15
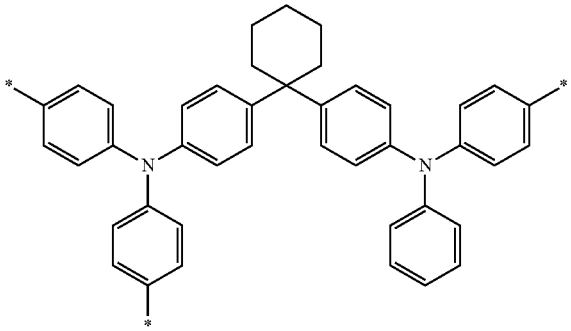
(M3)-16
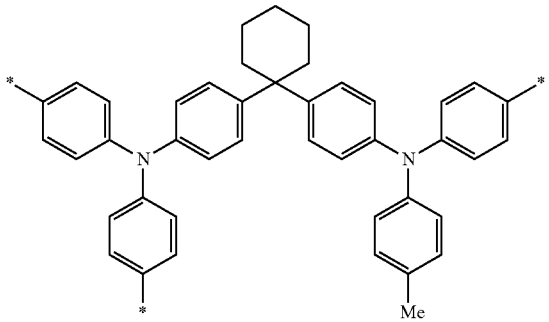
(M3)-17
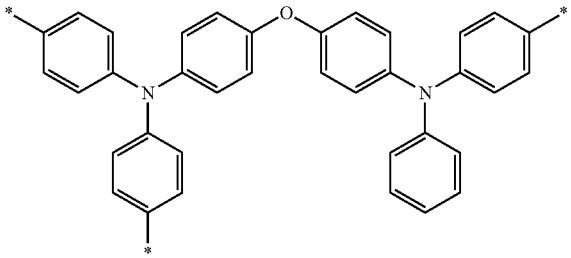
(M3)-18
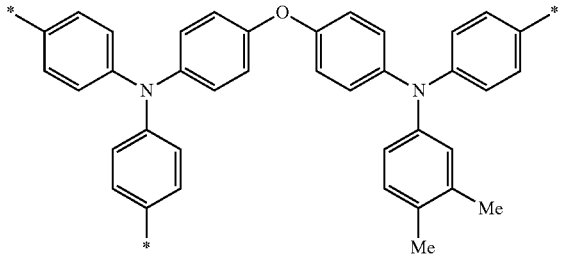
(M3)-19
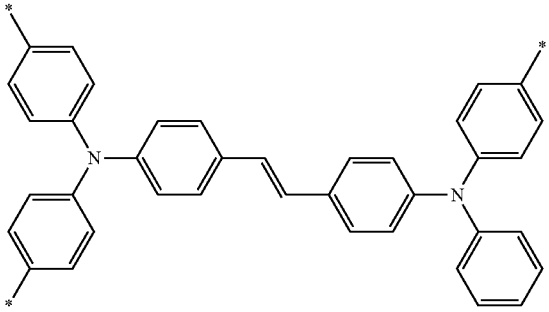

-continued
(M3)-20
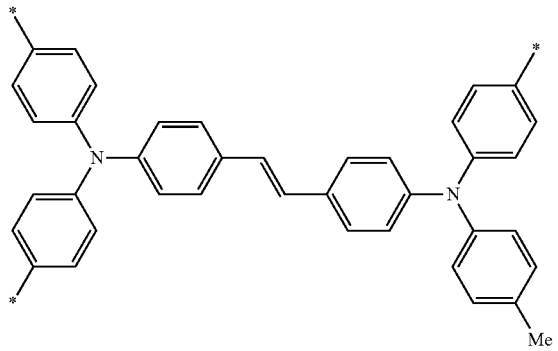
(M3)-21
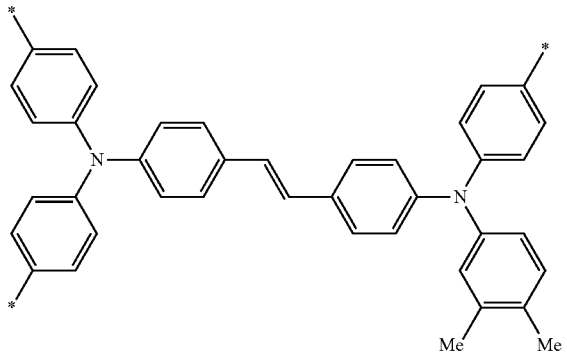
(M3)-22
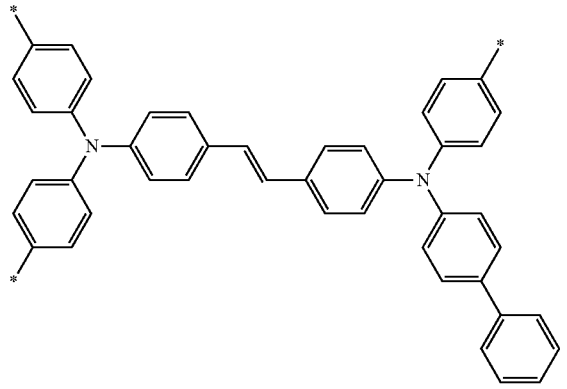
(M3)-23
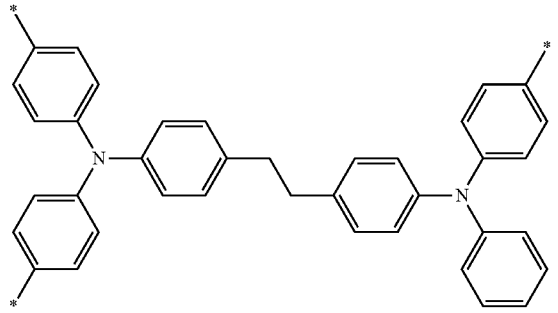
-continued
(M3)-24
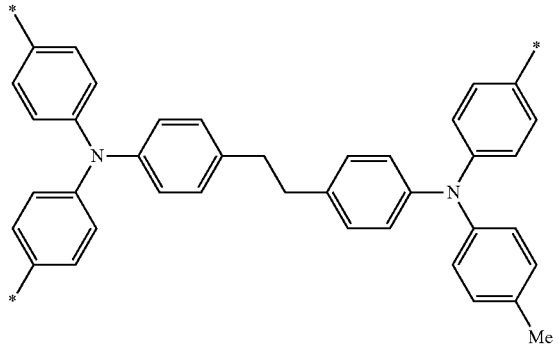
(M3)-25
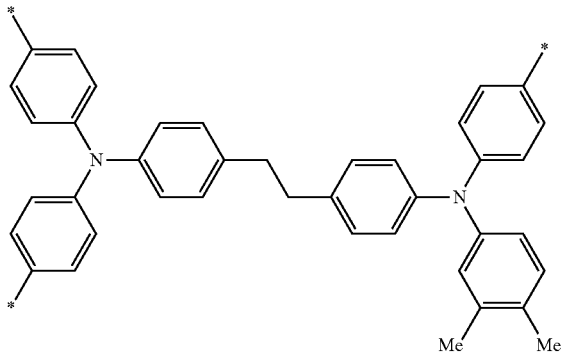
(M3)-26
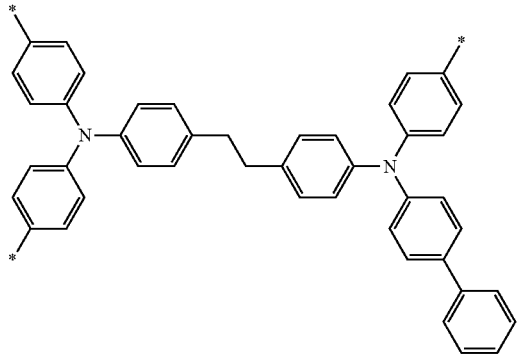
(M4)-1
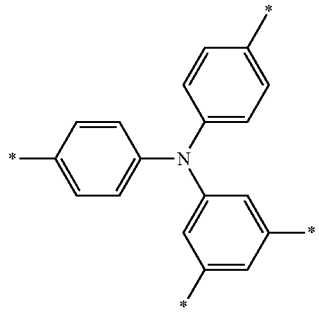

-continued
(M4)-2
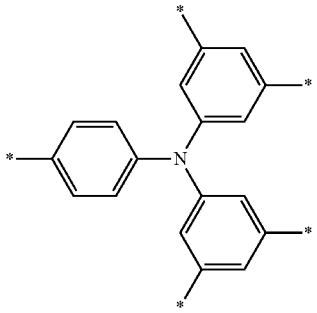
(M4)-3
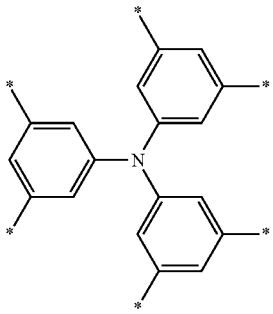
(M4)-4
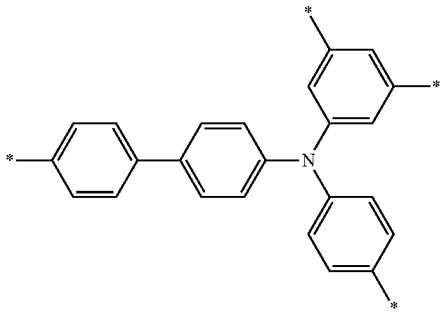
(M4)-5
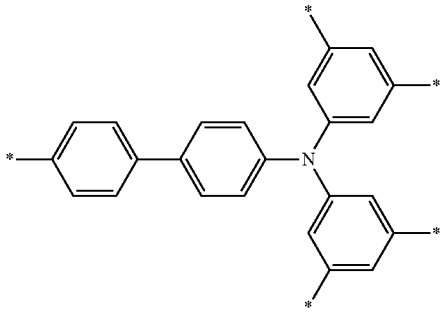
(M4)-6
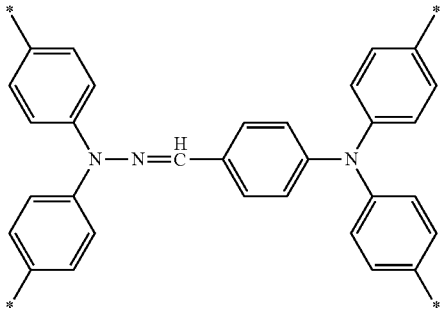
-continued
(M4)-7
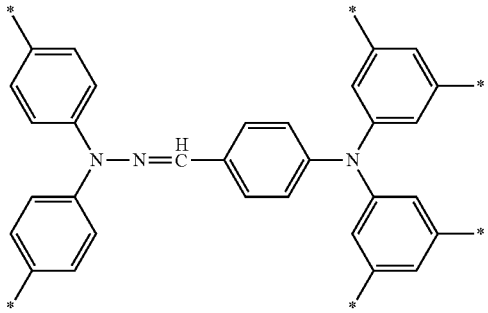
(M4)-8
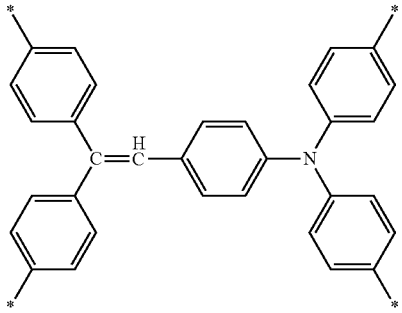
(M4)-9
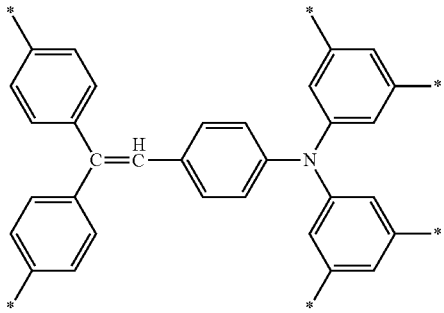
(M4)-10
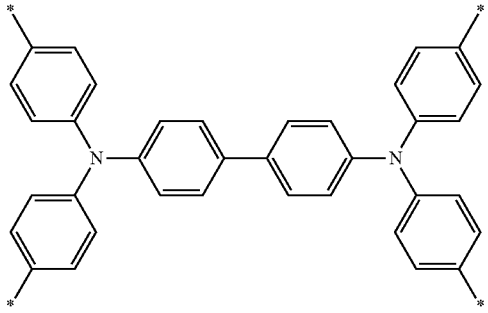
(M4)-11
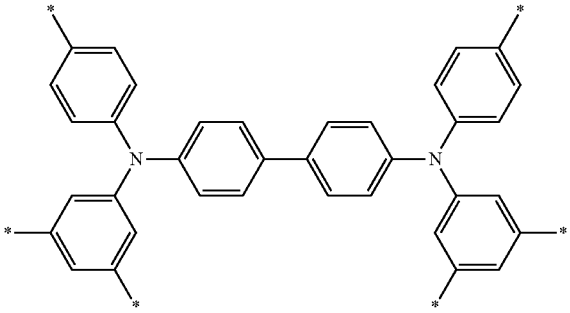

-continued
(M4)-12
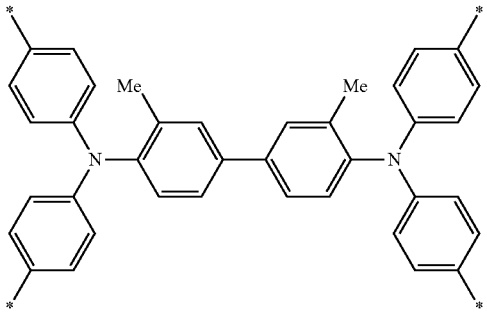
(M4)-13
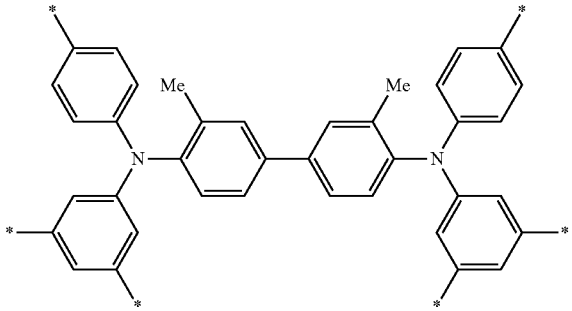
(M4)-14
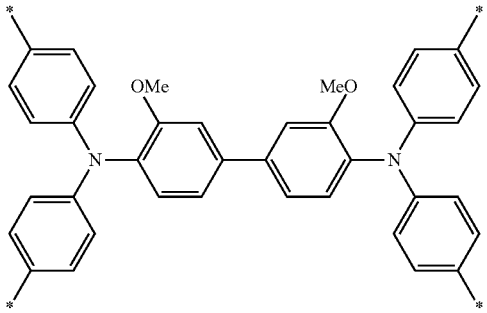
(M4)-15
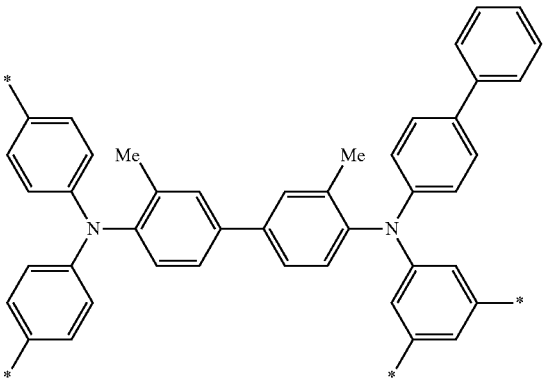
-continued
(M4)-16
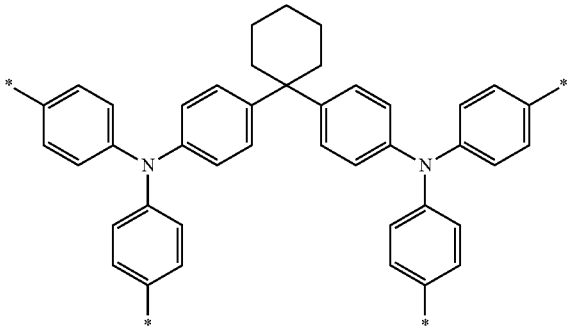
(M4)-17
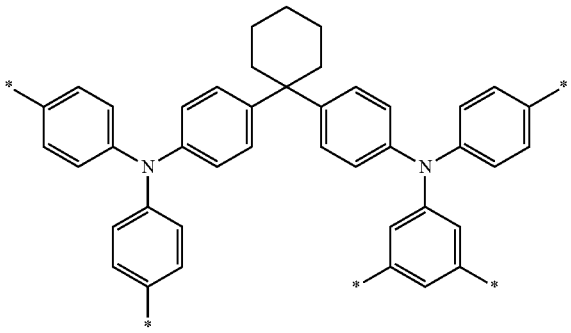
(M4)-18
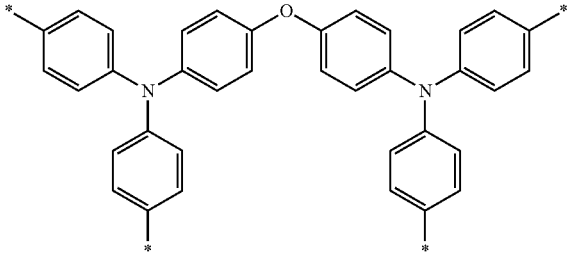
(M4)-19
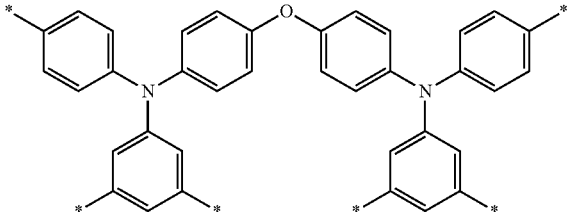
(M4)-20
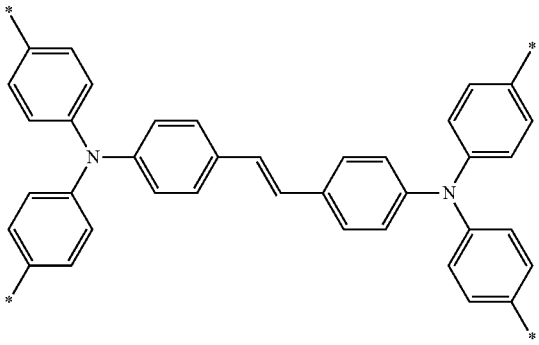

-continued
(M4)-21
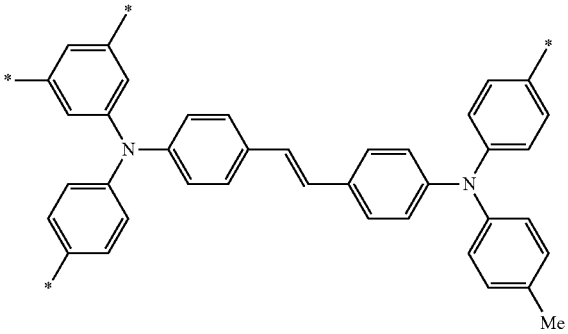
(M4)-22
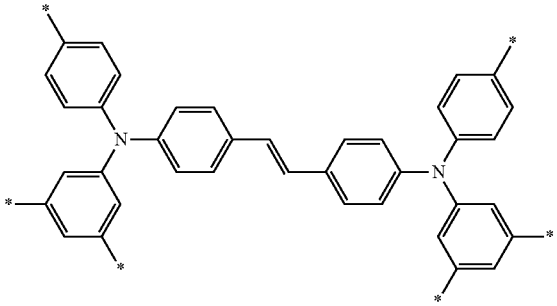
(M4)-23
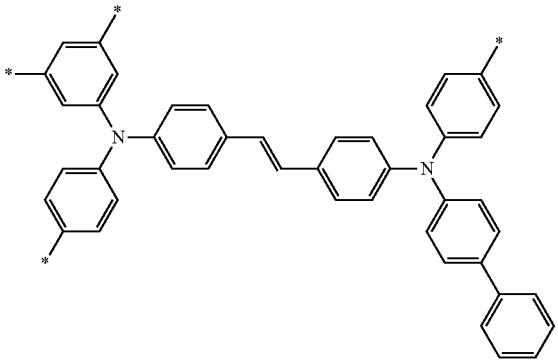
(M4)-24
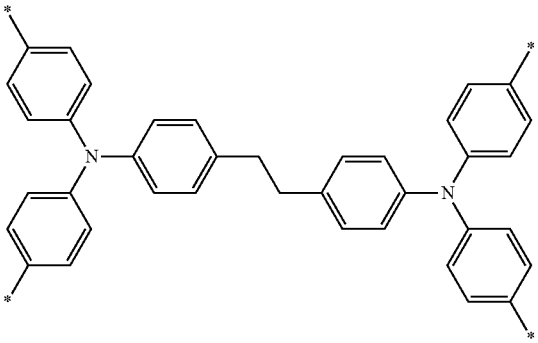
-continued
(M4)-25
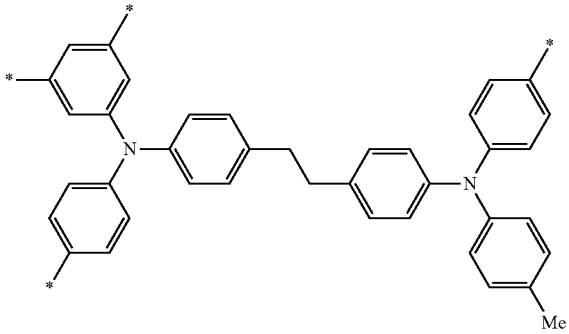
(M4)-26
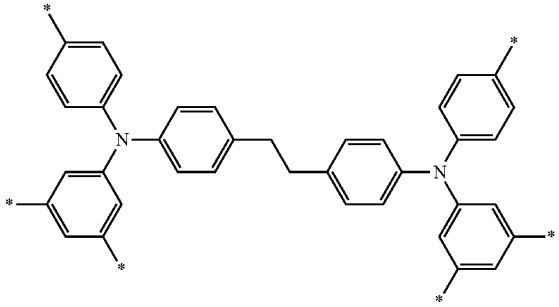
(M4)-27
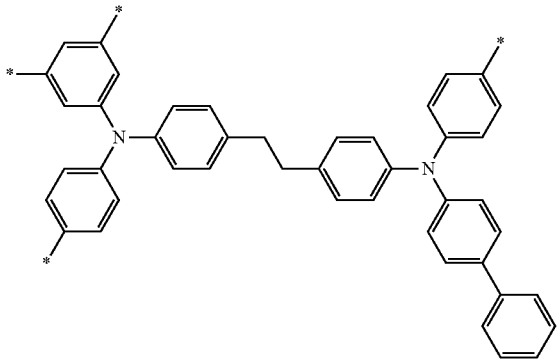
(M4)-28
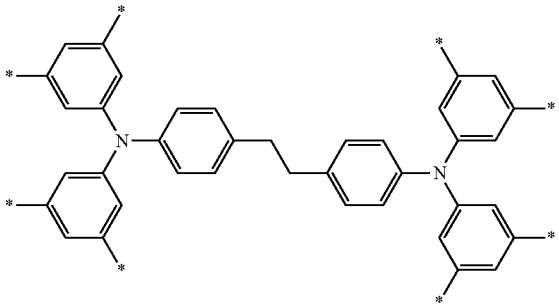
Next, specific examples of the functional group linked to the charge transporting skeleton F are shown.

(R1)-1
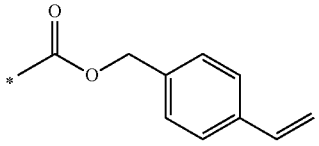
(R1)-2
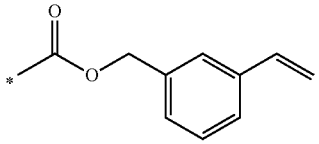
(R1)-3
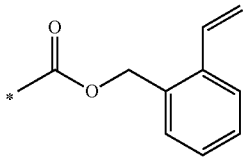
(R1)-4
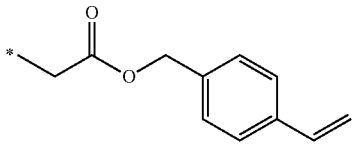
(R1)-5
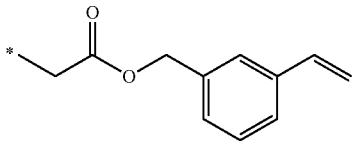
(R1)-6
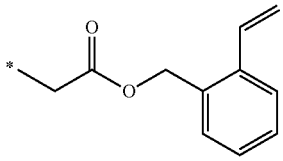
(R1)-7
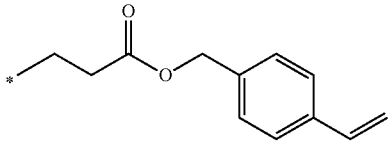
(R1)-8
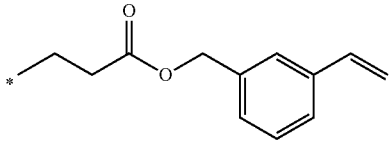
(R1)-9
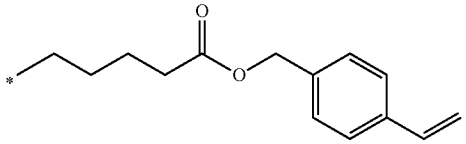
(R1)-10
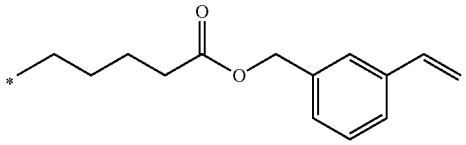
-continued
(R1)-11
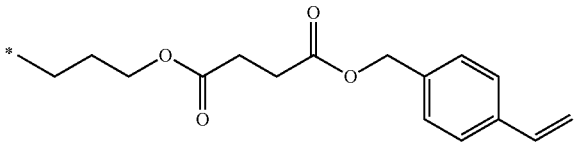
(R1)-12
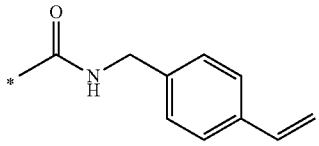
(R1)-13
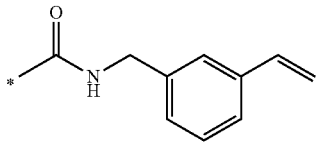
(R1)-14
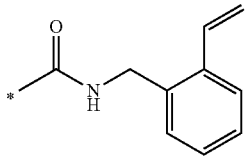
(R1)-15
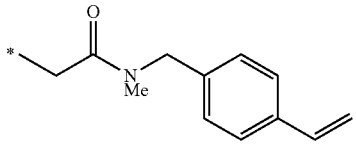
(R1)-16
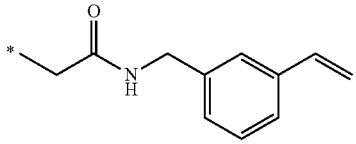
(R1)-17
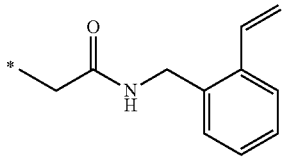
(R1)-18
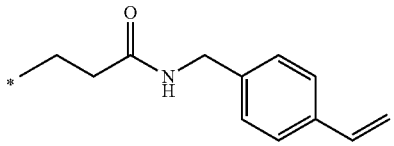
(R1)-19
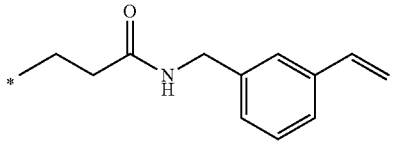
(R1)-20
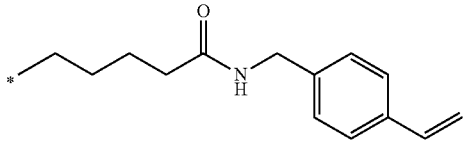

-continued
(R1)-21
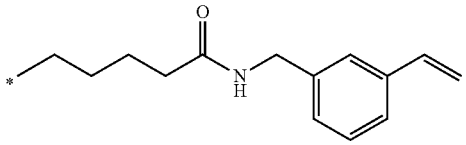
(R1)-22
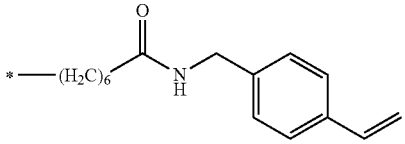
(R1)-23
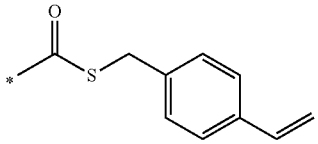
(R1)-24
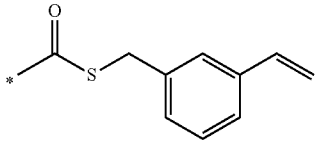
(R1)-25
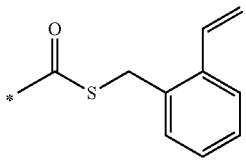
(R1)-26
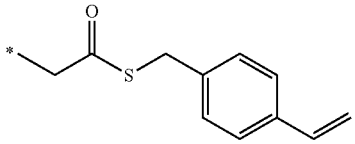
(R1)-27
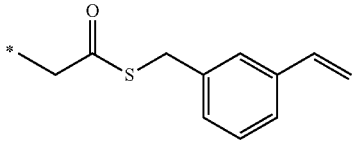
(R1)-28
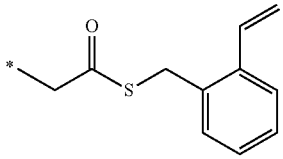
(R1)-29
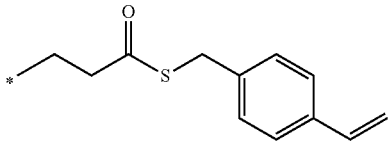
(R1)-30
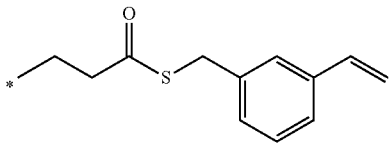
-continued
(R1)-31
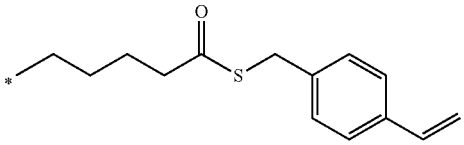
(R1)-32
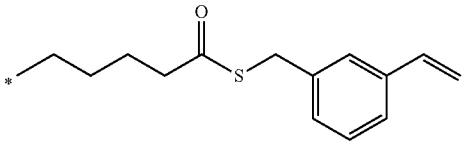
(R1)-33
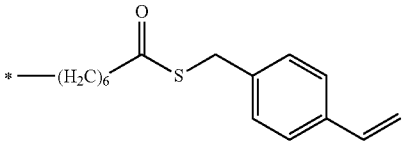
(R1)-34
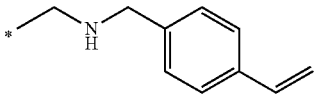
(R1)-35
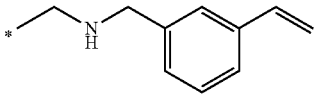
(R1)-36
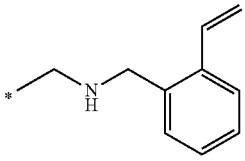
(R1)-37
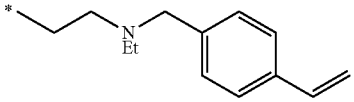
(R1)-38
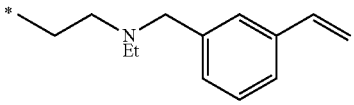
(R1)-39
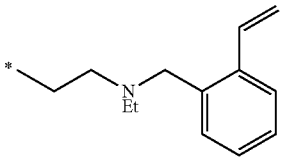
(R1)-40
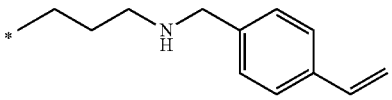
(R1)-41
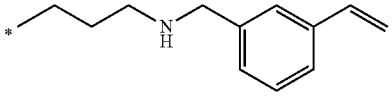

-continued
(R1)-42
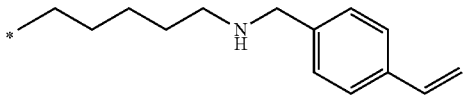
(R1)-43
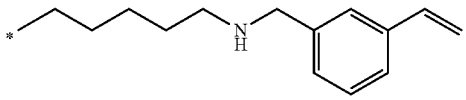
(R1)-44
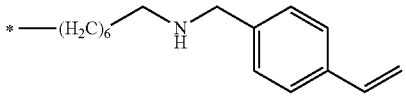
(R1)-45
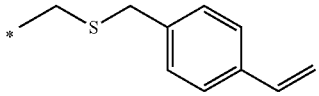
(R1)-46
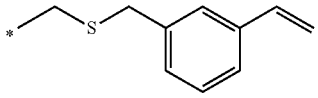
(R1)-47
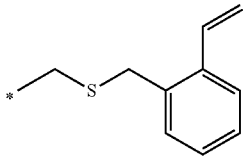
(R1)-48
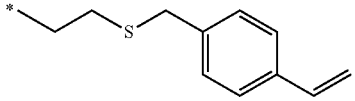
(R1)-49
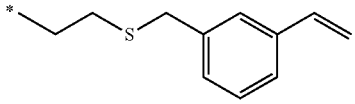
(R1)-50
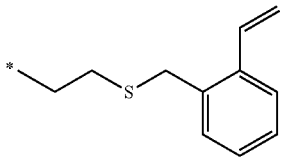
(R1)-51
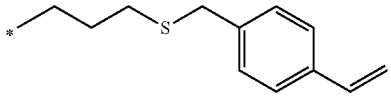
(R1)-52
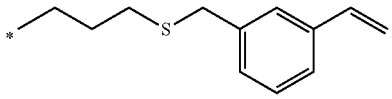
(R1)-53
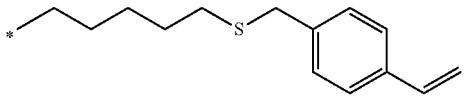
-continued
(R1)-54
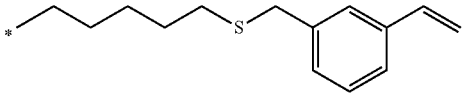
(R1)-55
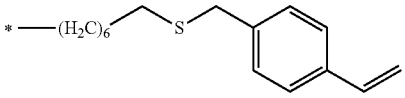
(R2)-1
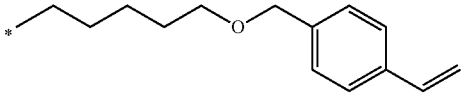
(R2)-2
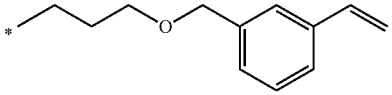
(R2)-3
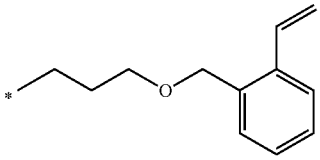
(R2)-4
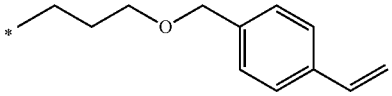
(R2)-5
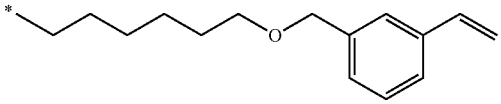
(R2)-6
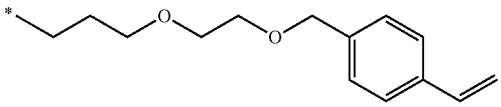
(R2)-7
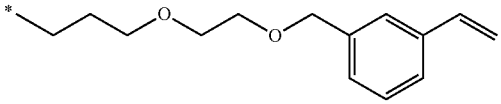
(R2)-8
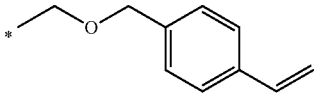
(R2)-9
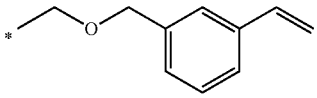
(R2)-10
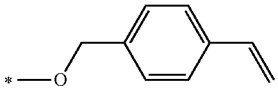
(R2)-11
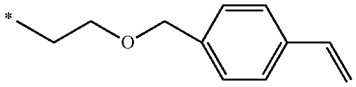

-continued
(R3)-1
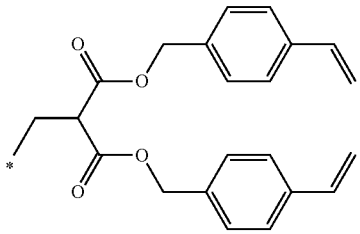
(R3)-2
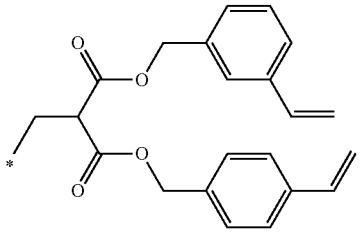
(R3)-3
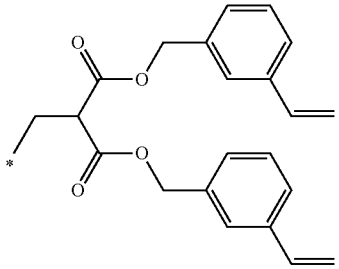
(R3)-4
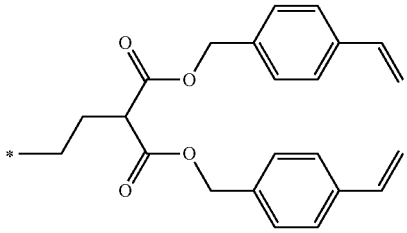
(R3)-5
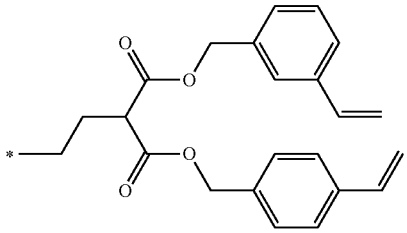
(R3)-6
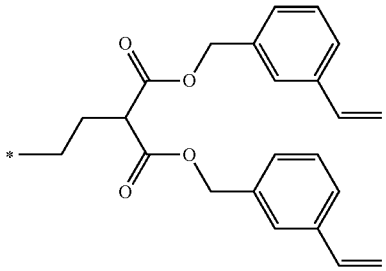
-continued
(R3)-7
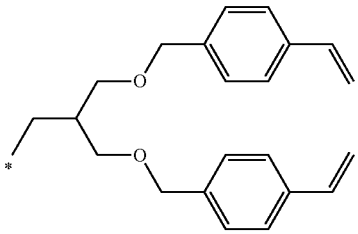
(R3)-8
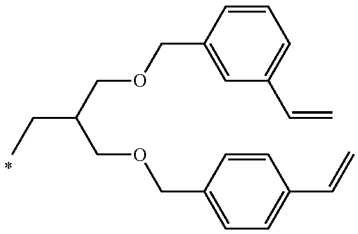
(R3)-9
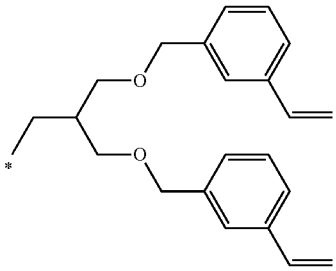
(R3)-10
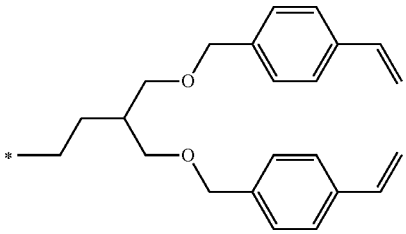
(R3)-11
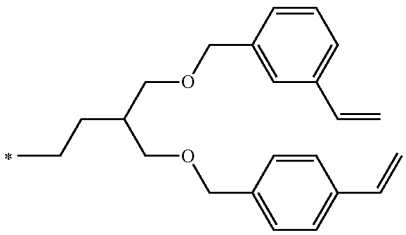
(R3)-12
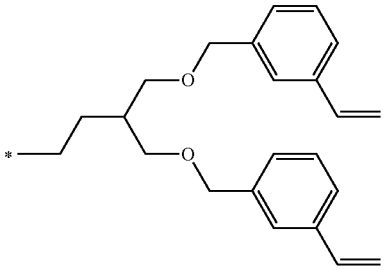

-continued
(R3)-13
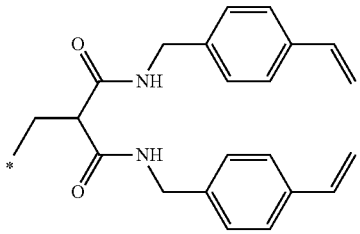
(R3)-14
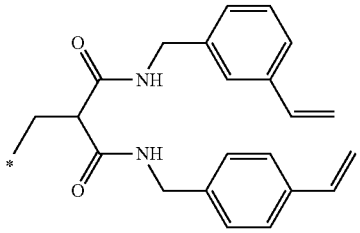
(R3)-15
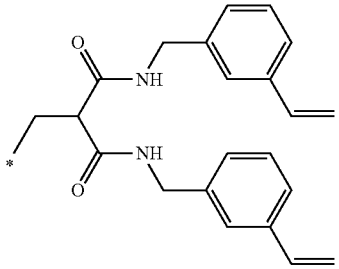
(R3)-16
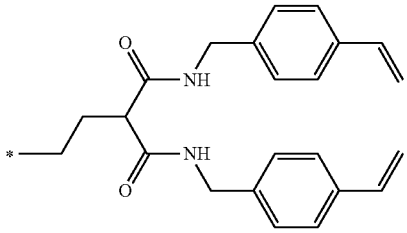
(R3)-17
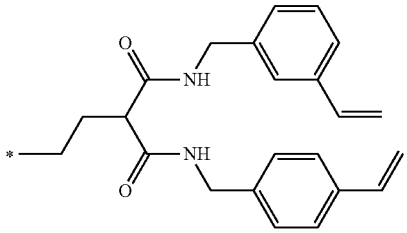
(R3)-18
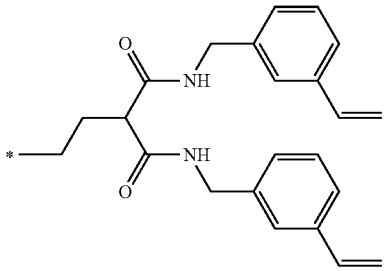
-continued
(R3)-19
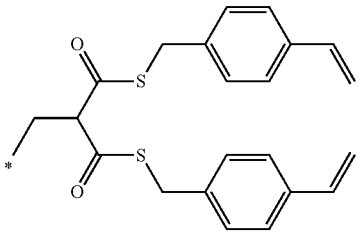
(R3)-20
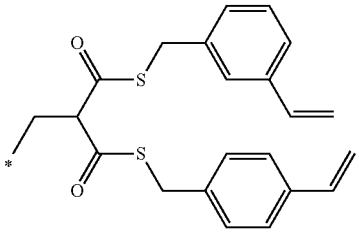
(R3)-21
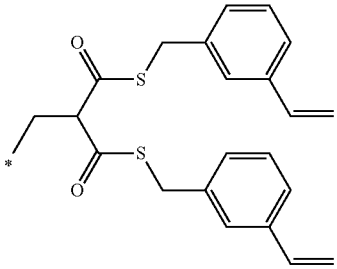
(R3)-22
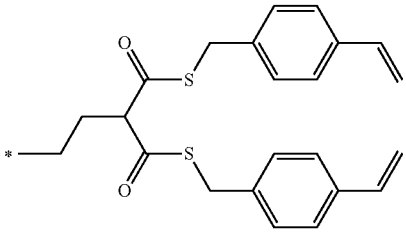
(R3)-23
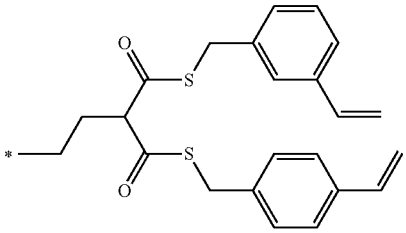
(R3)-24
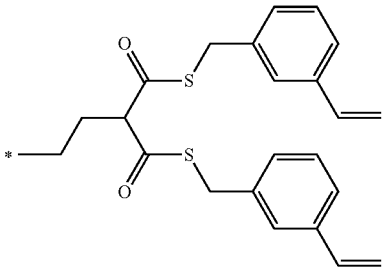

-continued
(R3)-25
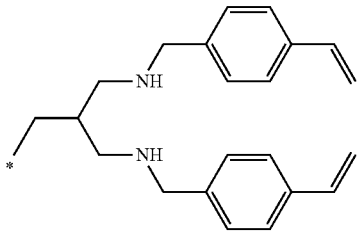
(R3)-26
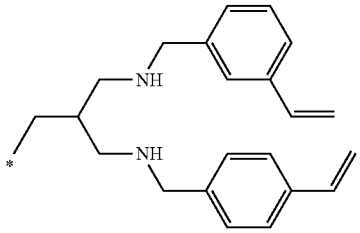
(R3)-27
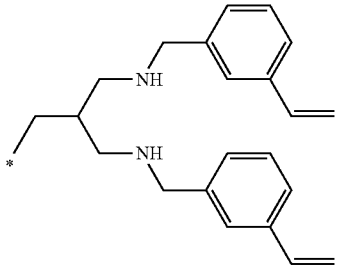
(R3)-28
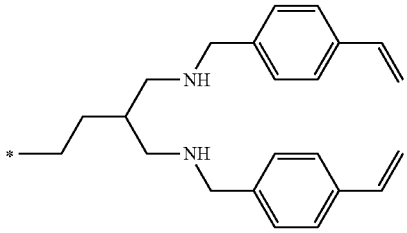
(R3)-29
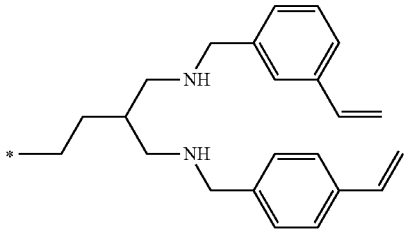
(R3)-30
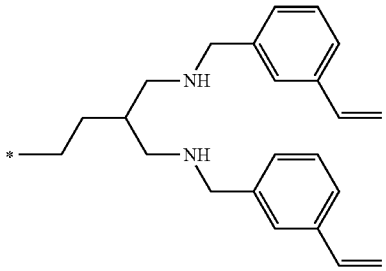
-continued
(R3)-31
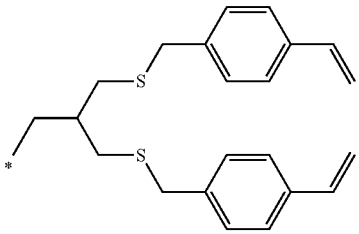
(R3)-32
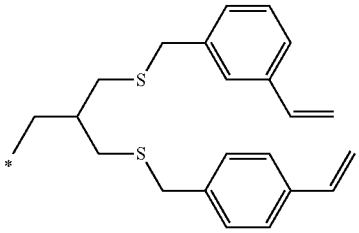
(R3)-33
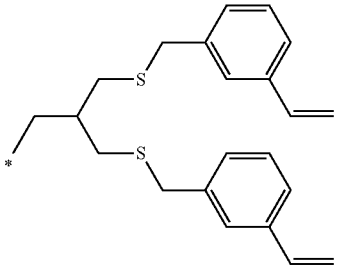
(R3)-34
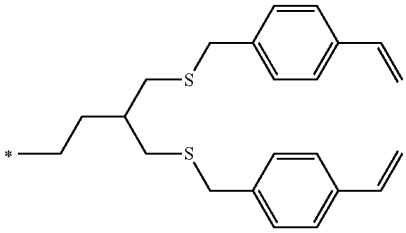
(R3)-35
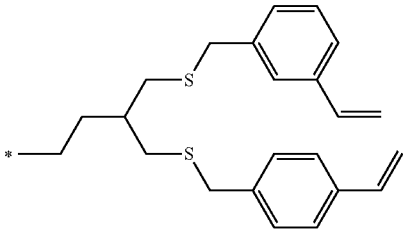
(R3)-36
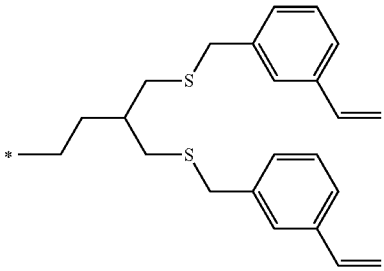

-continued
(R3)-37
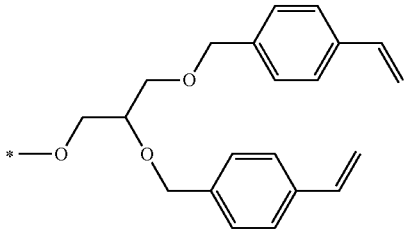
(R3)-38
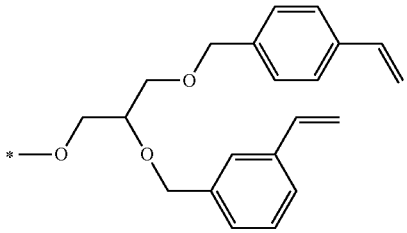
(R3)-39
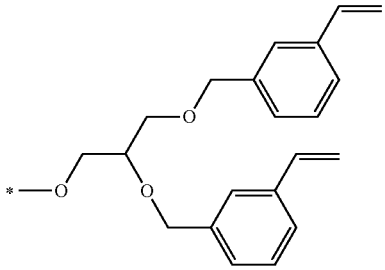
(R3)-40
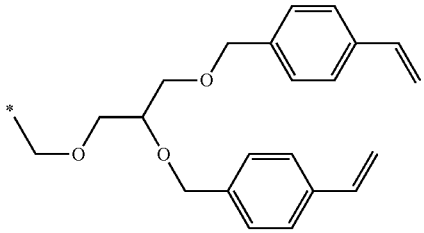
(R3)-41
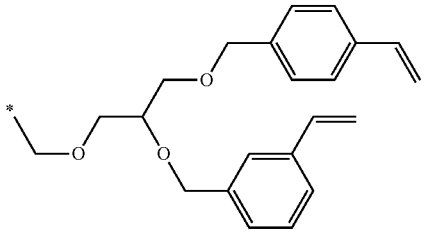
(R3)-42
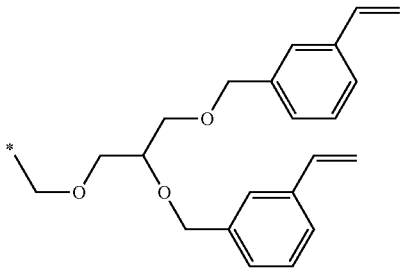
-continued
(R3)-43
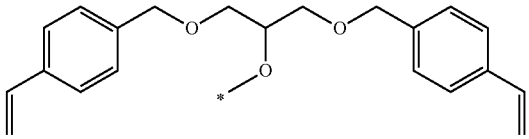
(R3)-44
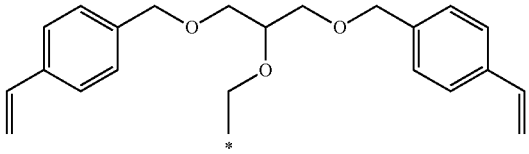
(R3)-45
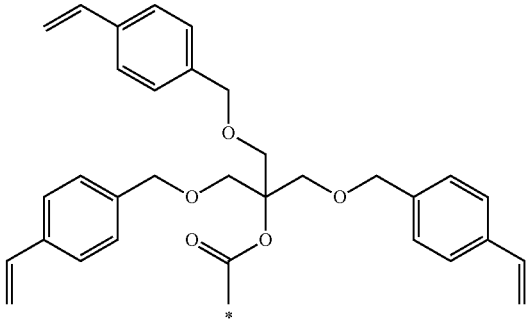
(R3)-46
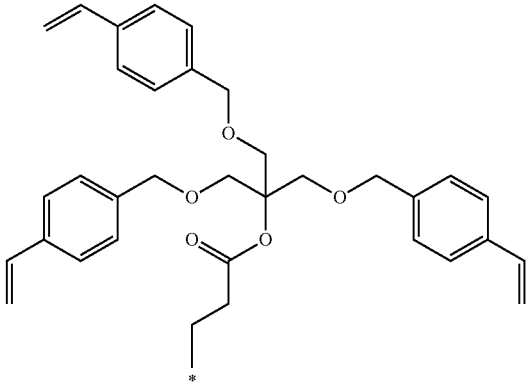
(R3)-47
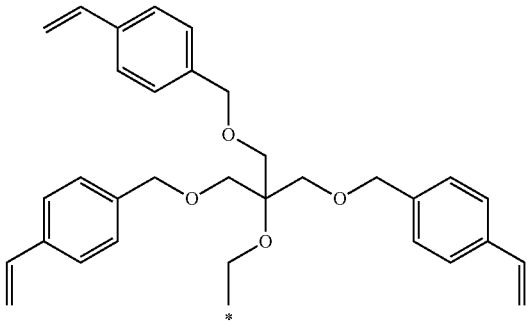

-continued (R3)-48

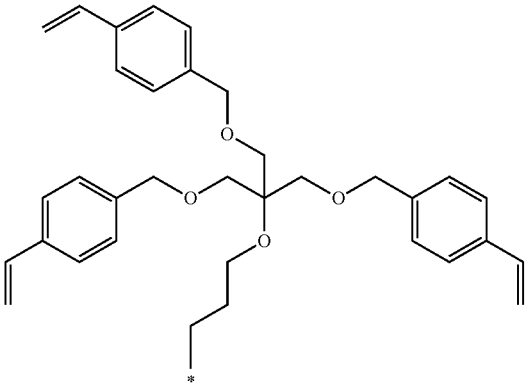

(R4)-1

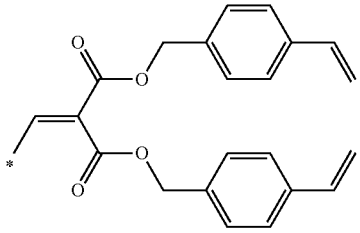

(R4)-2

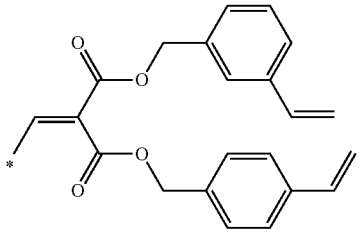

(R4)-3

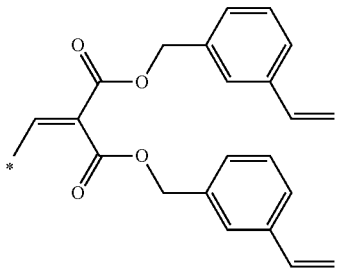

(R4)-4

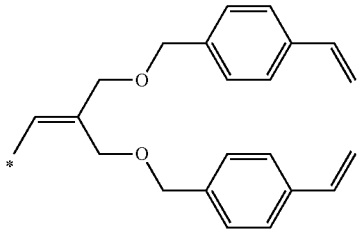

-continued (R4)-5

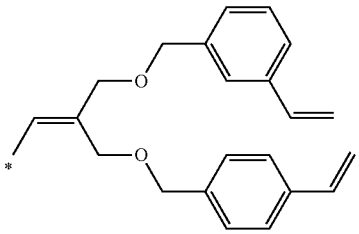

(R4)-6

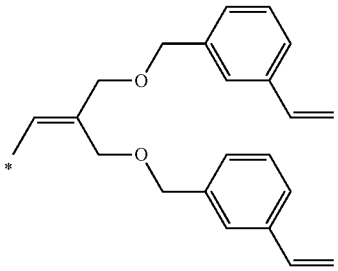

Next, specific examples of the compound represented by the formula (I), specifically the formula (I-a) are shown below.

Specific Examples of Formula (I) [Formula (I-a)]

| Exemplary compound | Charge transporting skeleton F | Functional group |
|---|---|---|
| (I-a)-1 | (M1)-15 | (R2)-8 |
| (I-a)-2 | (M1)-15 | (R2)-9 |
| (I-a)-3 | (M1)-15 | (R2)-10 |
| (I-a)-4 | (M1)-16 | (R2)-8 |
| (I-a)-5 | (M1)-17 | (R2)-8 |
| (I-a)-6 | (M1)-17 | (R2)-9 |
| (I-a)-7 | (M1)-17 | (R2)-10 |
| (I-a)-8 | (M1)-18 | (R2)-8 |
| (I-a)-9 | (M1)-18 | (R2)-9 |
| (I-a)-10 | (M1)-18 | (R2)-10 |
| (I-a)-11 | (M1)-19 | (R2)-8 |
| (I-a)-12 | (M1)-21 | (R2)-8 |
| (I-a)-13 | (M1)-22 | (R2)-8 |
| (I-a)-14 | (M2)-15 | (R2)-8 |
| (I-a)-15 | (M2)-15 | (R2)-9 |
| (I-a)-16 | (M2)-15 | (R2)-10 |
| (I-a)-17 | (M2)-16 | (R2)-8 |
| (I-a)-18 | (M2)-17 | (R2)-8 |
| (I-a)-19 | (M2)-23 | (R2)-8 |
| (I-a)-20 | (M2)-23 | (R2)-9 |
| (I-a)-21 | (M2)-23 | (R2)-10 |
| (I-a)-22 | (M2)-24 | (R2)-8 |
| (I-a)-23 | (M2)-24 | (R2)-9 |
| (I-a)-24 | (M2)-24 | (R2)-10 |
| (I-a)-25 | (M2)-25 | (R2)-8 |
| (I-a)-26 | (M2)-25 | (R2)-9 |
| (I-a)-27 | (M2)-25 | (R2)-10 |
| (I-a)-28 | (M2)-26 | (R2)-8 |
| (I-a)-29 | (M2)-26 | (R2)-9 |
| (I-a)-30 | (M2)-26 | (R2)-10 |
| (I-a)-31 | (M2)-21 | (R2)-11 |

Next, specific examples of the compound represented by the formula (I), specifically the formula (I-b), are shown below.

Specific Examples of Formula (I) [Formula (I-b)]

| Exemplary compound | Charge transporting skeleton F | Functional group |
|---|---|---|
| (I-b)-1 | (M1)-1 | (R2)-1 |
| (I-b)-2 | (M1)-1 | (R2)-2 |
| (I-b)-3 | (M1)-1 | (R2)-4 |
| (I-b)-4 | (M1)-2 | (R2)-5 |
| (I-b)-5 | (M1)-2 | (R2)-7 |
| (I-b)-6 | (M1)-4 | (R2)-3 |
| (I-b)-7 | (M1)-4 | (R2)-5 |
| (I-b)-8 | (M1)-5 | (R2)-6 |
| (I-b)-9 | (M1)-8 | (R2)-4 |
| (I-b)-10 | (M1)-16 | (R2)-5 |
| (I-b)-11 | (M1)-20 | (R2)-1 |
| (I-b)-12 | (M1)-22 | (R2)-1 |
| (I-b)-13 | (M2)-2 | (R2)-1 |
| (I-b)-14 | (M2)-2 | (R2)-3 |
| (I-b)-15 | (M2)-2 | (R2)-4 |
| (I-b)-16 | (M2)-6 | (R2)-4 |
| (I-b)-17 | (M2)-6 | (R2)-5 |
| (I-b)-18 | (M2)-6 | (R2)-6 |
| (I-b)-19 | (M2)-10 | (R2)-4 |
| (I-b)-20 | (M2)-10 | (R2)-5 |
| (I-b)-21 | (M2)-13 | (R2)-1 |
| (I-b)-22 | (M2)-13 | (R2)-3 |
| (I-b)-23 | (M2)-13 | (R2)-4 |
| (I-b)-24 | (M2)-13 | (R2)-5 |
| (I-b)-25 | (M2)-13 | (R2)-6 |
| (I-b)-26 | (M2)-16 | (R2)-4 |
| (I-b)-27 | (M2)-21 | (R2)-5 |
| (I-b)-28 | (M2)-25 | (R2)-4 |
| (I-b)-29 | (M2)-25 | (R2)-5 |
| (I-b)-30 | (M2)-25 | (R2)-7 |
| (I-b)-31 | (M2)-13 | (R2)-4 |

Next, specific examples of the compound represented by the formula (I), specifically the formula (I-c), are shown below.

Specific Examples of Formula (I) [Formula (I-c)]

| Exemplary compound | Charge transporting skeleton F | Functional group |
|---|---|---|
| (I-c)-1 | (M1)-1 | (R1)-1 |
| (I-c)-2 | (M1)-1 | (R1)-2 |
| (I-c)-3 | (M1)-1 | (R1)-4 |
| (I-c)-4 | (M1)-2 | (R1)-5 |
| (I-c)-5 | (M1)-2 | (R1)-7 |
| (I-c)-6 | (M1)-4 | (R1)-3 |
| (I-c)-7 | (M1)-4 | (R1)-7 |
| (I-c)-8 | (M1)-7 | (R1)-6 |
| (I-c)-9 | (M1)-11 | (R1)-4 |
| (I-c)-10 | (M1)-15 | (R1)-5 |
| (I-c)-11 | (M1)-25 | (R1)-1 |
| (I-c)-12 | (M1)-22 | (R1)-1 |
| (I-c)-13 | (M2)-2 | (R1)-1 |
| (I-c)-14 | (M2)-2 | (R1)-3 |
| (I-c)-15 | (M2)-2 | (R1)-7 |
| (I-c)-16 | (M2)-3 | (R1)-4 |
| (I-c)-17 | (M2)-3 | (R1)-7 |
| (I-c)-18 | (M2)-5 | (R1)-6 |
| (I-c)-19 | (M2)-10 | (R1)-4 |
| (I-c)-20 | (M2)-10 | (R1)-5 |
| (I-c)-21 | (M2)-13 | (R1)-1 |
| (I-c)-22 | (M2)-13 | (R1)-3 |
| (I-c)-23 | (M2)-13 | (R1)-7 |
| (I-c)-24 | (M2)-16 | (R1)-5 |

-continued

| Exemplary compound | Charge transporting skeleton F | Functional group |
|---|---|---|
| (I-c)-25 | (M2)-23 | (R1)-7 |
| (I-c)-26 | (M2)-23 | (R1)-4 |
| (I-c)-27 | (M2)-25 | (R1)-7 |
| (I-c)-28 | (M2)-25 | (R1)-4 |
| (I-c)-29 | (M2)-26 | (R1)-5 |
| (I-c)-30 | (M2)-26 | (R1)-7 |

Specific Examples of Formula (I) [Formula (I-c)]

| Exemplary compound | Charge transporting skeleton F | Functional group |
|---|---|---|
| (I-c)-31 | (M3)-1 | (R1)-2 |
| (I-c)-32 | (M3)-1 | (R1)-7 |
| (I-c)-33 | (M3)-5 | (R1)-2 |
| (I-c)-34 | (M3)-7 | (R1)-4 |
| (I-c)-35 | (M3)-7 | (R1)-2 |
| (I-c)-36 | (M3)-19 | (R1)-4 |
| (I-c)-37 | (M3)-26 | (R1)-1 |
| (I-c)-38 | (M3)-26 | (R1)-3 |
| (I-c)-39 | (M4)-3 | (R1)-3 |
| (I-c)-40 | (M4)-3 | (R1)-4 |
| (I-c)-41 | (M4)-8 | (R1)-5 |
| (I-c)-42 | (M4)-8 | (R1)-6 |
| (I-c)-43 | (M4)-12 | (R1)-7 |
| (I-c)-44 | (M4)-12 | (R1)-4 |
| (I-c)-45 | (M4)-12 | (R1)-2 |
| (I-c)-46 | (M4)-12 | (R1)-11 |
| (I-c)-47 | (M4)-16 | (R1)-3 |
| (I-c)-48 | (M4)-16 | (R1)-4 |
| (I-c)-49 | (M4)-20 | (R1)-1 |
| (I-c)-50 | (M4)-20 | (R1)-4 |
| (I-c)-51 | (M4)-20 | (R1)-7 |
| (I-c)-52 | (M4)-24 | (R1)-4 |
| (I-c)-53 | (M4)-24 | (R1)-7 |
| (I-c)-54 | (M4)-24 | (R1)-3 |
| (I-c)-55 | (M4)-24 | (R1)-4 |
| (I-c)-56 | (M4)-25 | (R1)-1 |
| (I-c)-57 | (M4)-26 | (R1)-3 |
| (I-c)-58 | (M4)-28 | (R1)-4 |
| (I-c)-59 | (M4)-28 | (R1)-5 |
| (I-c)-60 | (M4)-28 | (R1)-6 |

Specific Examples of Formula (I) [Formula (I-c)]

| Exemplary compound | Charge transporting skeleton F | Functional group |
|---|---|---|
| (I-c)-61 | (M1)-1 | (R1)-15 |
| (I-c)-62 | (M1)-1 | (R1)-27 |
| (I-c)-63 | (M1)-1 | (R1)-37 |
| (I-c)-64 | (M1)-2 | (R1)-52 |
| (I-c)-65 | (M1)-2 | (R1)-18 |
| (I-c)-66 | (M1)-4 | (R1)-31 |
| (I-c)-67 | (M1)-4 | (R1)-44 |
| (I-c)-68 | (M1)-7 | (R1)-45 |
| (I-c)-69 | (M1)-11 | (R1)-45 |
| (I-c)-70 | (M1)-15 | (R1)-45 |
| (I-c)-71 | (M1)-25 | (R1)-15 |
| (I-c)-72 | (M1)-22 | (R1)-15 |
| (I-c)-73 | (M2)-2 | (R1)-15 |
| (I-c)-74 | (M2)-2 | (R1)-27 |
| (I-c)-75 | (M2)-2 | (R1)-37 |
| (I-c)-76 | (M2)-3 | (R1)-52 |
| (I-c)-77 | (M2)-3 | (R1)-18 |
| (I-c)-78 | (M2)-5 | (R1)-31 |
| (I-c)-79 | (M2)-10 | (R1)-44 |

-continued

| Exemplary compound | Charge transporting skeleton F | Functional group |
|---|---|---|
| (I-c)-80 | (M2)-10 | (R1)-45 |
| (I-c)-81 | (M2)-13 | (R1)-45 |
| (I-c)-82 | (M2)-13 | (R1)-45 |
| (I-c)-83 | (M2)-13 | (R1)-15 |
| (I-c)-84 | (M2)-16 | (R1)-15 |
| (I-c)-85 | (M2)-23 | (R1)-27 |
| (I-c)-86 | (M2)-23 | (R1)-37 |
| (I-c)-87 | (M2)-25 | (R1)-52 |
| (I-c)-88 | (M2)-25 | (R1)-18 |
| (I-c)-89 | (M2)-26 | (R1)-31 |
| (I-c)-90 | (M2)-26 | (R1)-44 |

Specific Examples of Formula (I) [Formula (I-c)]

| Exemplary compound | Charge transporting skeleton F | Functional group |
|---|---|---|
| (I-c)-91 | (M3)-1 | (R1)-15 |
| (I-c)-92 | (M3)-1 | (R1)-27 |
| (I-c)-93 | (M3)-5 | (R1)-37 |
| (I-c)-94 | (M3)-7 | (R1)-52 |
| (I-c)-95 | (M3)-7 | (R1)-18 |
| (I-c)-96 | (M3)-19 | (R1)-31 |
| (I-c)-97 | (M3)-26 | (R1)-44 |
| (I-c)-98 | (M3)-26 | (R1)-45 |
| (I-c)-99 | (M4)-3 | (R1)-45 |
| (I-c)-100 | (M4)-3 | (R1)-45 |
| (I-c)-101 | (M4)-8 | (R1)-15 |
| (I-c)-102 | (M4)-8 | (R1)-15 |
| (I-c)-103 | (M4)-12 | (R1)-15 |
| (I-c)-104 | (M4)-12 | (R1)-27 |
| (I-c)-105 | (M4)-12 | (R1)-37 |
| (I-c)-106 | (M4)-12 | (R1)-52 |
| (I-c)-107 | (M4)-16 | (R1)-18 |
| (I-c)-108 | (M4)-16 | (R1)-31 |
| (I-c)-109 | (M4)-20 | (R1)-44 |
| (I-c)-110 | (M4)-20 | (R1)-45 |
| (I-c)-111 | (M4)-20 | (R1)-45 |
| (I-c)-112 | (M4)-24 | (R1)-45 |
| (I-c)-113 | (M4)-24 | (R1)-15 |
| (I-c)-114 | (M4)-24 | (R1)-15 |
| (I-c)-115 | (M4)-24 | (R1)-27 |
| (I-c)-116 | (M4)-25 | (R1)-37 |
| (I-c)-117 | (M4)-26 | (R1)-52 |
| (I-c)-118 | (M4)-28 | (R1)-18 |
| (I-c)-119 | (M4)-28 | (R1)-31 |
| (I-c)-120 | (M4)-28 | (R1)-44 |

Next, specific examples of the compound represented by the formula (I), specifically the formula (I-d), are shown below.

| Exemplary compound | Charge transporting skeleton F | Functional group |
|---|---|---|
| (I-d)-1 | (M3)-1 | (R2)-2 |
| (I-d)-2 | (M3)-1 | (R2)-7 |
| (I-d)-3 | (M3)-2 | (R2)-2 |
| (I-d)-4 | (M3)-2 | (R2)-4 |
| (I-d)-5 | (M3)-3 | (R2)-2 |
| (I-d)-6 | (M3)-3 | (R2)-4 |
| (I-d)-7 | (M3)-12 | (R2)-1 |
| (I-d)-8 | (M3)-21 | (R2)-3 |
| (I-d)-9 | (M3)-25 | (R2)-3 |
| (I-d)-10 | (M3)-25 | (R2)-4 |
| (I-d)-11 | (M3)-25 | (R2)-5 |
| (I-d)-12 | (M3)-25 | (R2)-6 |
| (I-d)-13 | (M4)-1 | (R2)-7 |
| (I-d)-14 | (M4)-3 | (R2)-4 |

-continued

| Exemplary compound | Charge transporting skeleton F | Functional group |
|---|---|---|
| (I-d)-15 | (M4)-3 | (R2)-2 |
| (I-d)-16 | (M4)-8 | (R2)-1 |
| (I-d)-17 | (M4)-8 | (R2)-3 |
| (I-d)-18 | (M4)-8 | (R2)-4 |
| (I-d)-19 | (M4)-10 | (R2)-1 |
| (I-d)-20 | (M4)-10 | (R2)-4 |
| (I-d)-21 | (M4)-10 | (R2)-7 |
| (I-d)-22 | (M4)-12 | (R2)-4 |
| (I-d)-23 | (M4)-12 | (R2)-1 |
| (I-d)-24 | (M4)-12 | (R2)-3 |
| (I-d)-25 | (M4)-22 | (R2)-4 |
| (I-d)-26 | (M4)-24 | (R2)-1 |
| (I-d)-27 | (M4)-24 | (R2)-3 |
| (I-d)-28 | (M4)-24 | (R2)-4 |
| (I-d)-29 | (M4)-24 | (R2)-5 |
| (I-d)-30 | (M4)-28 | (R2)-6 |

Specific Examples of Formula (I) [Formula (I-d)]

| Exemplary compound | Charge transporting skeleton F | Functional group |
|---|---|---|
| (I-d)-31 | (M3)-1 | (R2)-8 |
| (I-d)-32 | (M3)-1 | (R2)-9 |
| (I-d)-33 | (M3)-2 | (R2)-8 |
| (I-d)-34 | (M3)-2 | (R2)-9 |
| (I-d)-35 | (M3)-3 | (R2)-8 |
| (I-d)-36 | (M3)-3 | (R2)-9 |
| (I-d)-37 | (M3)-12 | (R2)-8 |
| (I-d)-38 | (M3)-12 | (R2)-9 |
| (I-d)-39 | (M4)-12 | (R2)-8 |
| (I-d)-40 | (M4)-12 | (R2)-9 |
| (I-d)-41 | (M4)-12 | (R2)-10 |
| (I-d)-42 | (M4)-24 | (R2)-8 |
| (I-d)-43 | (M4)-24 | (R2)-9 |
| (I-d)-44 | (M4)-24 | (R2)-10 |
| (I-d)-45 | (M4)-28 | (R2)-8 |
| (I-d)-46 | (M4)-28 | (R2)-9 |
| (I-d)-47 | (M4)-28 | (R2)-10 |

Next, specific examples of the compound represented by the formula (II), specifically the formula (II-a), are shown below.

Specific Examples of Formula (II) [Formula (II-a)]

| Exemplary compound | Charge transporting skeleton F | Functional group |
|---|---|---|
| (II)-1 | (M1)-1 | (R3)-1 |
| (II)-2 | (M1)-1 | (R3)-2 |
| (II)-3 | (M1)-1 | (R3)-7 |
| (II)-4 | (M1)-2 | (R3)-1 |
| (II)-5 | (M1)-2 | (R3)-2 |
| (II)-6 | (M1)-2 | (R3)-3 |
| (II)-7 | (M1)-2 | (R3)-5 |
| (II)-8 | (M1)-2 | (R3)-7 |
| (II)-9 | (M1)-2 | (R3)-8 |
| (II)-10 | (M1)-2 | (R3)-10 |
| (II)-11 | (M1)-2 | (R3)-11 |
| (II)-12 | (M1)-4 | (R3)-1 |
| (II)-13 | (M1)-4 | (R3)-2 |
| (II)-14 | (M1)-4 | (R3)-3 |
| (II)-15 | (M1)-4 | (R3)-5 |
| (II)-16 | (M1)-4 | (R3)-7 |
| (II)-17 | (M1)-4 | (R3)-8 |
| (II)-18 | (M1)-8 | (R3)-1 |

-continued

| Exemplary compound | Charge transporting skeleton F | Functional group |
|---|---|---|
| (II)-19 | (M1)-8 | (R3)-2 |
| (II)-20 | (M1)-8 | (R3)-3 |
| (II)-21 | (M1)-8 | (R3)-5 |
| (II)-22 | (M1)-8 | (R3)-7 |
| (II)-23 | (M1)-8 | (R3)-8 |
| (II)-24 | (M1)-11 | (R3)-1 |
| (II)-25 | (M1)-11 | (R3)-3 |
| (II)-26 | (M1)-11 | (R3)-7 |
| (II)-27 | (M1)-11 | (R3)-9 |
| (II)-28 | (M1)-16 | (R3)-4 |
| (II)-29 | (M1)-22 | (R3)-6 |
| (II)-30 | (M1)-22 | (R3)-9 |

Specific Examples of Formula (II) [Formula (II-a)]

| Exemplary compound | Charge transporting skeleton F | Functional group |
|---|---|---|
| (II)-31 | (M2)-2 | (R3)-1 |
| (II)-32 | (M2)-2 | (R3)-3 |
| (II)-33 | (M2)-2 | (R3)-7 |
| (II)-34 | (M2)-2 | (R3)-9 |
| (II)-35 | (M2)-3 | (R3)-1 |
| (II)-36 | (M2)-3 | (R3)-2 |
| (II)-37 | (M2)-3 | (R3)-3 |
| (II)-38 | (M2)-3 | (R3)-7 |
| (II)-39 | (M2)-3 | (R3)-8 |
| (II)-40 | (M2)-5 | (R3)-8 |
| (II)-41 | (M2)-5 | (R3)-10 |
| (II)-42 | (M2)-10 | (R3)-1 |
| (II)-43 | (M2)-10 | (R3)-3 |
| (II)-44 | (M2)-10 | (R3)-7 |
| (II)-45 | (M2)-10 | (R3)-9 |
| (II)-46 | (M2)-13 | (R3)-1 |
| (II)-47 | (M2)-13 | (R3)-2 |
| (II)-48 | (M2)-13 | (R3)-3 |
| (II)-49 | (M2)-13 | (R3)-5 |
| (II)-50 | (M2)-13 | (R3)-7 |
| (II)-51 | (M2)-13 | (R3)-8 |
| (II)-52 | (M2)-16 | (R3)-1 |
| (II)-53 | (M2)-16 | (R3)-7 |
| (II)-54 | (M2)-21 | (R3)-1 |
| (II)-55 | (M2)-21 | (R3)-7 |
| (II)-56 | (M2)-25 | (R3)-1 |
| (II)-57 | (M2)-25 | (R3)-3 |
| (II)-58 | (M2)-25 | (R3)-7 |
| (II)-59 | (M2)-25 | (R3)-8 |
| (II)-60 | (M2)-25 | (R3)-9 |

Specific Examples of Formula (II) [Formula (II-a)]

| Exemplary compound | Charge transporting skeleton F | Functional group |
|---|---|---|
| (II)-61 | (M3)-1 | (R3)-1 |
| (II)-62 | (M3)-1 | (R3)-2 |
| (II)-63 | (M3)-1 | (R3)-7 |
| (II)-64 | (M3)-1 | (R3)-8 |
| (II)-65 | (M3)-3 | (R3)-1 |
| (II)-66 | (M3)-3 | (R3)-7 |
| (II)-67 | (M3)-7 | (R3)-1 |
| (II)-68 | (M3)-7 | (R3)-2 |
| (II)-69 | (M3)-7 | (R3)-7 |
| (II)-70 | (M3)-7 | (R3)-8 |
| (II)-71 | (M3)-18 | (R3)-5 |
| (II)-72 | (M3)-18 | (R3)-12 |
| (II)-73 | (M3)-25 | (R3)-7 |

-continued

| Exemplary compound | Charge transporting skeleton F | Functional group |
|---|---|---|
| (II)-74 | (M3)-25 | (R3)-8 |
| (II)-75 | (M3)-25 | (R3)-5 |
| (II)-76 | (M3)-25 | (R3)-12 |
| (II)-77 | (M4)-2 | (R3)-1 |
| (II)-78 | (M4)-2 | (R3)-7 |
| (II)-79 | (M4)-4 | (R3)-7 |
| (II)-80 | (M4)-4 | (R3)-8 |
| (II)-81 | (M4)-4 | (R3)-5 |
| (II)-82 | (M4)-4 | (R3)-12 |
| (II)-83 | (M4)-7 | (R3)-1 |
| (II)-84 | (M4)-7 | (R3)-2 |
| (II)-85 | (M4)-7 | (R3)-7 |
| (II)-86 | (M4)-7 | (R3)-8 |
| (II)-87 | (M4)-9 | (R3)-7 |
| (II)-88 | (M4)-9 | (R3)-8 |
| (II)-89 | (M4)-9 | (R3)-5 |
| (II)-90 | (M4)-9 | (R3)-12 |

Specific Examples of Formula (II) [Formula (II-a)]

| Exemplary compound | Charge transporting skeleton F | Functional group |
|---|---|---|
| (II)-91 | (M1)-1 | (R3)-13 |
| (II)-92 | (M1)-1 | (R3)-15 |
| (II)-93 | (M1)-1 | (R3)-47 |
| (II)-94 | (M1)-2 | (R3)-13 |
| (II)-95 | (M1)-2 | (R3)-15 |
| (II)-96 | (M1)-2 | (R3)-19 |
| (II)-97 | (M1)-2 | (R3)-21 |
| (II)-98 | (M1)-2 | (R3)-28 |
| (II)-99 | (M1)-2 | (R3)-31 |
| (II)-100 | (M1)-2 | (R3)-33 |
| (II)-101 | (M1)-2 | (R3)-37 |
| (II)-102 | (M1)-2 | (R3)-38 |
| (II)-103 | (M1)-2 | (R3)-43 |
| (II)-104 | (M1)-4 | (R3)-13 |
| (II)-105 | (M1)-4 | (R3)-15 |
| (II)-106 | (M1)-4 | (R3)-43 |
| (II)-107 | (M1)-4 | (R3)-48 |
| (II)-108 | (M1)-8 | (R3)-13 |
| (II)-109 | (M1)-8 | (R3)-15 |
| (II)-110 | (M1)-8 | (R3)-19 |
| (II)-111 | (M1)-8 | (R3)-28 |
| (II)-112 | (M1)-8 | (R3)-31 |
| (II)-113 | (M1)-8 | (R3)-33 |
| (II)-114 | (M1)-11 | (R3)-33 |
| (II)-115 | (M1)-11 | (R3)-33 |
| (II)-116 | (M1)-11 | (R3)-33 |
| (II)-117 | (M1)-11 | (R3)-33 |
| (II)-118 | (M1)-16 | (R3)-13 |
| (II)-119 | (M1)-22 | (R3)-15 |
| (II)-120 | (M1)-22 | (R3)-47 |

Specific Examples of Formula (II) [Formula (II-a)]

| Exemplary compound | Charge transporting skeleton F | Functional group |
|---|---|---|
| (II)-121 | (M2)-2 | (R3)-13 |
| (II)-122 | (M2)-2 | (R3)-15 |
| (II)-123 | (M2)-2 | (R3)-14 |
| (II)-124 | (M2)-2 | (R3)-17 |
| (II)-125 | (M2)-3 | (R3)-15 |
| (II)-126 | (M2)-3 | (R3)-19 |
| (II)-127 | (M2)-3 | (R3)-21 |
| (II)-128 | (M2)-3 | (R3)-28 |

-continued

| Exemplary compound | Charge transporting skeleton F | Functional group |
|---|---|---|
| (II)-129 | (M2)-3 | (R3)-31 |
| (II)-130 | (M2)-5 | (R3)-33 |
| (II)-131 | (M2)-5 | (R3)-37 |
| (II)-132 | (M2)-10 | (R3)-38 |
| (II)-133 | (M2)-10 | (R3)-43 |
| (II)-134 | (M2)-10 | (R3)-13 |
| (II)-135 | (M2)-10 | (R3)-15 |
| (II)-136 | (M2)-13 | (R3)-16 |
| (II)-137 | (M2)-13 | (R3)-48 |
| (II)-138 | (M2)-13 | (R3)-13 |
| (II)-139 | (M2)-13 | (R3)-26 |
| (II)-140 | (M2)-13 | (R3)-19 |
| (II)-141 | (M2)-13 | (R3)-28 |
| (II)-142 | (M2)-16 | (R3)-31 |
| (II)-143 | (M2)-16 | (R3)-33 |
| (II)-144 | (M2)-21 | (R3)-33 |
| (II)-145 | (M2)-21 | (R3)-34 |
| (II)-146 | (M2)-25 | (R3)-35 |
| (II)-147 | (M2)-25 | (R3)-36 |
| (II)-148 | (M2)-25 | (R3)-37 |
| (II)-149 | (M2)-25 | (R3)-15 |
| (II)-150 | (M2)-25 | (R3)-47 |
| (II)-151 | (M3)-1 | (R3)-13 |
| (II)-152 | (M3)-1 | (R3)-15 |
| (II)-153 | (M3)-1 | (R3)-14 |
| (II)-154 | (M3)-1 | (R3)-17 |
| (II)-155 | (M3)-3 | (R3)-15 |
| (II)-156 | (M3)-3 | (R3)-19 |
| (II)-157 | (M3)-7 | (R3)-21 |
| (II)-158 | (M3)-7 | (R3)-28 |
| (II)-159 | (M3)-7 | (R3)-31 |
| (II)-160 | (M3)-7 | (R3)-33 |

Specific Examples of Formula (II) [Formula (II-a)]

| Exemplary compound | Charge transportin g skeleton F | Functional group |
|---|---|---|
| (II)-161 | (M3)-18 | (R3)-37 |
| (II)-162 | (M3)-18 | (R3)-38 |
| (II)-163 | (M3)-25 | (R3)-43 |
| (II)-164 | (M3)-25 | (R3)-13 |
| (II)-165 | (M3)-25 | (R3)-15 |
| (II)-166 | (M3)-25 | (R3)-16 |
| (II)-167 | (M4)-2 | (R3)-48 |
| (II)-168 | (M4)-2 | (R3)-13 |
| (II)-169 | (M4)-4 | (R3)-26 |
| (II)-170 | (M4)-4 | (R3)-19 |
| (II)-171 | (M4)-4 | (R3)-28 |
| (II)-172 | (M4)-4 | (R3)-31 |
| (II)-173 | (M4)-7 | (R3)-32 |
| (II)-174 | (M4)-7 | (R3)-33 |
| (II)-175 | (M4)-7 | (R3)-34 |
| (II)-176 | (M4)-7 | (R3)-35 |
| (II)-177 | (M4)-9 | (R3)-36 |
| (II)-178 | (M4)-9 | (R3)-37 |
| (II)-179 | (M4)-9 | (R3)-15 |
| (II)-180 | (M4)-9 | (R3)-47 |
| (II)-181 | (M2)-27 | (R4)-1 |
| (II)-182 | (M2)-27 | (R4)-4 |
| (II)-183 | (M2)-27 | (R3)-7 |

The specific reactive group-containing charge transporting material (in particular, the reactive compound represented by the formula (I)) is synthesized in the following manner, for example.

That is, the specific reactive group-containing charge transporting material is synthesized by, for example, etherification of a carboxylic acid or an alcohol as a precursor with corresponding chloromethylstyrene or the like.

As an example, the synthesis route for the exemplary compound (I-d)-22 of the specific reactive group-containing charge transporting material is shown below.

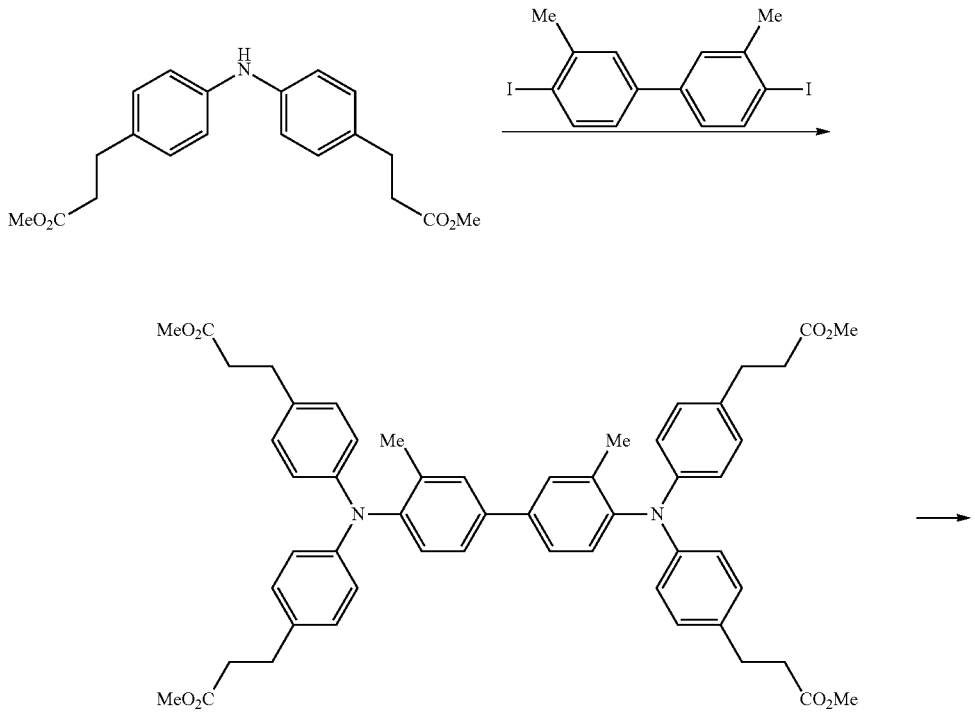

-continued

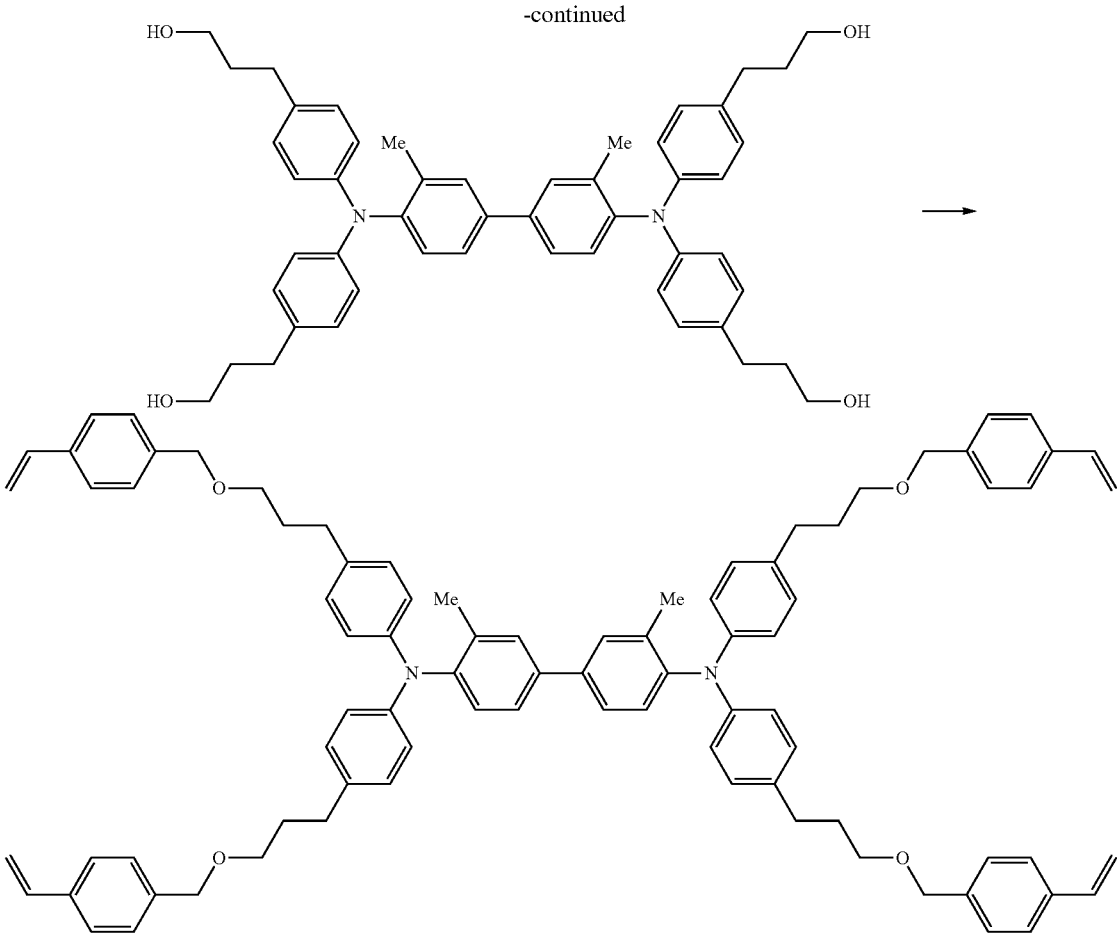

A carboxylic acid of an arylamine compound is obtained by subjecting an ester group the arylamine compound to hydrolysis using, for example, a basic catalyst (NaOH, $K_2$—$CO_3$, and the like) and an acidic catalyst (for example, phosphoric acid, sulfuric acid, and the like) as described in Experimental Chemistry Lecture, $4^{th}$ Ed., Vol. 20, p. 51, or the like.

Here, examples of the solvent include various types of the solvents, and an alcohol solvent such as methanol, ethanol, and ethylene glycol, or a mixture thereof with water may be preferably used.

Incidentally, in the case where the solubility of the arylamine compound is low, methylene chloride, chloroform, toluene, dimethylsulfoxide, ether, tetrahydrofuran, or the like may be added.

The amount of the solvent is not particularly limited, but it may be, for example, from 1 part by weight to 100 parts by weight, and preferably from 2 parts by weight to 50 parts by weight, based on 1 part by weight of the ester group-containing arylamine compound.

The reaction temperature is set to be, for example, in a range of room temperature (for example, 25° C.) to the boiling point of the solvent, and in terms of the reaction rate, preferably 50° C. or higher.

The amount of the catalyst is not particularly limited, and may be, for example, from 0.001 part by weight to 1 part by weight, and preferably from 0.01 part by weight to 0.5 part by weight, based on 1 part by weight of the ester group-containing arylamine compound.

After the hydrolysis reaction, in the case where the hydrolysis is carried out with a basic catalyst, the produced salt is neutralized with an acid (for example, hydrochloric acid) to be free. Further, after sufficiently washing with water, the product is dried and used, or may be, if necessary, purified by recrystallization with a suitable solvent such as methanol, ethanol, toluene, ethyl acetate, and acetone, and then dried and used.

Furthermore, the alcohol form of the arylamine compound is synthesized by reducing an ester group of the arylamine compound to a corresponding alcohol using aluminum lithium hydride, sodium borohydride, or the like as described in, for example, Experimental Chemistry Lecture, $4^{th}$ Ed., Vol. 20, P. 10, or the like.

For example, in the case of introducing a reactive group with an ester bond, ordinary esterification in which a carboxylic acid of an arylamine compound and hydroxymethylstyrene are dehydrated and condensed using an acid catalyst, or a method in which a carboxylic acid of an arylamine compound and halogenated methylstyrene are condensed using a base such as pyridine, piperidine, triethylamine, dimethylaminopyridine, trimethylamine, DBU, sodium hydride, sodium hydroxide, and potassium hydroxide may be used, but the method using halogenated methylstyrene is suitable since it inhibits by-products.

The halogenated methylstyrene may be added in an amount of 1 equivalent or more, preferably 1.2 equivalents or more, and more preferably 1.5 equivalents or more, based on the acid of the carboxylic acid of the arylamine compound, and the base may be added in an amount of from 0.8 equivalents to 2.0 equivalents, and preferably from 1.0 equivalent to 1.5 equivalents, based on the halogenated methylstyrene.

As the solvent, an aprotic polar solvent such as N-methylpyrrolidone, dimethylsulfoxide, and N,N-dimethylformamide; a ketone solvent such as acetone and methyl ethyl ketone; an ether solvent such as diethyl ether and tetrahydrofuran; an aromatic solvent such as toluene, chlorobenzene, and 1-chloronaphthalene; and the like are effective, and the solvent may be used in an amount in the range of from 1 part by weight to 100 parts by weight, and preferably from 2 parts by weight to 50 parts by weight, based on 1 part by weight of the carboxylic acid of the arylamine compound.

The reaction temperature is not particularly limited. After completion of the reaction, the reaction liquid is poured into water, extracted with a solvent such as toluene, hexane, and ethyl acetate, washed with water, and if necessary, purified using an adsorbent such as activated carbon, silica gel, porous alumina, and activated white clay.

Furthermore, in the case of introduction with an ether bond, a method in which an alcohol of an arylamine compound and a halogenated methylstyrene are condensed using a base such as pyridine, piperidine, triethylamine, dimethylaminopyridine, trimethylamine, DBU, sodium hydride, sodium hydroxide, and potassium hydroxide may be preferably used.

The halogenated methylstyrene may be used in an amount of 1 equivalent or more, preferably 1.2 equivalents or more, and more preferably 1.5 equivalents or more, based on the alcohol of the alcohol of the arylamine compound, and the base may be used in an amount of from 0.8 equivalents to 2.0 equivalents, and preferably from 1.0 equivalents to 1.5 equivalents, based on the halogenated methylstyrene.

As the solvent, an aprotic polar solvent such as N-methylpyrrolidone, dimethylsulfoxide, and N,N-dimethylformamide; a ketone solvent such as acetone and methyl ethyl ketone; an ether solvent such as diethyl ether and tetrahydrofuran; an aromatic solvent such as toluene, chlorobenzene, and 1-chloronaphthalene; and the like are effective, and the solvent may be used in an amount in the range of from 1 part by weight to 100 parts by weight, and preferably from 2 parts by weight to 50 parts by weight, based on 1 part by weight of the alcohol of the arylamine compound.

The reaction temperature is not particularly limited. After completion of the reaction, the reaction liquid is poured into water, extracted with a solvent such as toluene, hexane, and ethyl acetate, washed with water, and if necessary, purification may be carried out using an adsorbent such as activated carbon, silica gel, porous alumina, and activated white clay.

The specific reactive group-containing charge transporting material (in particular, the reactive compound represented by the formula (II)) is synthesized, using, for example, an ordinary method for synthesizing a charge transporting material as shown below (formylation, esterification, etherification, or hydrogenation).

Formylation: a reaction which is suitable for introducing a formyl group into an electron donating group-containing aromatic compound, heterocyclic compound, and alkene. DMF and phosphorous oxytrichloride are generally used and the reaction is commonly carried out at a reaction temperature from room temperature (for example, 25° C.) to 100° C.

Esterification: A condensation reaction of an organic acid with a hydroxyl group-containing compound such as an alcohol or a phenol. A method in which a dehydrating agent is coexistent or water is removed from the system to move the equilibrium toward the ester side is preferably used.

Etherification: A Williamson synthesis method in which an alkoxide and an organic halogen compound are condensed is general.

Hydrogenation: A method in which hydrogen is reacted with an unsaturated bond using various catalysts.

The content of the specific reactive group-containing charge transporting material is, for example, from 40% by weight to 95% by weight, and preferably from 50% by weight to 95% by weight, based on the total solid content of the composition for forming a layer.

Specific Inorganic Particles

The specific inorganic particles are inorganic particles having polymerizable groups (that is, inorganic particles having polymerizable groups introduced to the surface). Specific examples of the specific inorganic particles include inorganic particles that are surface-treated with a surface treating agent having a polymerizable group.

For the specific inorganic particles, suitable examples of the inorganic particles before introducing a polymerizable group into the surface include metal oxide particles.

Examples of the metal oxide particles include particles of magnesium oxide, zinc oxide, lead oxide, aluminum oxide (alumina), silicon oxide (silica), tantalum oxide, indium oxide, bismuth oxide, yttrium oxide, cobalt oxide, copper oxide, manganese oxide, selenium oxide, iron oxide, zirconium oxide, germanium oxide, tin oxide, titanium oxide, niobium oxide, molybdenum oxide, vanadium oxide, or the like.

Among these, from the viewpoints of suppression of the generation of scratches on a protective layer (outermost surface layer) and the decrease in the electrical characteristics due to repeated use, as the metal oxide particles, particles of silicon oxide (silica), aluminum oxide (alumina), or titanium oxide are preferable, particles of silicon oxide (silica) or aluminum oxide (alumina) are more preferable, and silicon oxide (silica) is even more preferable.

Furthermore, examples of the particles of silicon oxide (silica) include particles of dry type silica (for example, fumed silica), and wet type silica (for example, colloidal silica), but among these, from the viewpoint of inhibition of the generation of scratches on a protective layer (outermost surface layer) and the decrease in the electrical characteristics due to repeated use, particles of dry type silica (for example, fumed silica) are preferred.

That is, the specific inorganic particles are preferably at least one selected from silica particles having polymerizable groups and alumina particles having polymerizable groups, and dry type silica particles having polymerizable groups are more preferable.

For the specific inorganic particles, examples of the surface treating agent include compounds having polymerizable groups and surface treating groups.

The polymerizable group is preferably, for example, a functional group capable of radical polymerization, and examples thereof include functional groups having groups containing at least carbon double bonds. Specific examples of the polymerizable group include a functional group containing at least one selected from a vinyl group, a propenyl group, a vinyl ether group, a vinyl thioether group, an allyl ether group, an acryloyl group, a methacryloyl group, a styryl group, and a derivative thereof.

Among these, as the polymerizable group, from the viewpoint of being excellent in the reactivity, a functional group containing at least one selected from a vinyl group, a styryl group, an acryloyl group, a methacryloyl group, and a derivative thereof is preferable, and a functional group containing at least one selected from an acryloyl group, a methacryloyl group, and a styryl group is more preferable.

Meanwhile, suitable examples of the surface treating group include a silyl group, in particular, a silyl group having hydrolyzability.

Examples of the silyl group having hydrolyzability include a carboxylate silyl group (for example, an alkoxysilyl group and an acetoxysilyl group), a halogenated silyl group (for example, a chlorosilyl group), an aminosilyl group, an oximesilyl group, and a hydrido silyl group.

Among these, as the silyl group having hydrolyzability, from the viewpoint of the reactivity, an alkoxysilyl group is preferable.

Other examples of the silyl group having hydrolyzability include a functional group that forms a silanol group in the reaction with water. Among these, an alkoxysilyl group is preferable.

That is, the specific inorganic particles are preferably inorganic particles which are surface-treated with a hydrolyzable silane compound having a polymerizable group (a polymerizable compound having a hydrolyzable silyl group) as a surface treating agent.

In order to treat the surface of the inorganic particles with a hydrolyzable silane compound having a polymerizable group (surface treating agent), for example, the inorganic particles are mixed with a hydrolyzable silane compound in a solvent including water, and the mixture is stirred. At this time, an acid, a base, or other catalysts may be added to the solvent, if necessary.

The treatment amount of the surface treating agent (for example, a hydrolyzable silane compound having a polymerizable group) varies depending on the specific surface area of the inorganic particles or the minimum area to be coated of a hydrolyzable silane compound (surface treating agent), but it may be, for example, from 0.1% by weight to 50% by weight, preferably 0.2% by weight to 30% by weight, and more preferably 0.5% by weight to 20% by weight, based on the inorganic particles.

As a result that the treatment amount of the surface treating agent which is set within the above-described ranges, a decrease in the mechanical strength of a protective layer (outermost surface layer) or the deterioration of electrical characteristics is inhibited after enhancing the bonding of the reactive group-containing charge transporting material with the specific inorganic particles, and as a result, the generation of scratches on a protective layer (outermost surface layer) and the decrease in the electrical characteristics due to repeated use are easily inhibited.

Specific example of the surface treating agent (for example, hydrolyzable silane compounds having polymerizable groups) include compounds described in, for example, paragraphs [0072] and [0075] of JP-A-2004-258345, the compounds described in paragraphs [0075] through [0076] of JP-A-2010-169725, and the compounds as listed below.

SS-1

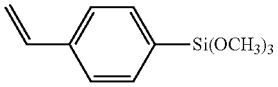

-continued

SS-2

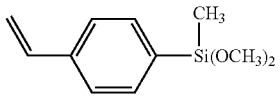

SS-3

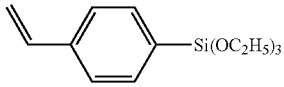

SS-4

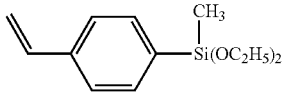

SS-5

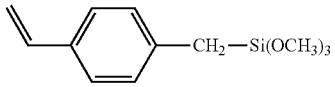

SS-6

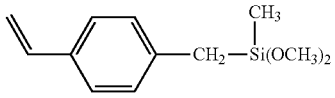

SS-7

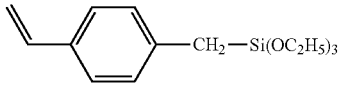

SS-8

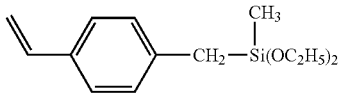

SS-9

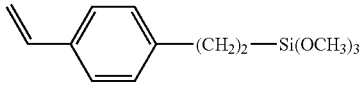

SS-10

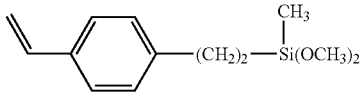

SS-11

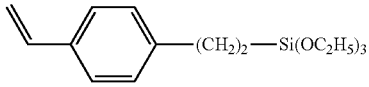

SS-12

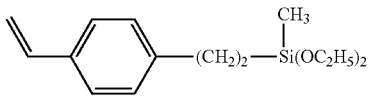

SS-13

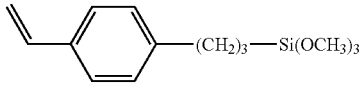

SS-14

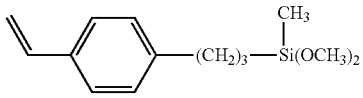

SS-15

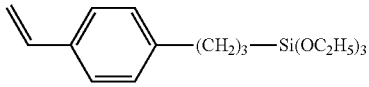

SS-16

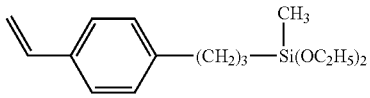

-continued

SS-17

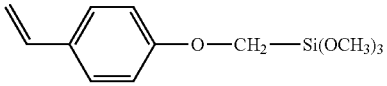

SS-18

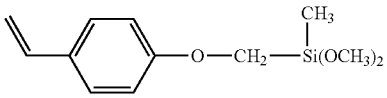

SS-19

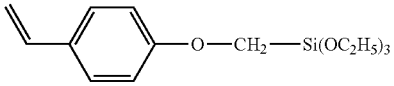

SS-20

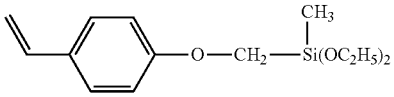

SS-21

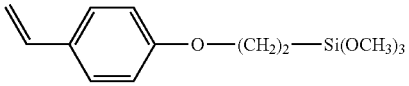

SS-22

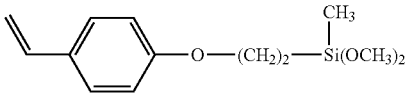

SS-23

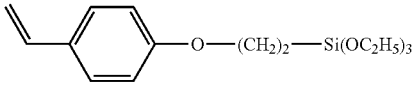

SS-24

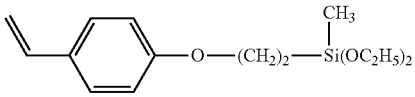

SS-25

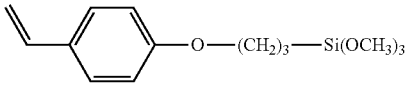

SS-26

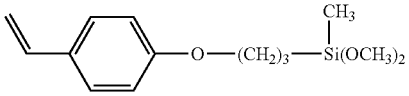

SS-27

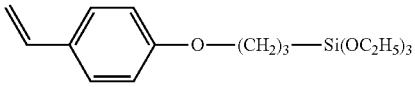

SS-28

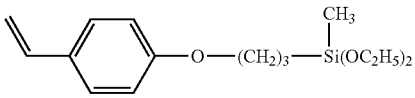

SS-29

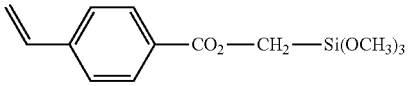

SS-30

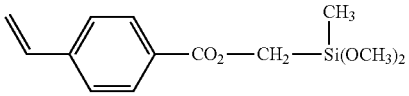

SS-31

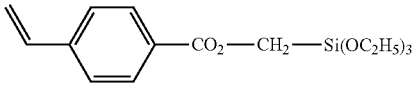

-continued

SS-32

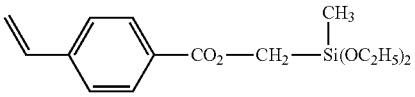

SS-33

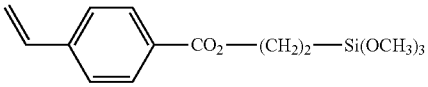

SS-34

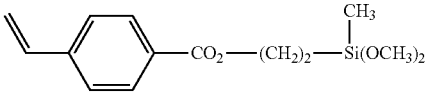

SS-35

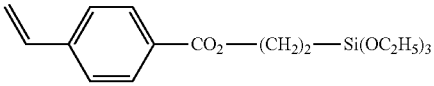

SS-36

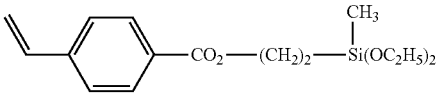

SS-37

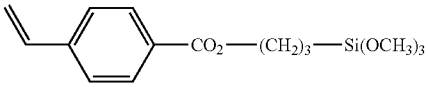

SS-38

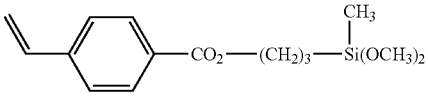

SS-39

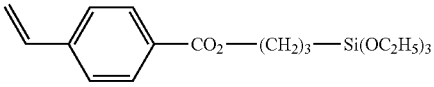

SS-40

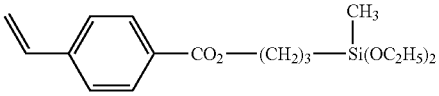

The number-average primary particle diameter of the specific inorganic particles may be, for example, from 10 nm to 500 nm, preferably from 10 nm to 200 nm, and more preferably from 15 nm to 100 nm.

Here, the number-average primary particle diameter of the specific inorganic particles is a value obtained by observing 100 particles randomly taken as the primary particles by 1000-fold magnification with a transmission electron microscope, and measuring the diameters in terms of number-average diameters of Feret's diameter by image-wise analysis.

The content of the specific inorganic particles may be, from 0.3% by weight to 60% by weight, preferably 0.5% by weight to 50% by weight, and more preferably 1% by weight to 40% by weight, based on the total solid contents of the composition for forming a layer. Further, this value is a value calculated in terms of the weight of the inorganic particles having no polymerizable group introduced thereinto.

Compound Having Unsaturated Bond

The film constituting the protective layer (outermost surface layer) may use a compound having an unsaturated bond in combination.

The compound having an unsaturated bond may be any one of a monomer, an oligomer, and a polymer, and may further have a charge transporting skeleton.

Examples of the compound having an unsaturated bond, which has no charge transporting skeleton, include the following compounds.

Examples of the monofunctional monomers include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyacrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl-o-phenylphenol acrylate, o-phenylphenol glycidyl ether acrylate, and styrene.

Examples of the difunctional monomers include diethylene glycol di(meth)acrylate, polyethylene glycol di(meth) acrylate, polypropylene glycol di(meth)acrylate, neopentyl glycol di(meth)acrylate, 1,6-hexanediol di(meth)acrylate, divinylbenzene, and diallyl phthalate.

Examples of the trifunctional monomers include trimethylol propane tri(meth)acrylate, pentaerythritol tri(meth)acrylate, aliphatic tri(meth)acrylate, and trivinylcyclohexane.

Examples of the tetrafunctional monomers include pentaerythritol tetra(meth)acrylate, ditrimethylol propane tetra (meth)acrylate, and aliphatic tetra(meth)acrylate.

As the pentafunctional or higher functional monomers, for example, (meth)acrylates having a polyester skeleton, a urethane skeleton, and a phosphagen skeleton are exemplified, in addition to dipentaerythritol penta(meth)acrylate, and dipentaerythritol hexa(meth)acrylate.

Furthermore, examples of the reactive polymer include those disclosed in, for example, JP-A-5-216249, JP-A-5-323630, JP-A-11-52603, JP-A-2000-264961, and JP-A-2005-2291.

In the case where a compound has an unsaturated bond, which has no charge transporting component, it is used singly or in a mixture of two or more kinds thereof.

The content of the compound having an unsaturated bond, which has no charge transporting component, may be 60% by weight or less, preferably 55% by weight or less, and more preferably 50% by weight or less, based on the total solid content of the composition used to form the protective layer (outermost surface layer).

Meanwhile, examples of the compound having an unsaturated bond, which has a charge transporting skeleton, include the following compounds.

Compound Having Polymerizable Functional Group (Polymerizable Functional Group Other than Styryl Group) and Charge Transporting Skeleton in the Same Molecule The polymerizable functional group in the compound having a polymerizable functional group and a charge transporting skeleton in the same molecule is not particularly limited as long as it is a functional group that is capable of radical polymerization, and it is, for example, a functional group having a group containing at least carbon double bonds. Specific examples thereof include a group containing at least one selected from a vinyl group, a vinyl ether group, a vinyl thioether group, a styryl group, an acryloyl group, a methacryloyl group, and derivatives thereof. Among these, in terms of high reactivity, the polymerizable functional group is preferably a group containing at least one selected from a vinyl group, a styryl group, an acryloyl group, a methacryloyl group, and derivatives thereof.

Furthermore, the charge transporting skeleton in the compound having a polymerizable functional group and a charge transporting skeleton in the same molecule is not particularly limited as long as it has a structure known in electrophotographic photoreceptor, and it is, for example, a skeleton derived from a nitrogen-containing hole transporting compound such as a triarylamine compound, a benzidine compound, and a hydrazone compound, it includes structures having conjugation with nitrogen atoms. Among these, a triarylamine skeleton is preferable.

Non-Reactive Charge Transporting Material

For the film constituting the protective layer (outermost surface layer), a non-reactive charge transporting material may be used in combination. The non-reactive charge transporting material has no reactive group which is not in charge of charge transportation, and accordingly, in the case where the non-reactive charge transporting material is used in the protective layer (outermost surface layer), the concentration of the charge transporting component increases, which is thus effective for further improvement of electrical characteristics. In addition, the non-reactive charge transporting material may be added to reduce the crosslinking density, and thus adjust the strength.

As the non-reactive charge transporting material, a known charge transporting material may be used, and specifically, a triarylamine compound, a benzidine compound, an arylalkane compound, an aryl-substituted ethylene compound, a stilbene compound, an anthracene compound, a hydrazone compound, or the like is used.

Among these, from the viewpoint of charge mobility, compatibility, or the like, it is preferable to have a triphenylamine skeleton.

The amount of the non-reactive charge transporting material used is preferably from 0% by weight to 30% by weight, more preferably from 1% by weight to 25% by weight, and even more preferably from 5% by weight to 25% by weight, based on the total solid content in a coating liquid for forming a layer.

Other Additives

The film constituting the protective layer (outermost surface layer) may be used in a mixture with other coupling agents, particularly, fluorine-containing coupling agents for the purpose of further adjusting film formability, flexibility, lubricating property, and adhesiveness. As these compounds, various silane coupling agents and commercially available silicone hard coat agents are used. In addition, a radically polymerizable group-containing silicon compound or a fluorine-containing compound may be used.

Examples of the silane coupling agent include vinyltrichlorosilane, vinyltrimethoxysilane, vinyltriethoxysilane, 3-glycidoxypropylmethyldiethoxysilane, 3-glycidoxypropyltriethoxysilane, 3-glycidoxypropyltrimethoxysilane, 3-aminopropyltriethoxysilane, 3-aminopropyltrimethoxysilane, 3-aminopropylmethyldimethoxysilane, N-2(aminoethyl)-3-aminopropyltriethoxysilane, tetramethoxysilane, methyltrimethoxysilane, and dimethyldimethoxysilane.

Examples of the commercially available hard coat agent include KP-85, X-40-9740, and X-8239 (all manufactured by Shin-Etsu Chemical Co., Ltd.), and AY42-440, AY42-441, and AY49-208 (all manufactured by Dow Corning Toray Co., Ltd.).

In addition, in order to impart water repellency, a fluorine-containing compound such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane may be added.

The silane coupling agent may be used in an arbitrary amount, but the amount of the fluorine-containing compound is preferably 0.25 time or less by weight, based on the compound containing no fluorine, from the viewpoint of the film formability of the crosslinked film. In addition, a reactive fluorine compound disclosed in JP-A-2001-166510 or the like may be mixed.

Examples of the radically polymerizable group-containing silicon compound and fluorine-containing compound include the compounds described in JP-A-2007-11005.

A deterioration inhibitor is preferably added to the film constituting the protective layer (outermost surface layer). Preferable examples of the deterioration inhibitor include hindered phenol deterioration inhibitors or hindered amine deterioration inhibitors, and known antioxidants such as organic sulfur antioxidants, phosphite antioxidants, dithiocarbamate antioxidants, thiourea antioxidants, benz imidazole antioxidants, and the like may be used.

The amount of the deterioration inhibitor to be added is preferably 20% by weight or less, and more preferably 10% by weight or less.

Examples of the hindered phenol antioxidant include IRGANOX 1076, IRGANOX 1010, IRGANOX 1098, IRGANOX 245, IRGANOX 1330, and IRGANOX 3114 (all manufactured by Ciba Japan), and 3,5-di-t-butyl-4-hydroxybiphenyl.

Examples of the hindered amine antioxidants include SANOL LS2626, SANOL LS765, SANOL LS770, and SANOL LS744 (all manufactured by Sankyo Lifetech Co., Ltd.), TINUVIN 144 and TINUVIN 622LD (both manufactured by Ciba Japan), and MARK LA57, MARK LA67, MARK LA62, MARK LA68, and MARK LA63 (all manufactured by Adeka Corporation); examples of the thioether antioxidants include SUMILIZER TPS and SUMILIZER TP-D (all manufactured by Sumitomo Chemical Co., Ltd.); and examples of the phosphite antioxidants include MARK 2112, MARK PEP-8, MARK PEP-24G, MARK PEP-36, MARK 329K, and MARK HP-10 (all manufactured by Adeka Corporation).

Conductive particles, organic particles, or inorganic particles may be added to the film constituting the protective layer (outermost surface layer). However, the inorganic particles are particles having no polymerizable group introduced therein.

Examples of the particles include silicon-containing particles. The silicon-containing particles refer to particles which include silicon as a constitutional element, and specific examples thereof include colloidal silica and silicone particles. The colloidal silica used as the silicon-containing particles is selected from silica having an average particle diameter of preferably from 1 nm to 100 nm, and more preferably from 10 nm to 30 nm, and dispersed in an acidic or alkaline aqueous dispersion or in an organic solvent such as an alcohol, a ketone, and an ester. As the particles, commercially available ones may be used.

The solid content of the colloidal silica in the protective layer is not particularly limited, but it is used in an amount in the range of 0.1% by weight to 20% by weight, and preferably from 0.1% by weight to 15% by weight, based on the total solid content of the protective layer.

The silicone particles used as the silicon-containing particles are selected from silicone resin particles, silicone rubber particles, and treated silica particles whose surfaces have been treated with silicone, and commercially available silicone particles may be used.

These silicone particles are spherical, and the average particle diameter is preferably from 1 nm to 500 nm, and more preferably from 10 nm to 100 nm.

The content of the silicone particles in the surface layer is preferably from 0.1% by weight to 30% by weight, and more preferably from 0.5% by weight to 10% by weight, based on the total amount of the total solid content of the protective layer.

In addition, examples of other particles include fluorinated particles such as ethylene tetrafluoride, ethylene trifluoride, propylene hexafluoride, vinyl fluoride, and vinylidene fluoride, particles including resins formed by the copolymerization of fluorine resins and monomers having hydroxyl groups, semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO. Further, various known dispersion materials may be used to disperse the particles.

Oils such as a silicone oil may be added to the film constituting the protective layer (outermost surface layer).

Examples of the silicone oil include silicone oils such as dimethylpolysiloxane, diphenylpolysiloxane, and phenylmethylsiloxane; reactive silicone oils such as amino-modified polysiloxane, epoxy-modified polysiloxane, carboxylic-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

In order to improve the wettablility of the coated film, a silicone-containing oligomer, a fluorine-containing acryl polymer, a silicone-containing polymer, or the like may be added to the film constituting the protective layer (outermost surface layer).

A metal, carbon black, or the like may be added to the film constituting the protective layer (outermost surface layer). Examples of the metal include aluminum, zinc, copper, chromium, nickel, silver and stainless steel, or resin particles having these metals deposited on the surface thereof.

These may be used singly or in combination of two or more kinds thereof. When two or more kinds are used in combination, they may be simply mixed, or mixed into a solid solution or a fusion. The average particle diameter of the conductive particles is 0.3 μm or less, and particularly preferably 0.1 μm or less.

Composition

The composition used to form a protective layer is preferably prepared as a coating liquid for forming a protective layer, including the respective components dissolved or dispersed in the solvent.

The coating liquid for forming a protective layer may be solvent-free, or may be, if necessary, prepared with a singular solvent or a mixed solvent of aromatic hydrocarbons such as toluene, xylene, and chlorobenzene; alcohols such as methanol, ethanol, propanol, butanol, cyclopentanol, and cyclohexanol; ketones such as acetone, methyl ethyl ketone, and methyl isobutyl ketone; ethers such as tetrahydrofuran, diethyl ether, diisopropyl ether, and dioxane; and esters such as ethyl acetate, n-propyl acetate, n-butyl acetate, and ethyl lactate.

Furthermore, when the above-described components are reacted with each other to obtain a coating liquid for forming a protective layer, the respective components may be simply mixed and dissolved, but alternatively, the components may be preferably warmed under the conditions of a temperature of from room temperature (20° C.) to 100° C., and more preferably from 30° C. to 80° C., and a time of preferably from 10 minutes to 100 hours, and more preferably from 1 hour to 50 hours. Further, it is also preferable to radiate ultrasonic waves.

Formation of Protective Layer

The protective layer-forming coating liquid is applied to a surface to be coated (charge transporting layer) through a general method such as a blade coating method, a wire bar coating method, a spray coating method, a dipping coating method, a bead coating method, an air knife coating method, a curtain coating method, or an inkjet coating method.

Thereafter, radical polymerization is carried out by applying light, electron beams, or heat to the obtained coating film to cure the coating film.

Heat, light, radiation, and the like are used in the curing method. When the coating film is cured by heat and light, a polymerization initiator is not necessarily needed, but a photocuring catalyst or a thermal polymerization initiator may be used. As the photocuring catalyst and the thermal polymerization initiator, known photocuring catalysts and thermal polymerization initiators are used. Electron beams are preferable as the radiation.

Electron Beam Curing

When using electron beams, the acceleration voltage is preferably 300 KV or less, and optimally 150 KV or less. In addition, the radiation dose is in the range of preferably from 1 Mrad to 100 Mrad, and more preferably from 3 Mrad to 50 Mrad. When the acceleration voltage is set to 300 KV or less, the damage of the electron beam irradiation on the photoreceptor characteristics is suppressed. When the radiation dose is set to 1 Mrad or greater, the cross-linking is sufficiently carried out, whereas when the radiation dose is set to 100 Mrad or less, the deterioration of the photoreceptor is suppressed.

The irradiation is performed under an inert gas atmosphere of nitrogen, argon, or the like at an oxygen concentration of 1000 ppm or less, and preferably 500 ppm or less, and heating may be performed at from 50° C. to 150° C. during or after irradiation.

Photocuring

As a light source, a high-pressure mercury lamp, a low-pressure mercury lamp, a metal halide lamp, or the like is used, and a filter such as a band pass filter may be used to select a preferable wavelength. The irradiation time and the light intensity are freely selected, but, for example, the illumination (365 nm) is preferably from 300 mW/cm$^2$ to 1000 mW/cm$^2$, and for example, in the case of irradiation with UV light at 600 mW/cm$^2$, irradiation may be performed for from 5 seconds to 360 seconds.

The irradiation is performed under an inert gas atmosphere of nitrogen, argon, or the like at an oxygen concentration of preferably 1000 ppm or less, and more preferably 500 ppm or less, and heating may be performed at from 50° C. to 150° C. during or after irradiation.

Examples of the photocuring catalyst of intramolecular cleavage type include benzyl ketal photocuring catalysts, alkylphenone photocuring catalysts, aminoalkylphenone photocuring catalysts, phosphine oxide photocuring catalysts, titanocene photocuring catalysts, and oxime photocuring catalysts.

Specifically, examples of the benzyl ketal photocuring catalysts include 2,2-dimethoxy-1,2-diphenylethan-1-one.

Examples of the alkylphenone photocuring catalysts include 1-hydroxy-cyclohexyl-phenyl-ketone, 2-hydroxy-2-methyl-1-phenyl-propan-1-one, 1-[4-(2-hydroxyethoxy)-phenyl]-2-hydroxy-2-methyl-1-propan-1-one, 2-hydroxy-1-{4-[4-(2-hydroxy-2-methyl-propionyl)-benzyl]phenyl}-2-methyl-propan-1-one, acetophenone, and 2-phenyl-2-(p-toluenesulfonyloxy)acetophenone.

Examples of the aminoalkylphenone photocuring catalysts include p-dimethylaminoacetophenone, p-dimethylaminopropiophenone, 2-methyl-1-(4-methylthiophenyl)-2-morpholinopropan-1-one, and 2-benzyl-2-dimethylamino-1-(4-morpholinophenyl)-butanone-1,2-(dimethylamino)-2-[(4-methylphenyl)methyl]-1-[4-(4-morpholinyl)phenyl]-1-butanone.

Examples of the phosphine oxide photocuring catalysts include 2,4,6-trimethylbenzoyl-diphenyl-phosphine oxide and bis(2,4,6-trimethylbenzoyl)-phenyl phosphine oxide.

Examples of the titanocene photocuring catalysts include bis(η5-2,4-cyclopentadien-1-yl)-bis(2,6-difluoro-3-(1H-pyrrol-1-yl)-phenyl)titanium.

Examples of the oxime photocuring catalysts include 1,2-octanedione,1-[4-(phenylthio)-,2-(O-benzoyloxime)] and ethanone, 1-[9-ethyl-6-(2-methylbenzoyl)-9H-carbazol-3-yl]-,1-(O-acetyloxime).

Examples of the hydrogen abstraction photocuring catalyst include benzophenone photocuring catalysts, thioxanthone photocuring catalysts, benzyl photocuring catalysts, and Michler's ketone photocuring catalysts.

Specifically, examples of the benzophenone photocuring catalysts include 2-benzoyl benzoic acid, 2-chlorobenzophenone, 4,4'-dichlorobenzophenone, 4-benzoyl-4'-methyl-diphenylsulfide, and p,p'-bisdiethylaminobenzophenone.

Examples of the thioxanthone photocuring catalysts include 2,4-diethylthioxanthen-9-one, 2-chlorothioxanthone, and 2-isopropylthioxanthone.

Examples of the benzyl photocuring catalysts include benzyl, (±)-camphorquinone, and p-anisyl.

These photocuring catalysts are used singly, or in combination of two or more kinds thereof.

Thermal Curing

Examples of the thermal polymerization initiator include thermal radical generating agents or derivatives thereof, and specific examples thereof include azo initiators such as V-30, V-40, V-59, V-601, V-65, V-70, VF-096, VE-073, Vam-110, and Vam-111 (manufactured by Wako Pure Chemical Industries, Ltd.), and OTazo-15, OTazo-30, AIBN, AMBN, ADVN, and ACVA (manufactured by Otsuka Chemical Co., Ltd.); and PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PEROYL TCP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, and PERBUTYL Z (manufactured by NOF Corporation), KAYAKETAL AM-055, TRIGONOX 36-C75, LAUROX, PERCADOX L-W75, PERCADOX CH-50L, TRIGONOX TMBH, KAYACUMENE H, KAYABUTYL H-70, PERCADOX BC-FF, KAYAHEXA AD, PERCADOX 14, KAYABUTYL C, KAYABUTYL D, KAYAHEXA YD-E85, PERCADOX 12-XL25, PERCADOX 12-EB20, TRIGONOX 22-N70, TRIGONOX 22-70E, TRIGONOX D-T50, TRIGONOX 423-C70, KAYAESTER CND-C70, KAYAESTER CND-W50, TRIGONOX 23-C70, TRIGONOX 23-W50N, TRIGONOX 257-C70, KAYAESTER P-70, KAYAESTER TMPO-70, TRIGONOX 121, KAYAESTER O, KAYAESTER HTP-65W, KAYAESTER AN, TRIGONOX 42, TRIGONOX F-050, KAYABUTYL B, KAYACARBON EH-C70, KAYACARBON EH-W60, KAYACARBON 1-20, KAYACARBON BIC-75, TRIGONOX 117, and KAYALENE 6-70 (manufactured by Kayaku Akzo Co., Ltd.), and LUPEROX 610, LUPEROX 188, LUPEROX 844, LUPEROX 259, LUPEROX 10, LUPEROX 701, LUPEROX 11, LUPEROX 26, LUPEROX 80, LUPEROX 7, LUPEROX 270, LUPEROX P, LUPEROX 546, LUPEROX 554, LUPEROX 575, LUPEROX TANPO, LUPEROX 555, LUPEROX 570, LUPEROX TAP, LUPEROX TBIC, LUPEROX TBEC, LUPEROX JW, LUPEROX TAIC, LUPEROX TAEC, LUPEROX DC, LUPEROX 101, LUPEROX F, LUPEROX DI, LUPEROX 130, LUPEROX 220, LUPEROX 230, LUPEROX 233, and LUPEROX 531 (manufactured by Arkema Yoshitomi, Ltd.).

Among them, when an azo polymerization initiator having a molecular weight of 250 or greater is used, the reaction proceeds without unevenness at a low temperature, and thus a high-strength film in which unevenness is suppressed is formed. The molecular weight of the azo polymerization initiator is preferably 250 or greater, and more preferably 300 or greater.

The heating is performed under an inert gas atmosphere of nitrogen, argon, or the like at an oxygen concentration of preferably 1000 ppm or less, and more preferably 500 ppm or less and a temperature of preferably from 50° C. to 170° C., and more preferably from 70° C. to 150° C. for preferably from 10 minutes to 120 minutes, and more preferably from 15 minutes to 100 minutes.

The total content of the photocuring catalyst or the thermal polymerization initiator is preferably from 0.1% by weight to 10% by weight, more preferably from 0.1% by weight to 8% by weight, and particularly preferably from 0.1% by weight to 5% by weight with respect to the total solid content in the solution for layer formation.

In this exemplary embodiment, a thermal curing method in which radicals are relatively slowly generated is employed due to the reason that when the reaction excessively rapidly proceeds, structural relaxation of the coating film is difficult to occur due to the cross-linking, and thus unevenness and wrinkles easily occur in the film.

Particularly, when the specific reactive group-containing charge transporting material and thermal curing are combined with each other, structural relaxation of the coating film is promoted, whereby a protective layer (outermost layer) having excellent surface properties is easily obtained.

The thickness of the protective layer is set in the range of, for example, preferably from 3 μm to 40 μm, and more preferably from 5 μm to 35 μm.

Although the configurations of the respective layers in the function separating-type photosensitive layer have been described with reference to the electrophotographic photoreceptor shown in FIG. 1, the respective layers in the function separating-type electrophotographic photoreceptor shown in FIG. 2 may also employ the configurations. In addition, in the case of the single layer-type photosensitive layer of the electrophotographic photoreceptor shown in FIG. 3, the following aspects are preferable.

That is, the single layer-type photosensitive layer (charge generating/charge transporting layer) may be configured to contain a charge generating material, a charge transporting material, and if necessary, a binder resin, with other known additives. These materials are the same as those described in the descriptions of the charge generating material and the charge transporting layer.

The content of the charge generating material in the single layer-type photosensitive layer may be from 10% by weight to 85% by weight, and is preferably from 20% by weight to 50% by weight with respect to the total solid content. The content of the charge transporting material in the single layer-type photosensitive layer may be from 5% by weight to 50% by weight with respect to the total solid content.

The method of forming the single layer-type photosensitive layer is the same as the method of forming the charge generating layer or the charge transporting layer.

The thickness of the single layer-type photosensitive layer may be, for example, from 5 μm to 50 μm, and is preferably from 10 μm to 40 μm.

In the electrophotographic photoreceptor according to this exemplary embodiment, the form has been described in which the outermost layer is a protective layer. However, a layer configuration with no protective layer may also be employed.

In the case of the layer configuration with no protective layer, in the electrophotographic photoreceptor shown in FIG. 1, the charge transporting layer which is positioned on the outermost surface of the layer configuration becomes the outermost layer. In addition, the charge transporting layer as the outermost layer is configured by a cured film of the above-described specific composition.

In addition, in the case of the layer configuration with no protective layer, in the electrophotographic photoreceptor shown in FIG. 3, the single layer-type photosensitive layer which is positioned on the outermost surface of the layer configuration becomes the outermost layer. In addition, the single layer-type photosensitive layer as the outermost layer is configured by a cured film of the above-described specific composition. The composition contains a charge generating material blended therein.

The thicknesses of the charge transporting layer as the outermost layer and the single layer-type photosensitive layer may be, for example, from 7 μm to 70 μm, and is preferably from 10 μm to 60 μm.

Image Forming Apparatus (and Process Cartridge)

Hereinafter, an image forming apparatus (and process cartridge) according to this exemplary embodiment will be described in detail.

Figure 4:
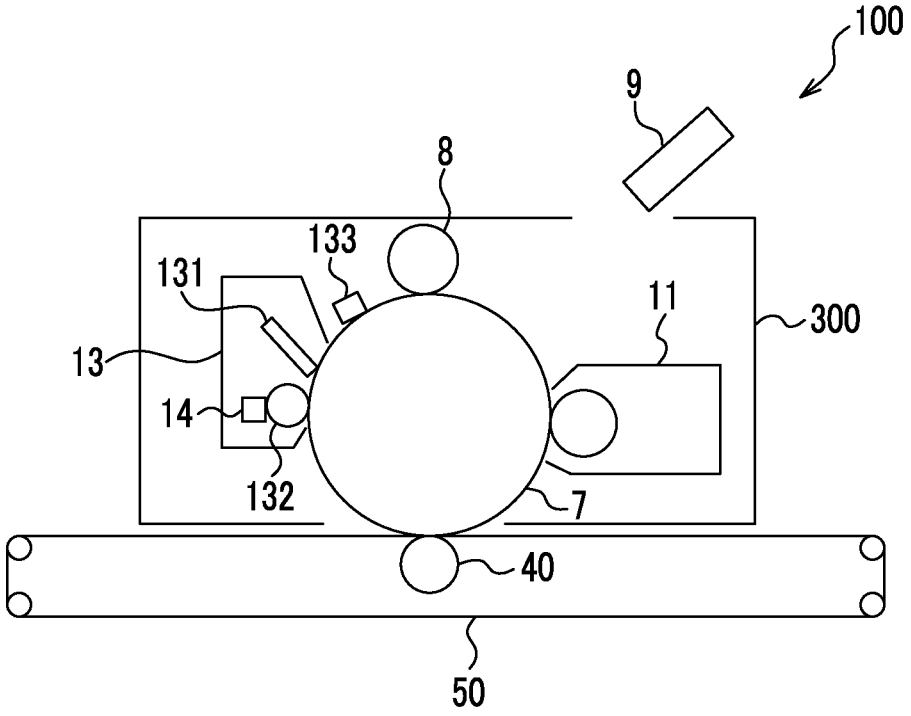
FIG. 4 is a schematic structural diagram showing an example of the image forming apparatus according to the present exemplary embodiment.

FIG. 4 is a diagram schematically showing the configuration of the image forming apparatus according to the first exemplary embodiment. As shown in FIG. 4, the image forming apparatus 100 is provided with a process cartridge 300 provided with an electrophotographic photoreceptor 7, an exposure device 9, a transfer device 40, and an intermediate transfer member 50. In the image forming apparatus 100, the exposure device 9 is disposed so that it is possible to expose the electrophotographic photoreceptor 7 through an opening portion of the process cartridge 300, the transfer device 40 is disposed at a position that is opposed to the electrophotographic photoreceptor 7 with the intermediate transfer member 50 interposed therebetween, and the intermediate transfer member 50 is disposed so as to be partially brought into contact with the electrophotographic photoreceptor 7. Also the image forming apparatus has a secondary transfer device which is not shown in the figure and transfers the toner images from the intermediate transfer member 50 to recording medium.

The process cartridge 300 in FIG. 4 integrally supports the electrophotographic photoreceptor 7, a charging device 8, a developing device 11 and a cleaning device 13 in a housing. The cleaning device 13 has a cleaning blade (cleaning member). The cleaning blade 131 is disposed so as to contact with the surface of the electrophotographic photoreceptor 7.

Although using a fibrous member 132 (roll shape) which supplies an antifriction 14 to the surface of the electrophotographic photoreceptor 7 and a fibrous member 133 (flat brush shape) which assists cleaning are exemplified, these may or may not be used.

Hereinafter, elements of the image forming apparatus according to this exemplary embodiment will be described in detail.

Charging Device

As the charging device 8, a contact charging device that uses, for example, a conductive or semiconductive charging roller, charging brush, charging film, charging rubber blade or charging tube is used. A known charging device such as a non-contact roller charging device, Scorotron corona charger or Corotron corona charger that makes use of corona discharge may be used as well.

Though not shown in the drawing, a photoreceptor heating member for elevating a temperature of the electrophotographic photoreceptor 7 to reduce a relative temperature may be disposed around the electrophotographic photoreceptor 7 to enhance stability of an image.

Exposure Device

As the exposure device 9, an optical device for desirably image-wise exposing light of semiconductor laser beam, LED light or liquid crystal shutter light on a surface of the photoreceptor 7 is exemplified. A wavelength of a light source, which is in a spectral sensitivity range of a photoreceptor, is used. As a wavelength of a semiconductor laser, near-infrared having an oscillation wavelength in the proximity of 780 nm is mainly used. However, without restricting to the wavelength, a laser having an oscillation wavelength of 600 something nm or a laser having an oscillation wavelength in the vicinity of from 400 nm to 450 nm as a blue laser may be used. Furthermore, when a color image is formed, a surface-emitting laser light source capable of outputting multi-beams as well is effective.

Developing Device

As the developing device 11, a general developing device where, for example, a magnetic or nonmagnetic single component developer or two-component developer is used in contact or without contact to develop may be used. The developing device is selected in accordance with the object as long as the foregoing functions are possessed. For example, a known developing device where the single component or two-component developer is attached to a photoreceptor 7 by use of a brush or a roller is cited. Among these, a developing roller retaining a developer on a surface thereof is preferably used.

Hereinafter, a toner that is used in the developing device 11 is described. The developer may be a single component developer composed of a toner, or two-component developer including a toner and a carrier.

Cleaning Device

A device with a cleaning blade system which is provided with the cleaning blade 131 is used as the cleaning device 13.

Other than the cleaning blade system, a fur brush cleaning system or a system in which cleaning is carried out simultaneously with development may be employed.

Transfer Device

As the transfer device 40, a known charging device such as a contact transfer charging device that uses, for example, a belt, a roller, a film or a rubber blade; or a Scorotron corona charger or Corotron corona charger using corona discharge may be used as well.

Intermediate Transfer Member

As the intermediate transfer member 50, a belt (intermediate transfer belt) made of semiconductive polyimide, polyamideimide, polycarbonate, polyarylate, polyester, rubber or the like may be used. As a form of the intermediate transfer member 50, a drum may be used in addition to a belt.

The above-described image forming apparatus 100 may be provided with, for example, known devices, other than the above-described devices.

Figure 5:
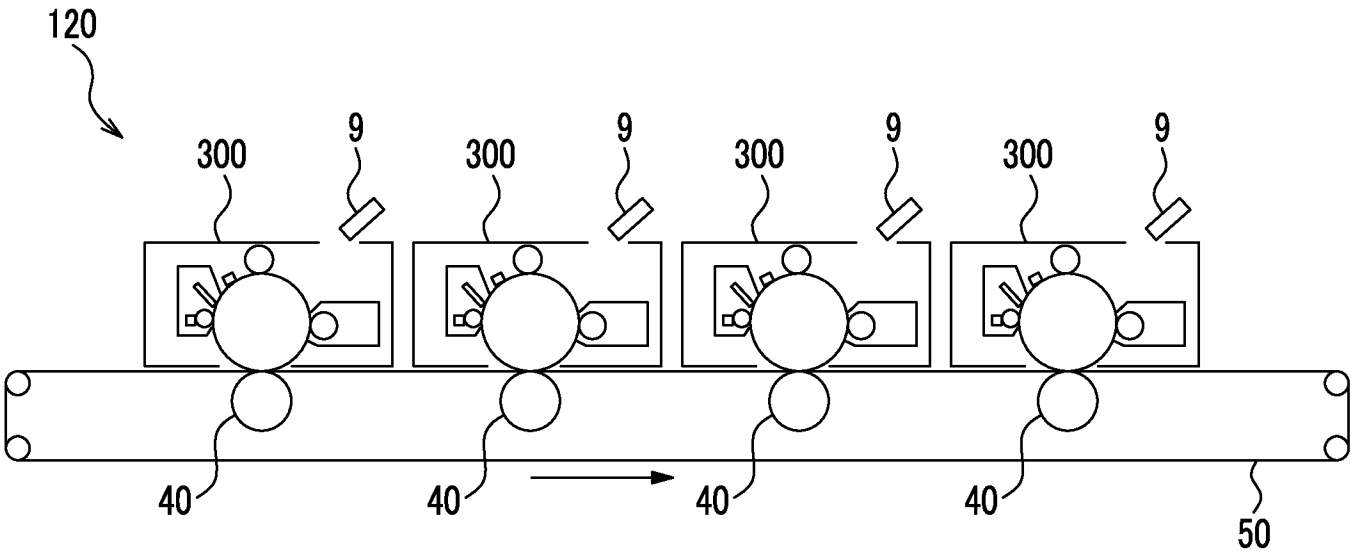
FIG. 5 is a schematic structural diagram showing another example of the image forming apparatus according to the present exemplary embodiment.

FIG. 5 is a schematic diagram showing another example of the configuration of the image forming apparatus according to this exemplary embodiment.

An image forming apparatus 120 shown in FIG. 5 is a tandem multicolor image forming apparatus having four process cartridges 300 installed therein. In the image forming apparatus 120, the four process cartridges 300 are arranged in parallel on an intermediate transfer member 50, and a configuration is employed in which one electrophotographic photoreceptor is used per color. The image forming apparatus 120 has the same configuration as the image forming apparatus 100, except that the image forming apparatus 120 has a tandem system.

The process cartridge according to this exemplary embodiment may be any process cartridge as long as it is provided with an electrophotographic photoreceptor and is detachable from the image forming apparatus.

As for the above-described image forming apparatus (process cartridge) according to this exemplary embodiment, the image forming apparatus to which a dry developer is applied has been described. However, an image forming apparatus (process cartridge) to which a liquid developer is applied may be used. Particularly, in the image forming apparatus (process cartridge) to which a liquid developer is applied, an outermost layer of an electrophotographic photoreceptor swells due to liquid components of the liquid developer, and thus cracks or cleaning scratches due to the cleaning are easily generated. However, when the electrophotographic photoreceptor according to this exemplary embodiment is applied, these are improved, and as a result, stable images are obtained over a long period of time.

Figure 6:
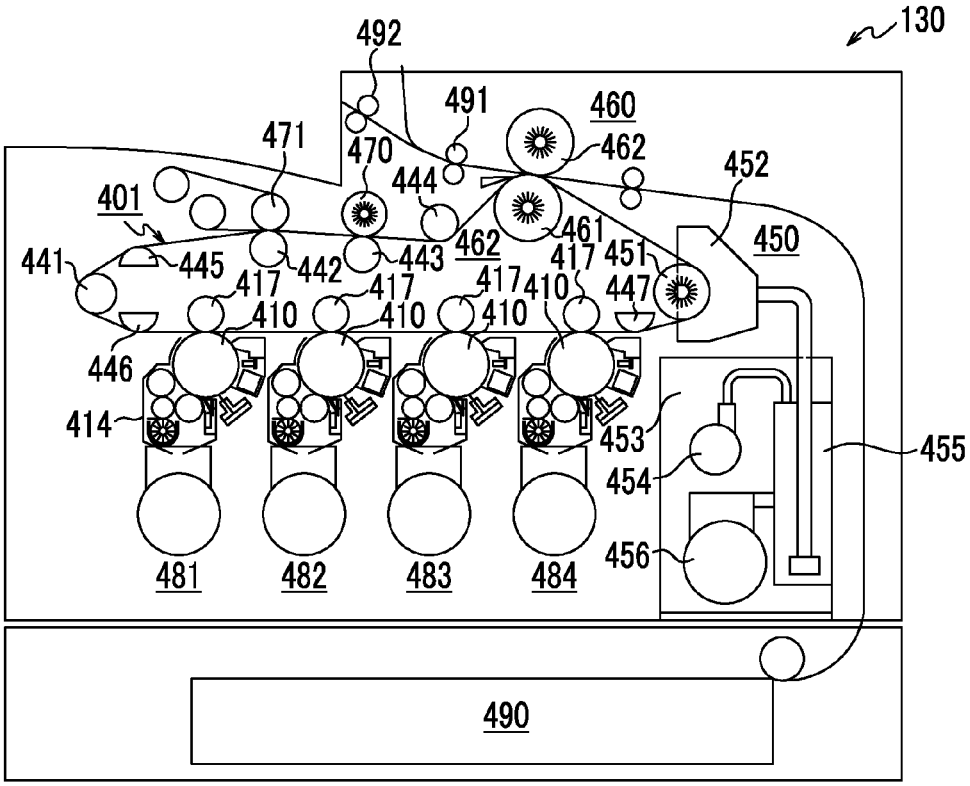
FIG. 6 is a schematic structural diagram showing still another example of the image forming apparatus according to the present exemplary embodiment.
Figure 7:
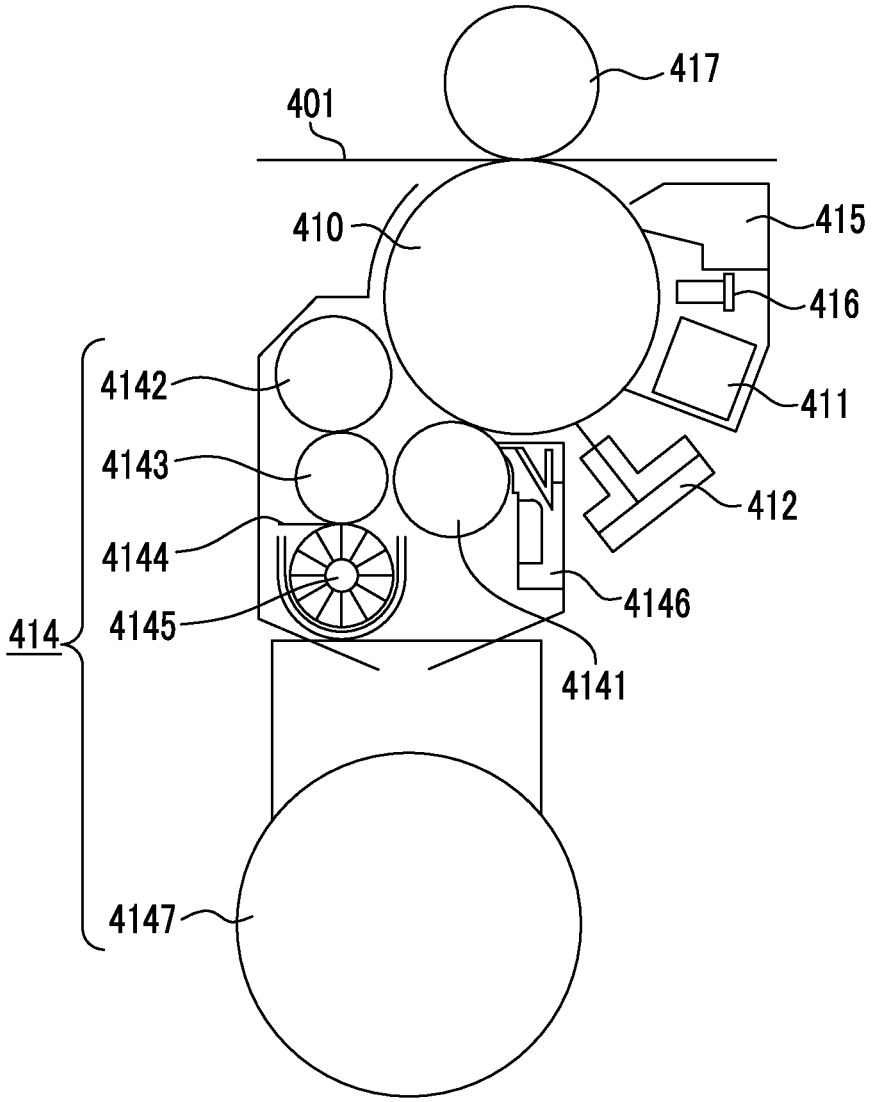
FIG. 7 is a schematic structural diagram showing a developing device in the image forming apparatus shown in FIG. 6.

FIG. 6 is a schematic diagram showing a further example of the configuration of the image forming apparatus according to this exemplary embodiment. FIG. 7 is a schematic diagram showing a configuration of an image forming unit in the image forming apparatus shown in FIG. 6.

An image forming apparatus 130 shown in FIG. 6 is mainly configured by a belt-shaped intermediate transfer member 401, color image forming units 481, 482, 483, and 484, a heating part 450 (an example of a layer forming section), and a transfer fixing part 460.

As shown in FIG. 7, the image forming unit 481 is configured by an electrophotographic photoreceptor 410, a charging device 411 which charges the electrophotographic photoreceptor 410, a LED array head 412 (an example of an electrostatic latent image forming section) which performs an image exposure in order to form an electrostatic latent image on a surface of the charged electrophotographic photoreceptor 410 in accordance with image information, a developing device 414 which develops the electrostatic latent image which is formed on the electrophotographic photoreceptor 410 using a liquid developer, a cleaner 415 which cleans the surface of the photoreceptor, an erasing device 416, and a transfer roll 417 (an example of a primary transfer section) which is disposed to be opposed to the electrophotographic photoreceptor 410 with the belt-shaped intermediate transfer member 401 interposed therebetween, and to which a transfer bias is applied to transfer, onto the belt-shaped intermediate transfer member 401, the image which is formed on the electrophotographic photoreceptor 410 and developed with the liquid developer.

As shown in FIG. 7, the developing device 414 has a developing roll 4141, a liquid drain-off roll 4142, a developer cleaning roll 4143, a developer cleaning blade 4144, a developer cleaning brush 4145, a circulation pump (not shown), a liquid developer supply path 4146, and a developer cartridge 4147 provided therein.

As the liquid developer which is used herein, a liquid developer in which particles including a heating fusing fixing-type resin such as polyester or polystyrene as a main component are dispersed, or a liquid developer which is formed into a layer (hereinafter, referred to as forming into a film) by increasing the ratio of the solid content in the liquid developer by removing a surplus dispersion medium (carrier liquid) is used. The detailed description of the material which is formed into a film is shown in U.S. Pat. No. 5,650,253 (from Column 10, Line 8 to Column 13, Line 14) and U.S. Pat. No. 5,698,616.

The developer which is formed into a film is a liquid developer in which a substance having a fine particle diameter (such as a toner having a fine particle diameter) having a glass transition temperature lower than room temperature (for example, 25° C.) is dispersed in a carrier liquid. Usually, particles of the substance do not come into contact and aggregate with each other. However, when the carrier liquid is removed, only the substance is present, and thus when the substance is adhered in the form of a film, the particles are bonded to each other at room temperature (for example, 25° C.) and a film is formed. This substance is obtained by blending ethyl acrylate with methyl methacrylate, and the glass transition temperature is set in accordance with the blending ratio.

Other image forming units 482, 483, and 484 also have the same configuration. Liquid developers having different colors (yellow, magenta, cyan, and black) are charged in the developing devices of the respective image forming units. In addition, the electrophotographic photoreceptor, the developing device, or the like is made into a cartridge in the respective image forming units 481, 482, 483, and 484.

In the above configuration, examples of the material of the belt-shaped intermediate transfer member 401 include a PET film (polyethylene telephthalate film) coated with silicone rubber or a fluorine resin, and a polyimide film.

The electrophotographic photoreceptor 410 contacts the belt-shaped intermediate transfer member 401 on an upper surface thereof, and moves with the belt-shaped intermediate transfer member 401 at the same rate.

For example, a corona charger is used as the charging device 411. As the electrophotographic photoreceptors 410 in the image forming units 481, 482, 483, and 484, electrophotographic photoreceptors 410 having the same peripheral length are used, and an interval between the transfer rolls 417 is the same as the peripheral length of the electrophotographic photoreceptor 410, or the integral multiple of the peripheral length.

The heating part 450 is configured by a heating roll 451 which is provided to contact and rotate with an inner surface of the belt-shaped intermediate transfer member 401, a reservoir tank 452 which is provided to be opposed to the heating roll 451 and surround an outer surface of the belt-shaped intermediate transfer member 401, and a carrier liquid recovering part 453 which recovers a carrier liquid vapor and a carrier liquid from the reservoir tank 452. A suction blade 454 which sucks the carrier liquid vapor in the reservoir tank 452, a condensing part 455 which converts the carrier liquid vapor into a liquid, and a recovery cartridge 456 which recovers the carrier liquid from the condensing part 455 are mounted on the carrier liquid recovering part 453.

The transfer fixing part 460 (an example of a secondary transfer section) is configured by a transfer support roll 461 which rotates and supports the belt-shaped intermediate transfer member 401 and a transfer fixing roll 462 which rotates while pressing a recording medium passing through the transfer fixing part 460 against the belt-shaped intermediate transfer member 401, and both of them have a heating element therein.

In addition, a cleaning roll 470 and a cleaning web 471 which perform cleaning on the belt-shaped intermediate transfer member 401 prior to the formation of the color image on the belt-shaped intermediate transfer member 401, and support rolls 441 to 444 and support shoes 445 to 447 which support the rotary drive of the belt-shaped intermediate transfer member 401 are provided.

Regarding the belt-shaped intermediate transfer member 401, the transfer rolls 417 of the respective color image forming units, the heating roll 451, the transfer support roll 461, the support rolls 441 to 444, the support shoes 445 to 447, the cleaning roll 470, and the cleaning web 471 constitute an intermediate unit 402, and the intermediate unit 402 in the vicinity of the support roll 441 is integrally moved up and down around the vicinity of the heating roll 451.

Hereinafter, an operation of the image forming apparatus shown in FIG. 6 which uses a liquid developer will be described.

First, in the image forming unit 481, an image exposure according to yellow image information is performed by the LED array head 412 on the electrophotographic photoreceptor 410 having a surface charged by the charging device 411 to form an electrostatic latent image. The electrostatic latent image is developed with a yellow liquid developer by the developing device 414.

Here, the developing is performed in the following steps. The yellow liquid developer passes through the liquid developer supply path 4146 from the developer cartridge 4147 by a circulation pump and is supplied around a position at which the developing roll 4141 and the electrophotographic photoreceptor 410 approach each other. Due to a developing electric field which is formed between the electrostatic latent image on the electrophotographic photoreceptor 410 and the developing roll 4141, the colored solid content having a charge in the supplied liquid developer transfers to the electrostatic latent image part as an image part on the electrophotographic photoreceptor 410.

Next, the carrier liquid is removed from the electrophotographic photoreceptor 410 by the liquid drain-off roll 4142 so as to obtain a carrier liquid ratio which is necessary in the next transfer process. In this manner, a yellow image by the yellow liquid developer is formed on the surface of the electrophotographic photoreceptor 410 passing through the developing device 414.

In the developing device 414, the developer cleaning roll 4143 removes the liquid developer on the developing roll 4141 after the developing operation and the liquid developer adhered to a squeeze roll due to a squeeze operation, and the developer cleaning blade 4144 and the developer cleaning brush 4145 clean the developer cleaning roll 4143 to always perform a stable developing operation. The configuration and the operation of the developing device are described in detail in JP-A-11-249444.

In order to supply a liquid developer having a constant solid content ratio to the developing roll 4141, at least one of the developing device 414 and the developer cartridge 4147 automatically controls the concentration of the solid content in the liquid developer.

The yellow developed image formed on the electrophotographic photoreceptor 410 is brought into contact with the belt-shaped intermediate transfer member 401 on its upper surface due to the rotation of the electrophotographic photoreceptor 410, and electrostatically transferred onto the belt-shaped intermediate transfer member 401 in a contact manner by the transfer roll 417 which is disposed to be opposed to and brought into pressure contact with the electrophotographic photoreceptor 410 via the belt-shaped intermediate transfer member 401 and to which a transfer bias is applied.

In the electrophotographic photoreceptor 410 in which the contact electrostatic transfer is ended, the liquid developer remaining after the transfer is removed by the cleaner 415, and the electrophotographic photoreceptor 410 is erased by the erasing device 416 so as to be used in the next image formation.

Other image forming units 482, 483, and 484 also perform the same operation. As the electrophotographic photoreceptors in the respective image forming units, electrophotographic photoreceptors 410 having the same peripheral length are used, and developed color images formed on the respective photoreceptors are electrostatically transferred in order onto the belt-shaped intermediate transfer member 401 by the transfer rolls which are provided at an interval which is the same as the peripheral length of photoreceptor, or the integral multiple of the peripheral length. Accordingly, the developed images of yellow, magenta, cyan, and black formed on the respective photoreceptors 410 in consideration of the overlapping positions on the belt-shaped intermediate transfer member 401 overlap each other in order with high accuracy on the belt-shaped intermediate transfer member 401 without a position deviation and are electrostatically transferred in a contact manner even when there is eccentricity of the electrophotographic photoreceptor 410, and the images developed with the respective color liquid developers are formed on the belt-shaped intermediate transfer member 401 passing through the image forming unit 484.

The developed images formed on the belt-shaped intermediate transfer member 401 are heated from a rear surface of the belt-shaped intermediate transfer member 401 by the heating roll 451 in the heating part 450, and the carrier liquid which is a dispersion medium almost evaporates, whereby an image formed into a film is obtained. The reason for this is that when the liquid developer contains dispersed particles including a heating fusing fixing-type resin as a main component, the dispersed particles are melted due to the removal of the surplus dispersion medium and the heating by the heating roll 451 and form a film. Otherwise, the reason is that the liquid developer is formed into a film by removing a surplus dispersion medium (carrier liquid) and increasing the ratio of the solid content in the liquid developer.

In the heating part 450, a carrier liquid vapor in the reservoir tank 452 which is generated by evaporation by heating by the heating roll 451 is guided to and liquefied in the condensing part 455 by the suction blade 454 in the carrier liquid recovering part 453, and the reliquefied carrier liquid is guided to the recovery cartridge 456 and recovered.

In the transfer fixing part 460, the belt-shaped intermediate transfer member 401 with the film-shaped (layer-shaped) image formed thereon which passes through the heating part 450 is transferred onto a transfer medium (for example, plain paper) which is transported at the right time from a paper supply part 490 in a lower part of the device, through heating and pressing by the transfer support roll 461 and the transfer fixing roll 462 to form the image on the transfer medium. The transfer medium is output and discharged to the outside of the device by discharge rolls 491 and 492. Here, in the transfer, the adhesion of the image formed into a film on the belt-shaped intermediate transfer member 401 to the belt-shaped intermediate transfer member 401 is weaker than the adhesion of the image formed into a film to the transfer medium, and the transfer is performed on the transfer medium by a difference in the adhesion. No electrostatic force is applied at the time of transfer. The bonding power of the image formed into a film is greater than the adhesion to the transfer medium.

In the belt-shaped intermediate transfer member 401 passing through the transfer fixing part 460, the solid content remaining after the transfer or a substance which is contained in the solid content and inhibits the function of the belt-shaped intermediate transfer member 401 is recovered and removed by the cleaning roll 470 having a heating element therein and the cleaning web 471. Thereafter, the belt-shaped intermediate transfer member 401 is used in the next image formation.

After the image is formed as described above, the intermediate unit 402 in the vicinity of the support roll 441 integrally moves upward around the vicinity of the heating roll 451, and the belt-shaped intermediate transfer member 401 is separated from the electrophotographic photoreceptors 410 of the respective image forming units. In addition, the transfer fixing roll 462 is also separated from the belt-shaped intermediate transfer member 401.

When there is again an image forming request, the intermediate unit 402 is operated so as to bring the belt-shaped intermediate transfer member 401 into contact with the electrophotographic photoreceptors 410 of the image forming units. Likewise, the transfer fixing roll 462 is also operated so as to be brought into contact with the belt-shaped intermediate transfer member 401. The operation of the transfer fixing roll 462 may be carried out in accordance with a time at which an image is transferred onto a recording medium.

Figure 8:
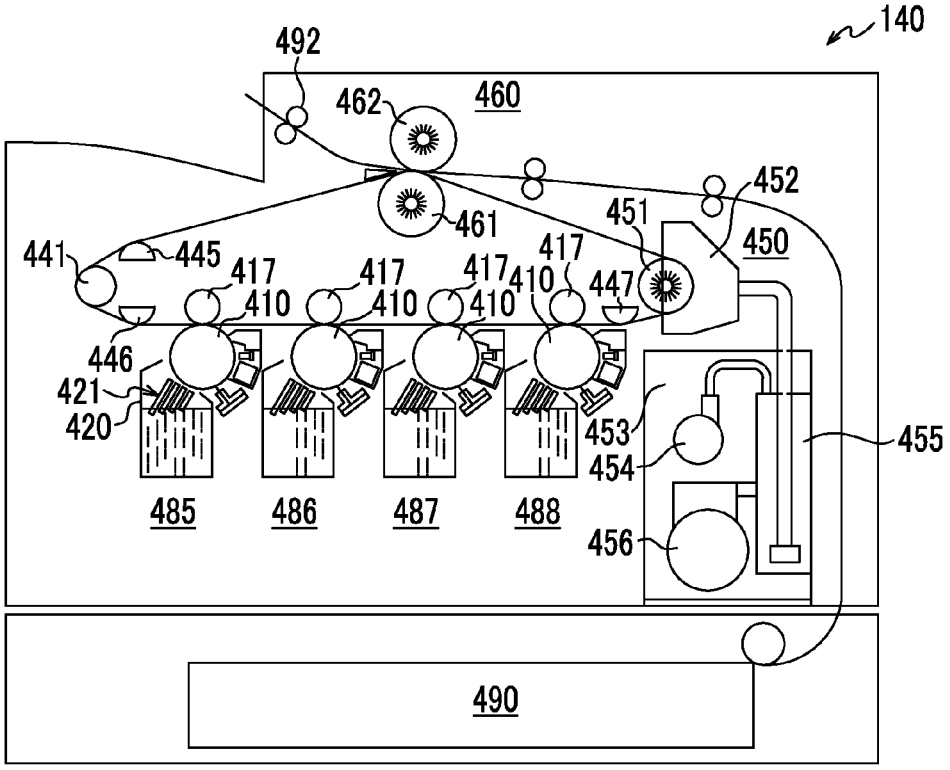
FIG. 8 is a schematic structural diagram showing even still another example of the image forming apparatus according to the present exemplary embodiment.

The image forming apparatus using a liquid developer is not limited to the above-described image forming apparatus 130 shown in FIG. 6, and may be, for example, an image forming apparatus shown in FIG. 8.

FIG. 8 is a schematic diagram showing a further example of the configuration of the image forming apparatus according to this exemplary embodiment.

An image forming apparatus 140 shown in FIG. 8 is mainly configured by a belt-shaped intermediate transfer member 401, color image forming units 485, 486, 487, and 488, a heating part 450, and a transfer fixing part 460 as in the image forming apparatus 130 shown in FIG. 6.

The image forming apparatus 140 shown in FIG. 8 is different from the image forming apparatus 130 shown in FIG. 6 in that the belt-shaped intermediate transfer member 401 runs in a substantially triangular form and a developing device 420 in each of the color image forming units 485, 486, 487, and 488 has a different configuration. The heating part 450 and the transfer fixing part 460 are the same as those in the image forming apparatus 130 shown in FIG. 6. A cleaning roll 470 and a cleaning web 471 are omitted in the drawing.

The belt-shaped intermediate transfer member 401 performs a bending operation with the rotation of the belt-shaped intermediate transfer member 401. However, since the bending operation affects the stable running and the lifespan of the belt-shaped intermediate transfer member 401, a substantially triangular running form with a minimized bending operation is employed.

In the developing device 420, there are no developing rolls and liquid drain-off rolls, but plural recording heads 421 which selectively jet and adhere a liquid developer to an electrostatic latent image formed on an electrophotographic photoreceptor 410 are arranged in plural rows.

In addition, a large number of recording electrodes 422 are uniformly provided in a longitudinal direction of the electrophotographic photoreceptor 410 in the respective rows of the recording heads 421, and a jetting electric field is formed between an electrostatic latent image potential formed on the electrophotographic photoreceptor 410 and a jetting bias potential applied to the recording electrode 422, whereby the colored solid content having a charge in the liquid developer supplied to the recording electrode 422 transfers to the electrostatic latent image part as an image part on the electrophotographic photoreceptor 410, and is developed.

Figure 9:
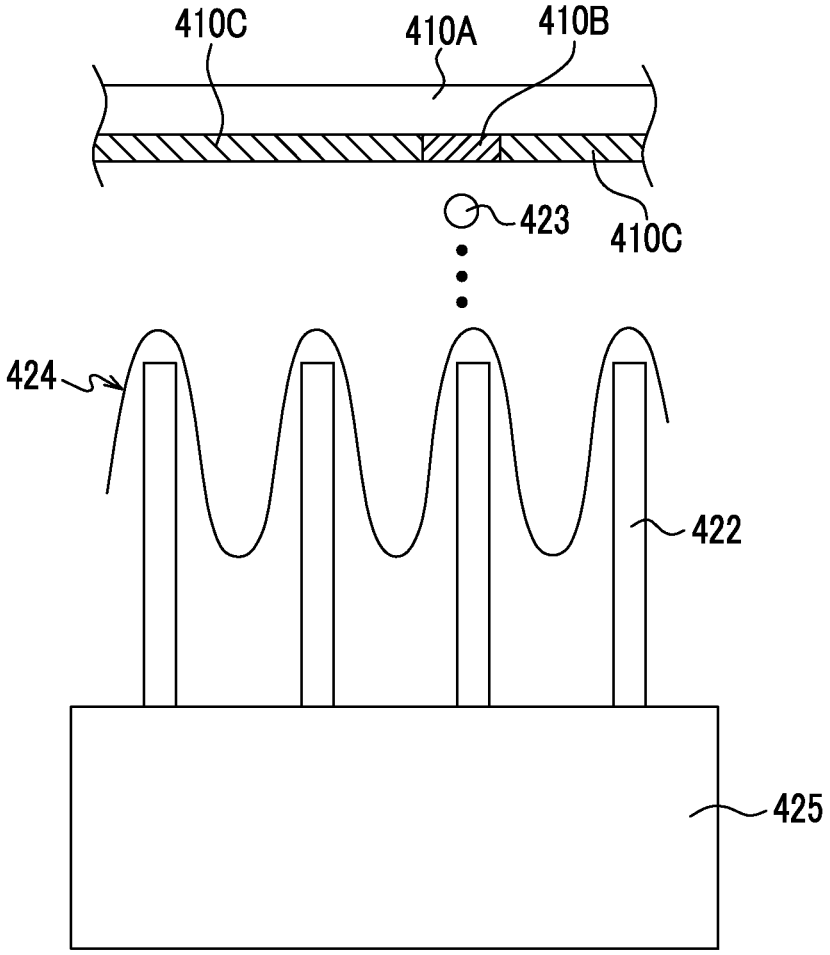
FIG. 9 is a schematic diagram showing the liquid transition state to the meniscus and the image portion of the liquid developer formed around the recording electrode of the developing device in the image forming apparatus shown in FIG. 8.

A meniscus (liquid holding form which is formed on the member or between the members brought into contact with the liquid by viscosity of the liquid, surface tension, and surface energy of the surface of the member brought into contact with the liquid) 424 of the liquid developer is formed around the recording electrode 422. FIG. 9 is a diagram showing the above state. An electrostatic latent image which becomes an image part is formed on an electrophotographic photoreceptor 410A which is a jetting destination of a liquid droplet 423 of the liquid developer. At this time, for example, an electrostatic latent image potential of from 50 V to 100 V is applied to an image part 410B, and for example, a potential of from 500 V to 600 V is applied to a non-image part 410C. Here, when a jetting bias potential of about 1000 V is applied to the recording electrode 422 via a bias voltage supplier 425, a liquid developer having a solid content ratio higher than the ratio of the solid content in the supplied liquid developer, i.e. a high-concentration liquid developer is supplied to a tip end of the recording electrode 422 by electric field concentration, and the liquid droplet 423 generated by the high-concentration liquid developer is jetted and adhered to the electrostatic latent image part (image part) on the electrophotographic photoreceptor 410A by a potential difference (for example, from 700 V to 800 V is a threshold of the potential difference for jetting) between the electrostatic latent image potential of the image part 410B on the electrophotographic photoreceptor 410A and the jetting bias potential of the recording electrode 422. In addition, in the developing device 420, the developing device itself acts as a developer cartridge.

As for the operation of the image forming apparatus 140 shown in FIG. 8, since only the running form of the belt-shaped intermediate transfer member 401 and the operation of the developing device 420 are different from those in the image forming apparatus 130 shown in FIG. 6 and other operations are the same, the descriptions thereof will be omitted.

Figure 10:
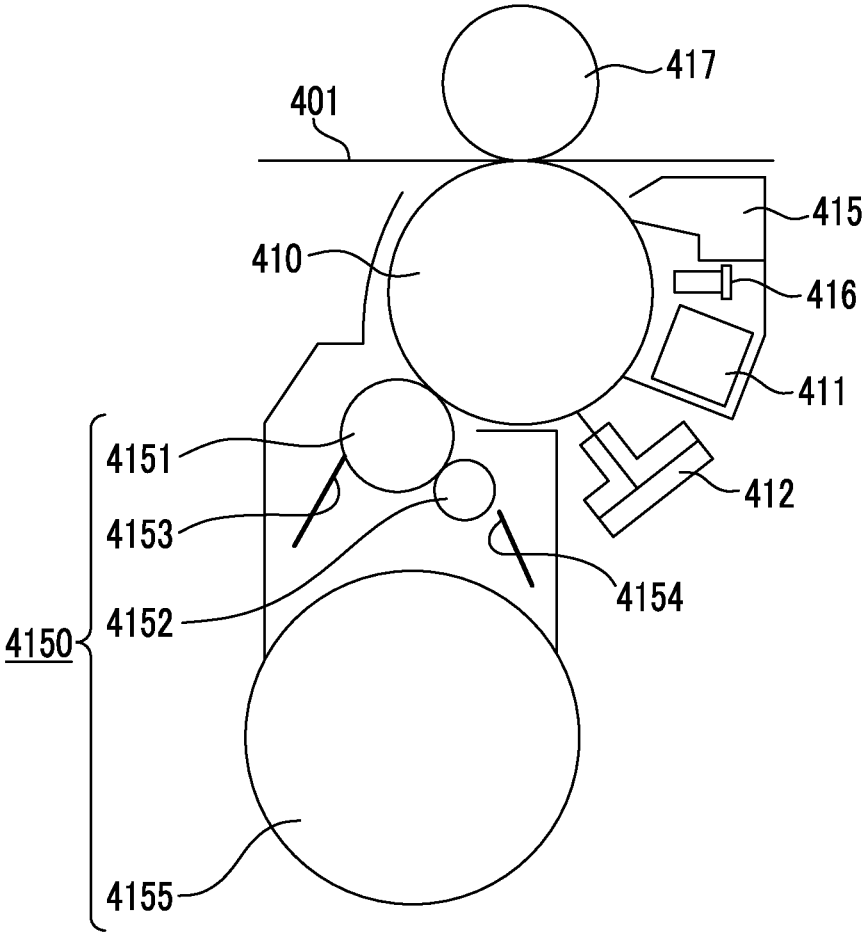
FIG. 10 is a schematic structural diagram showing another example of the developing device in the image forming apparatus shown in FIGS. 6 and 8.

Here, in the image forming apparatus using a liquid developer, the developing device is not limited to the above-described configuration, and for example, may be a developing device shown in FIG. 10.

FIG. 10 is a schematic diagram showing a configuration of another developing device in the image forming apparatus shown in FIG. 6 or 8.

In the image forming apparatus 130 shown in FIG. 6 or the image forming apparatus 140 shown in FIG. 8, when developing an electrostatic latent image formed on an electrophotographic photoreceptor 410 by a developing roll 4151, a developing device 4150 shown in FIG. 10 forms, on the developing roll 4151, a liquid developer layer having a solid content ratio higher than the ratio of the solid content in a liquid developer which is supplied from a developer cartridge 4155, and the developing is carried out by the high-concentration liquid developer layer.

As for the formation of the liquid developer layer having an increased solid content ratio on the developing roll 4151, by forming an electric field by providing a potential difference between a supply roll 4152 and the developing roll 4151, a liquid developer layer having a solid content ratio higher than that of the liquid developer from the developer cartridge 4155 is formed on the developing roll 4151. Cleaning blades 4153 and 4154 are provided to clean roll surfaces of the developing roll 4151 and the supply roll 4152.

The above-described image forming apparatus (process cartridge) according to this exemplary embodiment is not limited to the above-described configuration, and a known configuration may be applied.

EXAMPLES

Hereinbelow, the invention will be described in detail with reference to Examples, but the invention is not limited thereto.

Example 1

Preparation of Undercoat Layer 100 parts by weight of zinc oxide (average particle diameter: 70 nm, manufactured by Tayca Corporation, specific surface area: 15 $m^2/g$) is mixed with 500 parts by weight of toluene under stirring, and 1.3 parts by weight of a silane coupling agent (KBM503, manufactured by Shin-Etsu Chemical Co., Ltd.) is added thereto, followed by stirring for 2 hours. Subsequently, toluene is removed by distillation under reduced pressure and the resultant is baked at 120° C. for 3 hours to obtain zinc oxide having the surface treated with the silane coupling agent. 110 parts by weight of the surface-treated zinc oxide is stirred and mixed with 500 parts by weight of tetrahydrofuran, into which a solution having 0.6 part by weight of alizarin dissolved in 50 parts by weight of tetrahydrofuran is added, followed by stirring at 50° C. for 5 hours. Subsequently, the zinc oxide to which the alizarin is added is collected by filtration under a reduced pressure, and dried under reduced pressure at 60° C. to obtain alizarin-added zinc oxide.

38 parts by weight of a solution prepared by dissolving 60 parts by weight of the alizarin-added zinc oxide, 13.5 parts by weight of a curing agent (blocked isocyanate, Sumidur 3175, manufactured by Sumitomo-Bayer Urethane Co., Ltd.) and 15 parts by weight of a butyral resin (S-Lec BM-1, manufactured by Sekisui Chemical Co., Ltd.) in 85 parts by weight of methyl ethyl ketone is mixed with 25 parts by weight of methyl ethyl ketone. The mixture is dispersed using a sand mill with glass beads having a diameter of 1 mmϕ for 2 hours to obtain a dispersion.

0.005 part by weight of dioctyltin dilaurate as a catalyst, and 40 parts by weight of silicone resin particles (Tospal 145, manufactured by GE Toshiba Silicone Co., Ltd.) are added to the dispersion to obtain a coating liquid for an undercoat layer. An undercoat layer having a thickness of 20 μm is formed by coating the coating liquid on an aluminum substrate by a dip coating method, and drying to cure it at 170° C. for 40 minutes.

Preparation of Charge Generating Layer

A mixture including 15 parts by weight of hydroxygallium phthalocyanine (CGM-1) having the diffraction peaks at Bragg angles (2θ±0.2°) of at least 7.3°, 16.0°, 24.9°, and 28.0° in an X-ray diffraction spectrum of Cukα characteristic X rays as a charge generating material, 10 parts by weight of a vinyl chloride-vinyl acetate copolymer resin (VMCH, manufactured by Nippon Unicar Co., Ltd.) as a binder resin, and 200 parts by weight of n-butyl acetate is dispersed by a sand mill with the glass beads having a diameter of 1 ϕmm for 4 hours. 175 parts by weight of n-butyl acetate and 180 parts by weight of methyl ethyl ketone are added to the obtained dispersion, followed by stirring to obtain a coating liquid for forming a charge generating layer. This coating liquid for forming a charge generating layer is dip-coated on the undercoat layer and dried at an ordinary temperature (25° C.) to form a charge generating layer having a film thickness of 0.2 μm.

Preparation of Charge Transporting Layer

Next, 45 parts by weight of N,N'-diphenyl-N,N'-bis(3-methylphenyl)-[1,1']biphenyl 4,4'-diamine (TPD), and 55 parts by weight of a bisphenol Z polycarbonate resin (hereinafter also denoted as "PCZ500", viscosity-average molecular weight: 50,000) as a binder resin are dissolved in 800 parts by weight of chlorobenzene to obtain a coating liquid for a charge transporting layer. This coating liquid is coated on the charge generating layer and dried at 130° C. for 45 minutes to form a charge transporting layer having a film thickness of 20 μm.

Formation of Protective Layer 85 parts by weight of the exemplary compound (I-c)-15 as a reactive group-containing charge transporting material is dissolved in 150 by weight of a mixed solvent (weight ratio of 60/40) of tetrahydrofuran (THF)/toluene, and further, 2 parts by weight of an initiator OTazo15 (manufactured by Otsuka Chemical Co., Ltd.) is dissolved therein, and then 15 parts by weight (in terms of only solid contents) of inorganic particles (X1) as the specific inorganic particles are dispersed therein to obtain a coating liquid for forming a protective layer. The obtained coating layer for forming a protective layer is coated on the charge transporting layer and heated at 150° C. for 40 minutes under an atmosphere with an oxygen concentration of 100 ppm to form a protective layer in 7 μm thick.

Through the above-described steps, an electrophotographic photoreceptor is obtained.

Examples 2 to 28, Comparative Examples 1 to 2, and Comparative Examples 4 to 5

According to Tables 1 and 2, in the same manner as in Example 1 except that the composition (the composition except for the initiator and the solvent) of the protective layer (the coating liquid), the respective electrophotographic photoreceptors are obtained.

Furthermore, in Tables 1 and 2, the numbers of the parts mean parts by weight. However, the numbers of the parts of the surface treating agent is parts by weight based on 100 parts by weight of the inorganic particles before the treatment.

[Photoreceptor Running Evaluation 1]

Figure 11A:
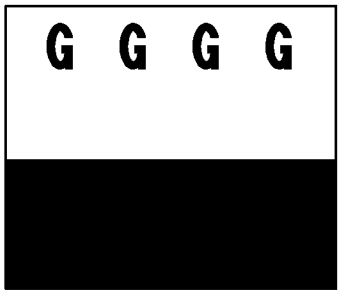
FIGS. 11A to 11C are diagrams showing image patterns, which are used respectively for image evaluation.

The electrophotographic photoreceptor prepared in each of Examples is installed on DocuCentre Color 400CP (manufactured by Fuji Xerox Co., Ltd.) and patterns for evaluation of images shown in FIG. 11A are printed under an ordinary environment (20° C., 50% RH). Thereafter, black solid patterns are printed continuously on 30000 sheets and then the patterns for evaluation of images are again printed. Further, the amount of light is adjusted with a filter depending on the sensitivity of the charge generating material.

<Image Stability>

Comparing the patterns for evaluation of images printed before and after the running evaluation 1, the degree of deterioration of the image quality is evaluated with the naked eye as shown below. A++ indicates the most satisfactory characteristics.

A++: Best (almost no deterioration may be seen in all of the image patterns)

A+: Change in the magnified images is found in some of the plural printed image patterns.

A: Good (change is not found with the naked eye but change in the magnified image is found)

B: Deterioration of the image quality may be found but is in an acceptable level.

C: Deterioration of the image quality occurs and is in a problematic level.

<Stability in Electrical Characteristics>

Before and after carrying out the photoreceptor running evaluation 1, each photoreceptor is negatively charged with a scorotron charging machine having a grid applied voltage of −700 V, under an ordinary environment (20° C., 50% RH), and subsequently, flash exposure is carried out on the charged photoreceptor at a light amount of 10 mJ/m$^2$ using a semiconductor laser at 780 nm. After the exposure, the potential (V) of the photoreceptor surface after 10 seconds is measured and this value is taken as a residual potential. In any of the photoreceptors, the residual potential indicates a negative value. In each of the photoreceptors, the value of (Residual potential before carrying out the running evaluation 1)−(Residual potential after carrying out the running evaluation 1) is calculated to evaluate the stability in electrical characteristics. A++ indicates the most satisfactory characteristics.

A++: Less than 10 V

A+: From 10 V to less than 20 V

A: From 20 V to less than 30 V

B: From 30 V to less than 50 V

C: 50 V or more

<Degree of Scratch Generation on Surface>

The degree of scratch generation on the surface of the photoreceptor after carrying out the photoreceptor running evaluation 1 is evaluated with the naked eye in the following manner (in the Table, denoted as the "initial scratch on the surface"). Thereafter, black solid patterns are printed on 50000 sheets under the same condition as in the photoreceptor running evaluation 1, and then the degree of scratch generation on the surface of the photoreceptor is evaluated with the naked eye in the following manner (in the Table, denoted as the "scratch on the surface over time").

A+ indicates the most satisfactory characteristics.

A+: Scratches are not observed even with a microscope.

A: Scratches are not found with the naked eye but small scratches are found with a microscope.

B: Scratches are partially generated.

C: Scratches are generated on the entire surface.

[Photoreceptor Running Evaluation 2]

The electrophotographic photoreceptor prepared in each of Examples is installed in DocuCentre Color 400 CP (manufactured by Fuji Xerox Co., Ltd.) and the patterns for image evaluation shown in FIG. 11A are printed under a low temperature and a low humidity (20° C., 30% RH) and taken as [Evaluation Images 1]. Then, black solid patterns are subsequently printed on 10000 sheets and taken as [Evaluation Images 2]. After being left to stand for 24 hours under a low temperature and low humidity environment (20° C., 30% RH), the patterns for image evaluation are printed and taken as [Evaluation Images 3]. Then, black solid patterns are printed on 5000 sheets under a high humidity (28° C., 60% RH), and the patterns for image evaluation are printed and taken as [Evaluation Images 4]. After being left to stand for 24 hours under a high humidity environment (28° C., 60% RH), patterns for image evaluation are printed and taken as [Evaluation Images 5]. Again, returning to a low temperature and low humidity environment (20° C., 30% RH), black solid patterns are printed on 20000 sheets, and the patterns for image evaluation are printed and taken as [Evaluation Images 6].

Evaluation of Ghost

As comparing [Evaluation Images 3] with [Evaluation Images 2], and [Evaluation Images 5] with [Evaluation Images 4], respectively, the degrees of deterioration of image quality are evaluated with the naked eye. A+ denotes the most satisfactory characteristics.

A+: State where the degree of deterioration is satisfactory as in FIG. 11A.

A: State where the degree of deterioration is satisfactory as in FIG. 11A but deterioration is slightly generated.

Figure 11B:
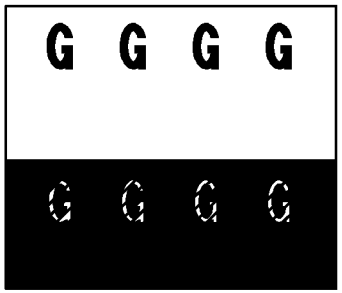

B: State where the degree of deterioration is slightly conspicuous as in FIG. 11B.

Figure 11C:
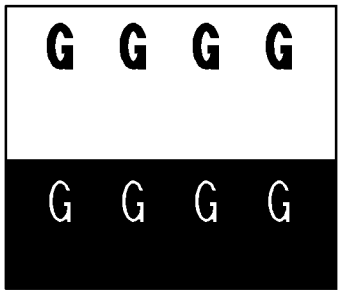

C: State where the degree of deterioration is clearly perceivable as in FIG. 11C.

TABLE 1

| | Composition of protective layer (the coating liquid) | | | | | | | | | | | | | |
|---|---|---|---|---|---|---|---|---|---|---|---|---|---|---|
| | Reactive group-containing charge transporting material | | Radical polymerizable monomer having no charge transportability | | Specific inorganic particles | | | | | Evaluation | | | | |
| | Kind | Number of parts | Kind | Number of parts | Kind | Number of parts | Inorganic particles before treatment | Surface treating agent Kind | Surface treating agent Number of parts | Image stability | Stability in electrical characteristics | Initial scratches on the surface | Scratches on the surface over time | Ghost |
| Ex. 1 | (I-c)-15 | 85 | None | — | (X1) | 15 | OX50 | KBM-503 | 2.5 | A | A | A | A | A |
| Comp. Ex. 1 | AC-1 | 85 | None | — | (X1) | 15 | OX50 | KBM-503 | 2.5 | B | B | B | C | B |
| Comp. Ex. 2 | AC-2 | 85 | None | — | (X1) | 15 | OX50 | KBM-503 | 2.5 | B | B | C | C | C |
| Comp. Ex. 3 | (I-c)-15 | 85 | None | — | (C1) | 15 | OX50 | None | — | C | C | C | C | C |
| Ex. 2 | (I-c)-15 | 85 | TMPTA | 15 | (X1) | 15 | OX50 | KBM-503 | 2.5 | A | A | A | A | A |
| Comp. Ex. 4 | AC-1 | 85 | TMPTA | 15 | (X1) | 15 | OX50 | KBM-503 | 2.5 | B | B | B | C | B |
| Ex. 3 | (I-c)-15 | 85 | TMPTA | 15 | (Ot1) | 15 | AA03 | KBM-503 | 40 | A | A | A | A | A |
| Comp. Ex. 5 | AC-1 | 85 | TMPTA | 15 | (Ot1) | 15 | AA03 | KBM-503 | 40 | B | C | B | C | C |
| Ex. 4 | (I-b)-23 | 85 | None | — | (X1) | 15 | OX50 | KBM-503 | 2.5 | A+ | A+ | A+ | A | A+ |
| Ex. 5 | (I-b)-29 | 85 | None | — | (X1) | 15 | OX50 | KBM-503 | 2.5 | A | A | A+ | A | A |
| Ex. 6 | (I-c)-30 | 85 | None | — | (X1) | 15 | OX50 | KBM-503 | 2.5 | A+ | A+ | A+ | A | A+ |
| Ex. 7 | (I-c)-43 | 85 | None | — | (X1) | 15 | OX50 | KBM-503 | 2.5 | A | A | A+ | A+ | A |
| Ex. 8 | (I-c)-53 | 85 | None | — | (X1) | 15 | OX50 | KBM-503 | 2.5 | A | A | A+ | A+ | A |
| Ex. 9 | (I-d)-22 | 85 | None | — | (X1) | 15 | OX50 | KBM-503 | 2.5 | A | A | A+ | A+ | A |
| Ex. 10 | (I-d)-28 | 85 | None | — | (X1) | 15 | OX50 | KBM-503 | 2.5 | A | A | A+ | A+ | A |
| Ex. 11 | (II)-13 | 85 | None | — | (X1) | 15 | OX50 | KBM-503 | 2.5 | A+ | A+ | A | A | A+ |
| Ex. 12 | (II)-50 | 85 | None | — | (X1) | 15 | OX50 | KBM-503 | 2.5 | A++ | A++ | A+ | A+ | A+ |
| Ex. 13 | (II)-58 | 85 | None | — | (X1) | 15 | OX50 | KBM-503 | 2.5 | A++ | A++ | A+ | A+ | A+ |
| Ex. 14 | (II)-33 | 85 | None | — | (X1) | 15 | OX50 | KBM-503 | 2.5 | A++ | A++ | A+ | A+ | A+ |
| Ex. 15 | (II)-33 | 85 | None | — | (Ot3) | 15 | Aerosil 50 | KBM-503 | 3 | A++ | A++ | A+ | A+ | A+ |
| Ex. 16 | (II)-33 | 85 | None | — | (Ot4) | 10 | Aerosil 90 | KBM-503 | 3.5 | A++ | A++ | A+ | A+ | A+ |
| Ex. 17 | (II)-33 | 85 | None | — | (Ot5) | 10 | Aerosil 130 | KBM-503 | 15 | A++ | A++ | A+ | A+ | A+ |
| Ex. 18 | (II)-33 | 85 | None | — | (Ot6) | 10 | Aerosil 300 | KBM-503 | 30 | A++ | A++ | A+ | A+ | A+ |
| Ex. 19 | (II)-33 | 85 | None | — | (Ot7) | 15 | MEK-ST-L | KBM-503 | 30 | A+ | A+ | A+ | A+ | A+ |
| Ex. 20 | (II)-33 | 85 | None | — | (Ot8) | 10 | MEK-ST | KBM-503 | 40 | A+ | A+ | A+ | A+ | A+ |

TABLE 2

| | Composition of protective layer (the coating liquid) | | | | | | | | | | | | | |
|---|---|---|---|---|---|---|---|---|---|---|---|---|---|---|
| | Reactive group-containing charge transporting material | | Radical polymerizable monomer having no charge transportability | | Specific inorganic particles | | | | | Evaluation | | | | |
| | Kind | Number of parts | Kind | Number of parts | Kind | Number of parts | Inorganic particles before treatment | Surface treating agent Kind | Surface treating agent Number of parts | Image stability | Stability in electrical characteristics | Initial scratches on the surface | Scratches on the surface over time | Ghost |
| Ex. 21 | (II)-33 | 85 | None | — | (Ot2) | 15 | AA03 | KBM-503 | 50 | A+ | A+ | A+ | A+ | A+ |
| Ex. 22 | (II)-33 | 85 | None | — | (Ot9) | 10 | CR97 | KBM-503 | 65 | A+ | A+ | A+ | A+ | A+ |
| Ex. 23 | (II)-33 | 85 | None | — | (X2) | 15 | OX50 | KBM-5103 | 2.5 | A++ | A++ | A+ | A+ | A+ |
| Ex. 24 | (II)-33 | 85 | None | — | (X3) | 15 | OX50 | KBM-1403 | 3.5 | A++ | A++ | A+ | A+ | A+ |
| Ex. 25 | (II)-33 | 85 | None | — | (X4) | 30 | OX50 | KBM-503 | 2.5 | A++ | A++ | A+ | A+ | A+ |
| Ex. 26 | (I-c)-15 | 85 | Maleic anhydride | 15 | (X5) | 15 | OX50 | KBM-403 | 2.5 | B | A | A | A | A |
| Ex. 27 | (II)-181 | 85 | None | — | (X1) | 15 | OX50 | KBM-503 | 2.5 | A++ | A++ | A+ | A+ | A+ |
| Ex. 28 | (II)-182 | 85 | None | — | (X1) | 15 | OX50 | KBM-503 | 2.5 | A++ | A++ | A+ | A+ | A+ |

From the results above, it is seen that in the present Examples, the satisfactory results are obtained as compared with Comparative Examples in the evaluation of all of image stability, electrical characteristics stability, initial scratches on the surface, scratches on the surface over time, and ghost.

The details of the abbreviations shown in Tables are shown below.

Reactive Group-Containing Charge Transporting Material (I-b)-23: Exemplary compound (I-b)-23

(I-b)-29: Exemplary compound (I-b)-29

(I-c)-15: Exemplary compound (I-c)-15 (see the following synthesis method)

(I-c)-30: Exemplary compound (I-c)-30

(I-c)-43: Exemplary compound (I-c)-43 (see the following synthesis method)

(I-c)-53: Exemplary compound (I-c)-53

(I-d)-22: Exemplary compound (I-d)-22

(I-d)-28: Exemplary compound (I-d)-28

(II)-13: Exemplary compound (II)-13

(II)-33: Exemplary compound (II)-33

(II)-50: Exemplary compound (II)-50

(II)-58: Exemplary compound (II)-58

(II)-181: Exemplary compound (II)-181

(II)-182: Exemplary compound (II)-182

AC-1: Charge transporting material represented by the following structural formula AC-2: Charge transporting material represented by the following structural formula Synthesis of Exemplary Compound (I-c)-15

To a 500-ml three necked flask are added 68.3 g of 4,4'-bis(2-methoxycarbonylethyl)diphenylamine, 46.4 g of 4-iodoxylene, 30.4 g of potassium carbonate, 1.5 g of copper sulfate pentahydrate, and 50 ml of n-tridecane, and the system is stirred for 20 hours while heating at 220° C. under a nitrogen flow. Thereafter, the temperature is lowered to room temperature, and 200 ml of toluene and 150 ml of water are added to the system to perform a liquid separation operation. The toluene layer is collected, 20 g of sodium sulfate is added thereto, followed by stirring for 10 minutes, and then sodium sulfate is filtered. A crude product formed by the evaporation of toluene under reduced pressure is purified by silica gel column chromatography using toluene/ethyl acetate as an eluent to obtain 65.1 g (yield of 73%) of (I-c)-15a.

To a 3-L three necked flask are added 59.4 g of (I-c)-15a and 450 ml of tetrahydrofuran, and an aqueous solution having 11.7 g of sodium hydroxide dissolved in 450 ml of water is added thereto, followed by stirring at 60° C. for 3 hours. Thereafter, the reaction liquid is added dropwise to an aqueous solution of 1 L of water/60 ml of concentrated hydrochloric acid, and the precipitated solid is collected by suction filtration. This solid is made into a suspension state by further adding 50 ml of a mixed solvent of acetone/water (volume ratio of 40/60) thereto, followed by stirring, and the solid is collected by suction filtration and dried in vacuum for 10 hours to obtain 46.2 g (yield of 83%) of (I-c)-15b.

To a 500-ml three necked flask are added 29.2 g of (I-c)-15b, 23.5 g of 4-chloromethylstyrene, 21.3 g of potassium carbonate, 0.17 g of nitrobenzene, and 175 ml of DMF (N,N-dimethylformamide), and the system is stirred for hours while heating at 75° C. under a nitrogen flow. Thereafter, the temperature is lowered to room temperature, and the reaction solution is subjected to a liquid separation operation by the addition of 200 ml of ethyl acetate/200 ml of water. The ethyl acetate layer is collected, 10 g of sodium sulfate is added thereto, followed by stirring for 10 minutes, and then sodium sulfate is filtered. A crude product formed by the evaporation of ethyl acetate under reduced pressure is purified by silica gel column chromatography using toluene/ethyl acetate as an eluent to obtain 36.4 g (yield of 80%) of (I-c)-15.

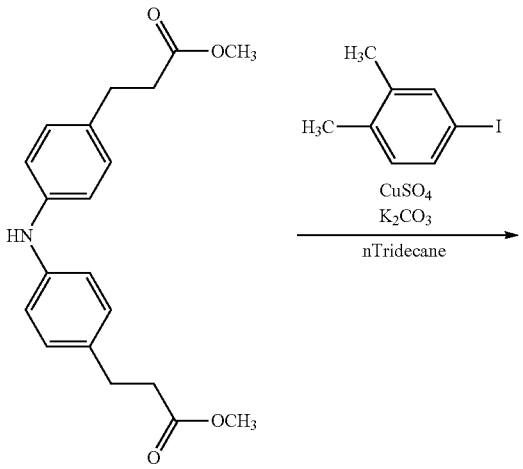

-continued

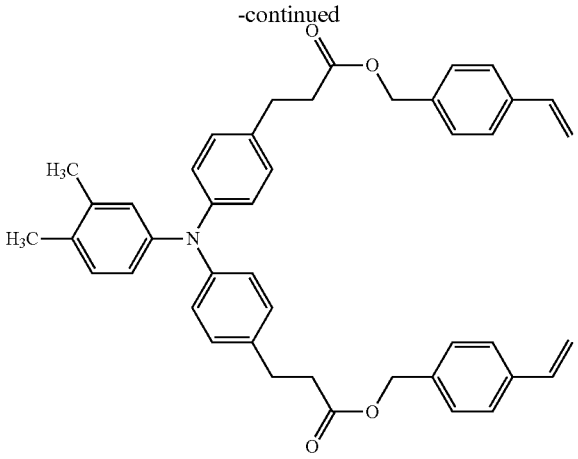

(I-c)-15

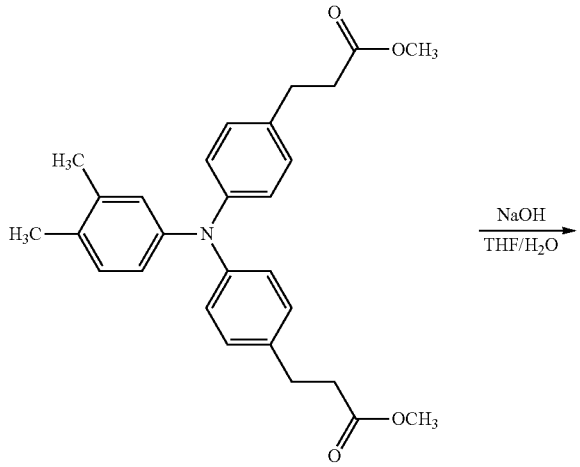

(I-c)-15a

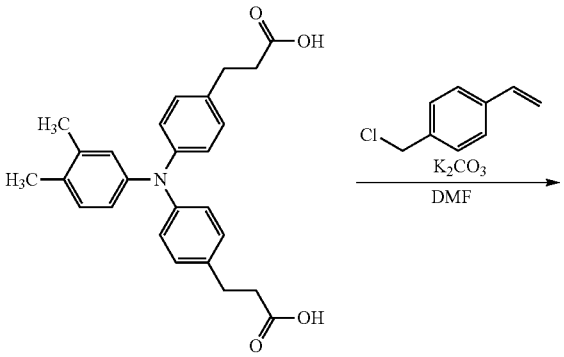

(I-c)-15b

Synthesis of Exemplary Compound (I-c)-43

To a 500-ml three necked flask are added 68.3 g of 4,4'-bis(2-methoxycarbonylethyl)diphenylamine, 43.4 g of 4,4'-diiodo-3,3'-dimethyl-1,1'-biphenyl, 30.4 g of potassium carbonate, 1.5 g of copper sulfate pentahydrate, and 50 ml of n-tridecane, and the system is stirred for 20 hours while heating at 220° C. under a nitrogen flow. Thereafter, the temperature is lowered to room temperature, and 200 ml of toluene and 150 ml of water are added to the system to perform a liquid separation operation. The toluene layer is collected, 10 g of sodium sulfate is added thereto, followed by stirring for 10 minutes, and then sodium sulfate is filtered. A crude product formed by evaporation of toluene under reduced pressure is purified by silica gel column chromatography using toluene/ethyl acetate as an eluent to obtain 56.0 g (yield of 65%) of (I-c)-43a.

To a 3-L three necked flask are added 43.1 g of (I-c)-43a and 350 ml of tetrahydrofuran, and an aqueous solution having 8.8 g of sodium hydroxide dissolved in 350 ml of water is added thereto, followed by heating and stirring at 60° C. for 5 hours. Thereafter, the reaction liquid is added dropwise to an aqueous solution of 1 L of water/40 ml of concentrated hydrochloric acid, and the precipitated solid is collected by suction filtration. This solid is made into a suspension state by further adding 50 ml of a mixed solvent of acetone/water (volume ratio of 40/60) thereto, followed by stirring, and the solid is collected by suction filtration and dried in vacuum for 10 hours to obtain 36.6 g (yield of 91%) of (I-c)-43b.

To a 500-ml three necked flask are added 28.2 g of (I-c)-43b, 23.5 g of 4-chloromethylstyrene, 21.3 g of potassium carbonate, 0.09 g of nitrobenzene, and 175 ml of DMF (N,N-dimethylformamide), and the system is stirred for hours while heating at 75° C. under a nitrogen flow. Thereafter, the temperature is lowered to room temperature, and the reaction solution is subjected to a liquid separation operation by the addition of 200 ml of ethyl acetate/200 ml of water. The ethyl acetate layer is collected, 10 g of sodium sulfate is added thereto, followed by stirring for 10 minutes, and then sodium sulfate is filtered. A crude product formed by evaporation of ethyl acetate under reduced pressure is purified by silica gel column chromatography using toluene/ethyl acetate as an eluent to obtain 37.8 g (yield of 85%) of (I-c)-43.

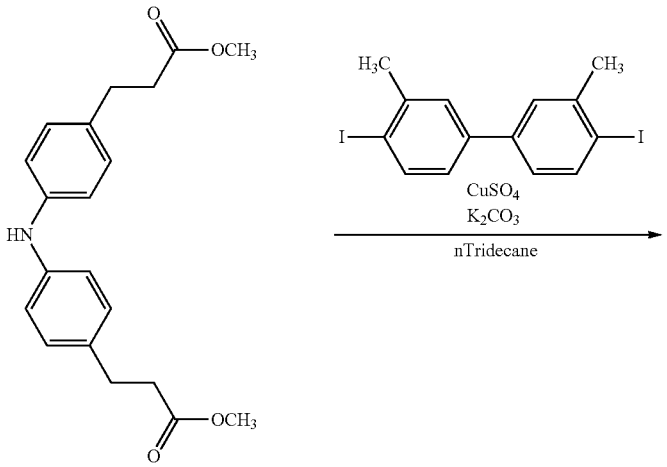
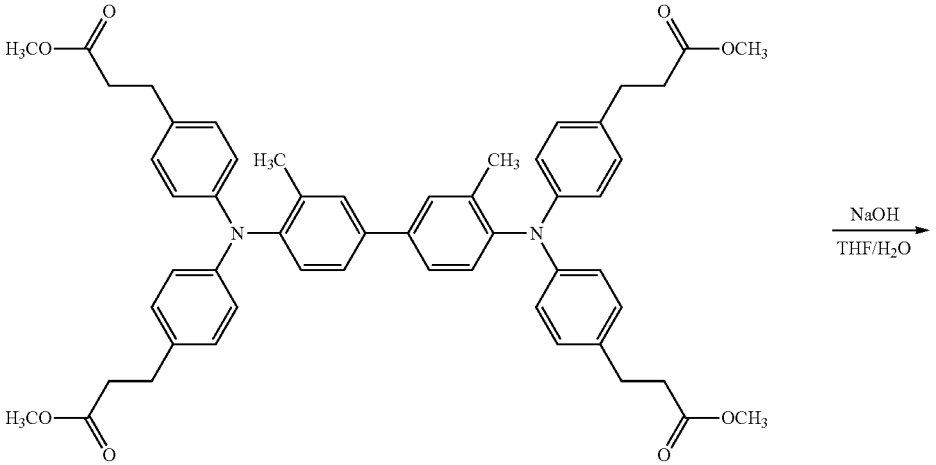
(I-c)-43a
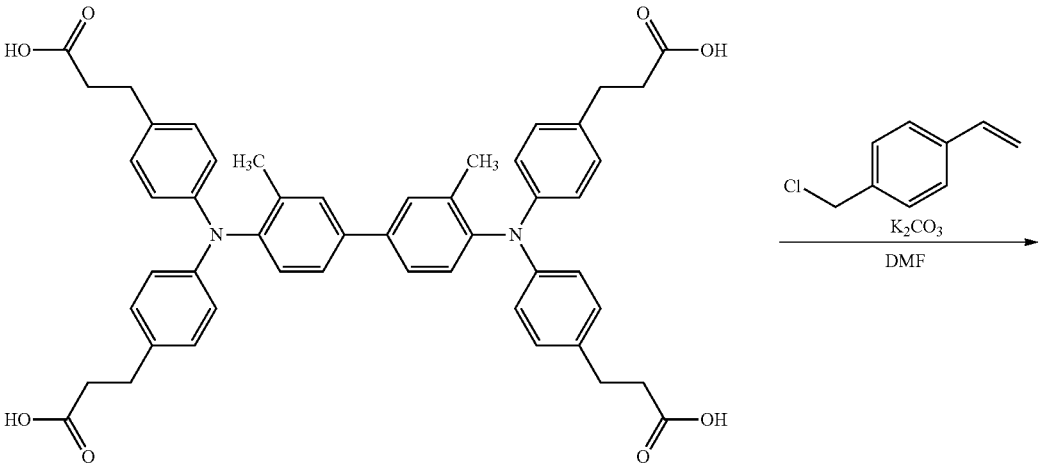
(I-c)-43b

-continued

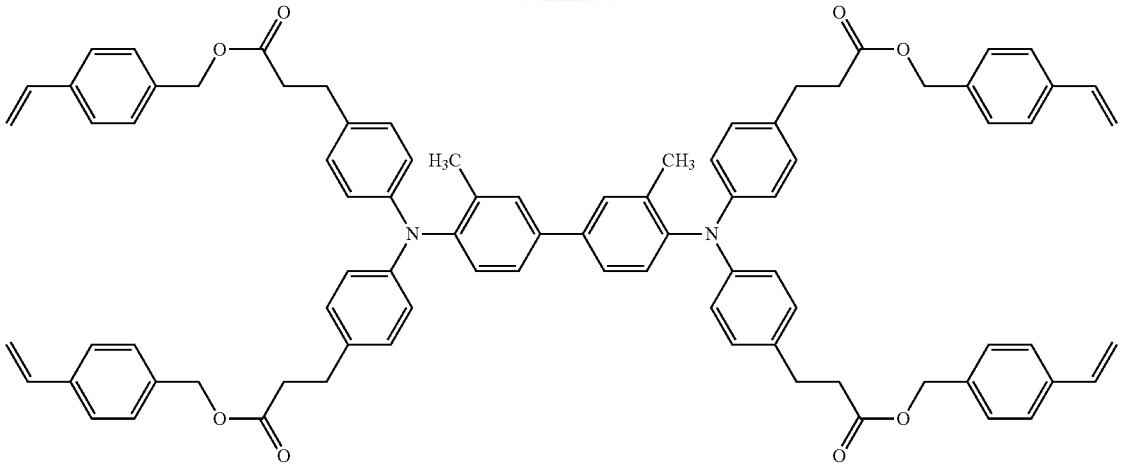

(I-c)-43

Furthermore, other exemplary compounds are also synthesized in accordance with the synthesis above.

(AC-1)

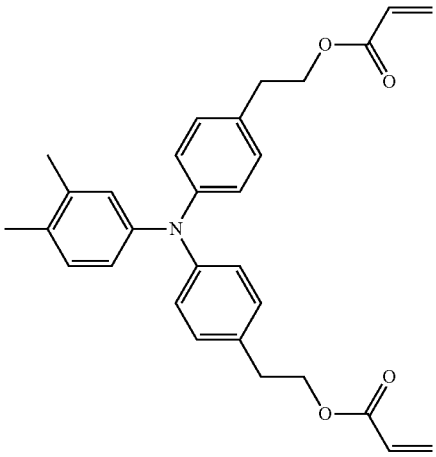

(AC-2)

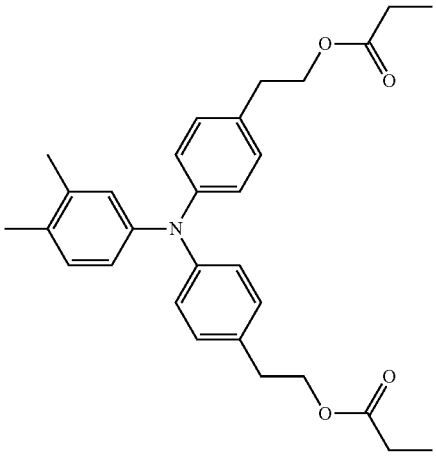

Radically Polymerizable Monomer Having No Charge Transportability: Compound Having Unsaturated Bond TMPTA: Trimethylolpropane triacrylate (KAYARAD TMPTA, manufactured by Nippon Kayaku Co., Ltd.: molecular weight: 382, number of functional groups: trifunctional, molecular weight/number of functional groups=99)

Specific Inorganic Particles (X1): Inorganic particles (X1) prepared by the following method Preparation of Inorganic Particles (X1)

To 900 parts by weight of a mixed solvent of water and ethanol (water:ethanol=2:8) are added 100 parts by weight of fumed silica particles (OX50, manufactured by Nippon Aerosil Co., Ltd., and average primary particle diameter of 40 nm) as the inorganic particles before the treatment, and 2.5 parts by weight of 3-methacryloxypropyltrimethoxysilane (KBM-503, manufactured by Shin-Etsu Chemical Co., Ltd.) as a surface treating agent, followed by stirring for 30 minutes and subjecting the inorganic particles to a surface treatment with a surface treating agent. After the surface treatment, the inorganic particles dispersion is subjected to replacement of solvents with tetrahydrofuran three times by a centrifuge to prepare a dispersion of 20% by weight of inorganic particles (X).

(X1) to (X4), and (Ot1) to (Ot9): In the same manner as for the inorganic particles (X1) except that the kind of the inorganic particles before the treatment, the kind of the surface treating agent, and the number of parts (parts by weight based on 100 parts by weight of the inorganic particles before the treatment) are changed according to Tables 1 and 2, inorganic particles are prepared.

(C1): Fumed silica particles that are not surface-treated (OX50, manufactured by Nippon Aerosil Co., Ltd., and average primary particle diameter of 40 nm)

Inorganic Particles Before Treatment

OX50: Fumed silica particles (manufactured by Nippon Aerosil Co., Ltd., average primary particle diameter of 40 nm)

Aerosil 50: Fumed silica particles (manufactured by Nippon Aerosil Co., Ltd., average primary particle diameter of 30 nm)

Aerosil 90: Fumed silica particles (manufactured by Nippon Aerosil Co., Ltd., average primary particle diameter of 20 nm)

Aerosil 130: Fumed silica particles (manufactured by Nippon Aerosil Co., Ltd., average primary particle diameter of 16 nm)

Aerosil 300: Fumed silica particles (manufactured by Nippon Aerosil Co., Ltd., average primary particle diameter of 7 nm)

MEK-ST-L: Colloidal silica particles (manufactured by Nissan Chemical Industries, Ltd., average primary particle diameter of from 40 nm to 50 nm)

MEK-ST: Colloidal silica particles (manufactured by Nissan Chemical Industries, Ltd., average primary particle diameter of from 10 nm to 20 nm)

AA03: Alumina particles (manufactured by Sumitomo Chemical Co., Ltd., average primary particle diameter of 300 nm)

CR97: Titanium oxide particles (manufactured by Ishihara Sangyo Kaisha, Ltd., average primary particle diameter of 250 nm)

Surface Treating Agent

KBM-503: 3-Methacryloxypropyltrimethoxysilane (manufactured by Shin-Etsu Chemical Co., Ltd.)

KBM-5103: 3-Acryloxypropyltrimethoxysilane (manufactured by Shin-Etsu Chemical Co., Ltd.)

KBM-1403: 4-Styryltrimethoxysilane (manufactured by Shin-Etsu Chemical Co., Ltd.)

KBM-403: 3-Glycidopropyltrimethoxysilane (manufactured by Shin-Etsu Chemical Co., Ltd.)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate; and a photosensitive layer provided on the conductive substrate, wherein an outermost surface layer includes a cured film of a composition containing inorganic particles having polymerizable groups and a reactive compound represented by the following formula (I-c):

(I-c)

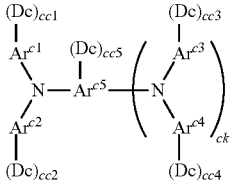

wherein $Ar^{c1}$ to $Ar^{c4}$ each independently represent a substituted or unsubstituted aryl group; $Ar^{c5}$ represents a substituted or unsubstituted aryl group, or a substituted or unsubstituted arylene group; Dc represents a group represented by the following formula (IA-c); cc1 to cc5 each independently represent an integer of 0 to 2; and ck represents 0 or 1; provided that a total number of Dc is from 1 to 8, (IA-c)

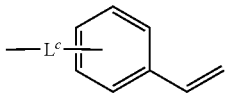

wherein $L^c$ represents a divalent linking group including one or more groups selected from the group consisting of: (i) —C(═O)—, (ii) —N(R)—, (iii) —S—, and (iv) a group formed by a combination of —C(═O)— with —O—, —N(R)—, or —S—; and R represents a hydrogen atom, an alkyl group, an aryl group, or an aralkyl group; wherein the inorganic particles having polymerizable groups are fumed silica particles having polymerizable groups.

2. The electrophotographic photoreceptor according to claim 1, wherein Dc represents a group represented by the following formula (IA-c1):

(IA-c1)

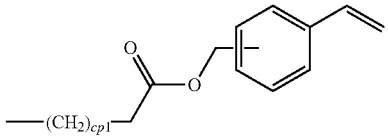

wherein cp1 represents an integer of 0 to 4.

3. The electrophotographic photoreceptor according to claim 1, wherein the inorganic particles having polymerizable groups are inorganic particles surface-treated with a hydrolyzable silane compound having a polymerizable group.

4. The electrophotographic photoreceptor according to claim 1, wherein each polymerizable group of the inorganic particles having polymerizable groups is a functional group including at least one selected from an acryloyl group, a methacryloyl group, and a styryl group.

5. The electrophotographic photoreceptor according to claim 1, wherein $L^c$ represents a divalent linking group represented by one of the following formulae:

*—$(CH_2)_{cp}$—C(═O)—O—$(CH_2)_{cq}$—,

*—$(CH_2)_{cp}$—O—C(═O)—$(CH_2)_{cr}$—C(═O)—O—$(CH_2)_{cq}$—,

*—$(CH_2)_{cp}$—C(═O)—N(R)—$(CH_2)_{cq}$—,

*—$(CH_2)_{cp}$—C(═O)—S—$(CH_2)_{cq}$—,

*—$(CH_2)_{cp}$—N(R)—$(CH_2)_{cq}$—, and

*—$(CH_2)_{cp}$—S—$(CH_2)_{cq}$—, wherein cp represents an integer of from 0 to 6; cq represents an integer of from 1 to 6; cr represents an integer of from 1 to 6; R represents a hydrogen atom, an alkyl group, an aryl group, or an aralkyl group; and "*" represents a site linked to one of the groups represented by $Ar^{c1}$ to $Ar^{c5}$.

6. The electrophotographic photoreceptor according to claim 1, wherein $L^c$ represents a divalent linking group including —N(R)—, wherein R represents a hydrogen atom, an alkyl group, an aryl group, or an aralkyl group.

7. A process cartridge detachable from an image forming apparatus, wherein the process cartridge has an electrophotographic photoreceptor; and the electrophotographic photoreceptor is the electrophotographic photoreceptor according to claim 1.

8. An image forming apparatus comprising:

an electrophotographic photoreceptor;

a charging unit that charges a surface of the electrophotographic photoreceptor;

a latent image forming unit that forms an electrostatic latent image on a charged surface of the electrophotographic photoreceptor;

a developing unit that develops the electrostatic latent image formed on the surface of the electrophotographic photoreceptor by a developer containing a toner to form a toner image; and a transfer unit that transfers the toner image formed on the surface of the electrophotographic photoreceptor onto a recording medium, wherein the electrophotographic photoreceptor is the electrophotographic photoreceptor according to claim 1.

* * * * *